US010482816B2

(12) United States Patent
Toyomura

(10) Patent No.: US 10,482,816 B2
(45) Date of Patent: Nov. 19, 2019

(54) METHOD FOR DRIVING DISPLAY ELEMENT, DISPLAY DEVICE, AND ELECTRONIC DEVICE

(71) Applicant: SONY CORPORATION, Tokyo (JP)

(72) Inventor: Naobumi Toyomura, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 5 days.

(21) Appl. No.: 15/760,551

(22) PCT Filed: Jul. 19, 2016

(86) PCT No.: PCT/JP2016/071142
§ 371 (c)(1),
(2) Date: Mar. 15, 2018

(87) PCT Pub. No.: WO2017/056648
PCT Pub. Date: Apr. 6, 2017

(65) Prior Publication Data

US 2018/0261154 A1 Sep. 13, 2018

(30) Foreign Application Priority Data

Sep. 30, 2015 (JP) ..... 2015-193471

(51) Int. Cl.
*G09G 3/3233* (2016.01)

(52) U.S. Cl.
CPC ... *G09G 3/3233* (2013.01); *G09G 2300/0819* (2013.01); *G09G 2300/0866* (2013.01);
(Continued)

(58) Field of Classification Search
None
See application file for complete search history.

(56) References Cited

U.S. PATENT DOCUMENTS

2004/0253781 A1 12/2004 Kimura et al.
2009/0058771 A1* 3/2009 Toyomura ..... G09G 3/3233 345/80
(Continued)

FOREIGN PATENT DOCUMENTS

CN 1523547 A 8/2004
CN 102956194 A 3/2013
(Continued)

OTHER PUBLICATIONS

International Search Report and Written Opinion of PCT Application No. PCT/JP2016/071142, dated Oct. 25, 2016, 08 pages.

*Primary Examiner* — Nitin Patel
*Assistant Examiner* — Amen Woldesenbet Bogale
(74) *Attorney, Agent, or Firm* — Chip Law Group

(57) ABSTRACT

In driving a display element including an n-channel drive transistor in which a voltage is applied to one source/drain region and a light-emitting unit is connected to another source/drain region, and a capacitor connected between a gate electrode and the other source/drain region, processing is performed to: apply a drive voltage to the one source/drain region in a state where a reference voltage is applied to the gate electrode of the drive transistor, to bring a potential of the other source/drain region closer to a potential obtained by subtracting a threshold voltage of the drive transistor from the reference voltage; and subsequently, set the gate electrode in a floating state, and change a potential of the gate electrode in the floating state via parasitic capacitance and cause a current to flow via the drive transistor to increase a voltage between the other source/drain region and the gate electrode, and then apply the reference voltage to the gate electrode.

15 Claims, 31 Drawing Sheets

[T P$_3$]

[T P$_3$] (CONTINUATION)

(52) U.S. Cl.
CPC ..... *G09G 2320/0233* (2013.01); *G09G 2320/043* (2013.01); *G09G 2320/045* (2013.01)

(56) References Cited

U.S. PATENT DOCUMENTS

| | | | | |
|---|---|---|---|---|
| 2009/0115765 | A1* | 5/2009 | Toyomura | G09G 3/3233 345/211 |
| 2009/0294163 | A1* | 12/2009 | Yamamoto | G09G 3/3233 174/261 |
| 2013/0050160 | A1 | 2/2013 | Minami | |
| 2014/0132646 | A1* | 5/2014 | Aoki | G09G 3/3233 345/691 |

FOREIGN PATENT DOCUMENTS

| | | | |
|---|---|---|---|
| CN | 103810977 | A | 5/2014 |
| EP | 2562743 | A1 | 2/2013 |
| JP | 2004-222256 | A | 8/2004 |
| JP | 2007-310311 | A | 11/2007 |
| JP | 2013-044891 | A | 3/2013 |
| JP | 2014-098736 | A | 5/2014 |
| KR | 2004-0057952 | A | 7/2004 |
| TW | I307165 | B | 3/2009 |

* cited by examiner

[TP$_0$]

[TP$_1$]

[ T P$_2$ ]

[ T P$_2$ ] (CONTINUATION)

[TP$_3$]

[TP$_4$]

[TP$_4$]

[TP$_5$]

$$V_{bst} = \frac{C_S}{C_S + C_p} \cdot V_{up} = G_{bst} \cdot V_{up}$$

$$G_{bst} \equiv \frac{C_S}{C_S + C_p}$$

[ T P$_2$ ]

[ T P$_2$ ] (CONTINUATION)

[T P$_3$]

[T P$_3$] (CONTINUATION)

[ T $P_3$ ] (CONTINUATION)

[ T $P_3$ ] (CONTINUATION)

POTENTIAL OF DTLn
POTENTIAL OF SCLm
POTENTIAL OF PS1n
TP3
TP4
TP5
Vofs
Vsig_m
VCC-H
VCC-M
THRESHOLD VOLTAGE CANCELLATION PROCESSING
[A]
BOOTSTRAP OPERATION
[B]
GATE VOLTAGE REINITIALIZATION
[C]
WAIT FOR WRITE
[D]
WRITE PROCESSING
[E]
LIGHT EMISSION DUE TO BOOTSTRAP OPERATION
[F]
Vsig
VEL
Vofs
Vofs−Vth1
Vofs−Vth2
Vofs−Vth1+Va1
Vofs−Vth2+Va2
VA1
VA2
Vg1, g2
Vs1
Vs2

FIG. 17

| CHARACTERISTICS OF DRIVE TRANSISTOR | NOTATION | [A] THRESHOLD VOLTAGE CANCELLATION PROCESSING | [B] BOOTSTRAP OPERATION | [C] GATE VOLTAGE REINITIALIZATION | [D] | [E] WRITE PROCESSING | [F] LIGHT EMISSION |
|---|---|---|---|---|---|---|---|
| CASE OF THRESHOLD VOLTAGE [$V_{th1}$] | $V_{g1}$ | $V_{Ofs}$ | $V_{Ofs}+0.6V_{A1}$ | $V_{Ofs}$ | → | $V_{Sig}$ | $V_{Sig}+0.6(V_{EL}-(V_{Ofs}-V_{th1}+V_{a1}))$ |
| | $V_{s1}$ | $V_{Ofs}-V_{th1}$ | $V_{Ofs}-V_{th1}+V_{A1}$ | $V_{Ofs}-V_{th1}+V_{a1}$ | → | → | $V_{EL}$ |
| | $V_{gs1}$ | $V_{th1}$ | $V_{th1}-V_{A1}$ | $V_{th1}-V_{a1}$ | → | $V_{Sig}-V_{Ofs}+V_{th1}-V_{a1}$ | $V_{Sig}-V_{Ofs}+V_{th1}-V_{a1}$ $-(V_{EL}-(V_{Ofs}-V_{th1}+V_{a1})\cdot(1-0.6))$ |
| CASE OF THRESHOLD VOLTAGE [$V_{th2}$] [ $V_{th2}$ ( $>V_{th1}$ ) ] | $V_{g2}$ | $V_{Ofs}$ | $V_{Ofs}+0.6V_{A2}$ | $V_{Ofs}$ | → | $V_{Sig}$ | $V_{Sig}+0.6(V_{EL}-(V_{Ofs}-V_{th2}+V_{a2}))$ |
| | $V_{s2}$ | $V_{Ofs}-V_{th2}$ | $V_{Ofs}-V_{th2}+V_{A2}$ | $V_{Ofs}-V_{th2}+V_{a2}$ | → | → | $V_{EL}$ |
| | $V_{gs2}$ | $V_{th2}$ | $V_{th2}-V_{A2}$ | $V_{th2}-V_{a2}$ | → | $V_{Sig}-V_{Ofs}+V_{th2}-V_{a2}$ | $V_{Sig}-V_{Ofs}+V_{th2}-V_{A2}$ $-(V_{EL}-(V_{Ofs}-V_{th2}+V_{a2})\cdot(1-0.6))$ |

[TP$_3$] (CONTINUATION)

METHOD FOR DRIVING DISPLAY ELEMENT, DISPLAY DEVICE, AND ELECTRONIC DEVICE

CROSS REFERENCE TO RELATED APPLICATIONS

This application is a U.S. National Phase of International Patent Application No. PCT/JP2016/071142 filed on Jul. 19, 2016, which claims priority benefit of Japanese Patent Application No. JP 2015-193471 filed in the japan Patent Office on Sep. 30, 2015. Each of the above-referenced applications is hereby incorporated herein by reference in its entirety.

TECHNICAL FIELD

The present disclosure relates to a method for driving a display element, a display device, and an electronic device.

BACKGROUND ART

A display element including a current drive type light-emitting unit, and a display device including the display element are known. For example, a display element including a light-emitting unit utilizing electroluminescence of an organic material (hereinafter may be simply referred to as an organic EL display element) is noted as a display element capable of high luminance light emission by low voltage direct current drive.

Similarly to a liquid crystal display device, for example, in a display device including the organic EL display element, a simple matrix system and an active matrix system are known as a drive system. The active matrix system has a disadvantage that its structure is complicated, but has an advantage that a luminance of an image can be increased, for example. The organic EL display element driven by the active matrix system includes a light-emitting unit including an organic layer including a light emitting layer and the like, and also includes a drive circuit for driving the light-emitting unit.

As a circuit for driving the current drive type light-emitting unit, for example, a drive circuit including two transistors and one capacitor (referred to as a 2Tr/1C drive circuit) is known from, for example, Japanese Patent Application Laid-Open No. 2007-310311 (Patent Document 1). As illustrated in FIG. 1, the 2Tr/1C drive circuit includes two transistors, a write transistor $TR_W$ and a drive transistor $TR_D$, and one capacitor $C_S$. Here, a gate electrode of the drive transistor $TR_D$ configures a first node $ND_1$, and a source/drain region connected to a light-emitting unit ELP configures a second node $ND_2$.

The capacitor $C_S$ is used to hold a voltage of the gate electrode (so-called gate-source voltage) with respect to a source region of the drive transistor $TR_D$. Here, a threshold voltage $V_{th}$ of the drive transistor $TR_D$ varies for each display element. Therefore, if the voltage held by the capacitor $C_S$ is a voltage reflecting only a video signal voltage, luminance unevenness occurs due to variation in the threshold voltage $V_{th}$. For this reason, the drive circuit is driven such that the voltage held by the capacitor $C_S$ is a voltage reflecting the video signal voltage and the threshold voltage $V_{th}$.

If the write transistor $TR_W$ is set in a non-conductive state in a state where the voltage reflecting the video signal voltage and the threshold voltage $V_{th}$ is held by the capacitor $C_S$, a current flows via the drive transistor, and the light-emitting unit ELP emits light. A voltage of an anode electrode of the light-emitting unit ELP, in other words, a voltage of the second node $ND_2$ increases with light emission of the light-emitting unit ELP. At this time, the voltage of the gate electrode of the drive transistor $TR_D$, in other words, the voltage of the first node $ND_1$, increases due to bootstrap operation. If ideal bootstrap operation occurs, the gate-source voltage is kept before and after the bootstrap operation, so that the luminance unevenness does not occur due to the variation in the threshold voltage $V_{th}$ of the drive transistor.

CITATION LIST

Patent Document

Patent Document 1: Japanese Patent Application Laid-Open No. 2007-310311

SUMMARY OF THE INVENTION

Problems to be Solved by the Invention

Actually, due to influence of parasitic capacitance of the drive transistor $TR_D$ or the like, an amount of increase in the voltage of the first node $ND_1$ during the bootstrap operation is less than an amount of increase in the voltage of the second node $ND_2$. In addition, the amount of increase in the voltage of the second node $ND_2$ during the bootstrap operation changes in accordance with the threshold voltage $V_{th}$ of the drive transistor $TR_D$. For this reason, a degree of a voltage change of the capacitor $C_S$ before and after the bootstrap operation varies depending on a value of the threshold voltage $V_{th}$ of the drive transistor $TR_D$. Qualitatively, as the threshold voltage $V_{th}$ increases, the voltage of the capacitor $C_S$ decreases due to the bootstrap operation, and as a result, the current flowing through the light-emitting unit ELP decreases. This causes the luminance unevenness.

Therefore, an object of the present disclosure is to provide a display device and a method for driving the display device capable of reducing the luminance unevenness due to the bootstrap operation.

Solutions to Problems

A method for driving a display element of the present disclosure to achieve the object described above, includes:

in driving a display element including an n-channel drive transistor in which a voltage is applied to one source/drain region and a light-emitting unit is connected to another source/drain region, and a capacitor connected between a gate electrode of the drive transistor and the other source/drain region, performing threshold voltage cancellation processing that applies a drive voltage to the one source/drain region in a state where a reference voltage is applied to the gate electrode of the drive transistor, to bring a potential of the other source/drain region closer to a potential obtained by subtracting a threshold voltage of the drive transistor from the reference voltage;

subsequently, setting the gate electrode of the drive transistor in a floating state, and changing a potential of the gate electrode in the floating state via parasitic capacitance and causing a current to flow via the drive transistor to increase a voltage between the other source/drain region and the gate electrode, and then applying the reference voltage to the gate electrode of the drive transistor;

afterwards, performing write processing that applies a video signal voltage to the gate electrode of the drive transistor; and subsequently, setting the gate electrode of the drive transistor in the floating state to cause the light-emitting unit to emit light.

A display device of the present disclosure to achieve the object described above, includes:

a display unit in which a display element is disposed, the display element including an n-channel drive transistor in which a voltage is applied to one source/drain region and a light-emitting unit is connected to another source/drain region, and a capacitor connected between a gate electrode of the drive transistor and the other source/drain region; and a drive unit that drives the display unit, in which the drive unit performs threshold voltage cancellation processing that applies a drive voltage to the one source/drain region in a state where a reference voltage is applied to the gate electrode of the drive transistor, to bring a potential of the other source/drain region closer to a potential obtained by subtracting a threshold voltage of the drive transistor from the reference voltage, subsequently, sets the gate electrode of the drive transistor in a floating state, and changes a potential of the gate electrode in the floating state via parasitic capacitance and causing a current to flow via the drive transistor to increase a voltage between the other source/drain region and the gate electrode, and then applies the reference voltage to the gate electrode of the drive transistor, afterwards, performs write processing that applies a video signal voltage to the gate electrode of the drive transistor, and subsequently, sets the gate electrode of the drive transistor in the floating state to cause the light-emitting unit to emit light.

An electronic device of the present disclosure to achieve the object described above is an electronic device including a display device, in which the display device includes:

a display unit in which a display element is disposed, the display element including an n-channel drive transistor in which a voltage is applied to one source/drain region and a light-emitting unit is connected to another source/drain region, and a capacitor connected between a gate electrode of the drive transistor and the other source/drain region; and a drive unit that drives the display unit, in which the drive unit performs threshold voltage cancellation processing that applies a drive voltage to the one source/drain region in a state where a reference voltage is applied to the gate electrode of the drive transistor, to bring a potential of the other source/drain region closer to a potential obtained by subtracting a threshold voltage of the drive transistor from the reference voltage, subsequently, sets the gate electrode of the drive transistor in a floating state, and changes a potential of the gate electrode in the floating state via parasitic capacitance and causing a current to flow via the drive transistor to increase a voltage between the other source/drain region and the gate electrode, and then applies the reference voltage to the gate electrode of the drive transistor, afterwards, performs write processing that applies a video signal voltage to the gate electrode of the drive transistor, and subsequently, sets the gate electrode of the drive transistor in the floating state to cause the light-emitting unit to emit light.

Effects of the Invention

With the method for driving a display device according to the present disclosure, after the threshold voltage cancellation processing is performed, the gate electrode of the drive transistor is set in the floating state, and the potential of the gate electrode in the floating state is changed via the parasitic capacitance and the current is caused to flow via the drive transistor to increase the voltage between the other source/drain region and the gate electrode, and then the reference voltage is applied to the gate electrode of the drive transistor. A voltage change of the other source/drain region of the drive transistor due to this operation reduces a phenomenon that the voltage of the capacitor $C_S$ decreases due to the bootstrap operation as the threshold voltage $V_{th}$ increases. As a result, the luminance unevenness due to the bootstrap operation can be reduced. In the display device and the electronic device of the present disclosure, an image can be displayed with reduced luminance unevenness due to the bootstrap operation.

BRIEF DESCRIPTION OF DRAWINGS

FIG. 12A illustrates a case where a threshold voltage of the transistor is Vth1, and FIG. 12B illustrates a case where the threshold voltage of the drive transistor is Vth2 (>Vth1).

FIG. 17 is a table for explaining the voltage changes in FIG. 16.

FIGS. 29A and 19B are external views of a lens interchangeable single lens reflex type digital still camera, and FIG. 29A illustrates a front view of the camera and FIG. 29B illustrates a rear view of the camera.

MODE FOR CARRYING OUT THE INVENTION

Figure 1:
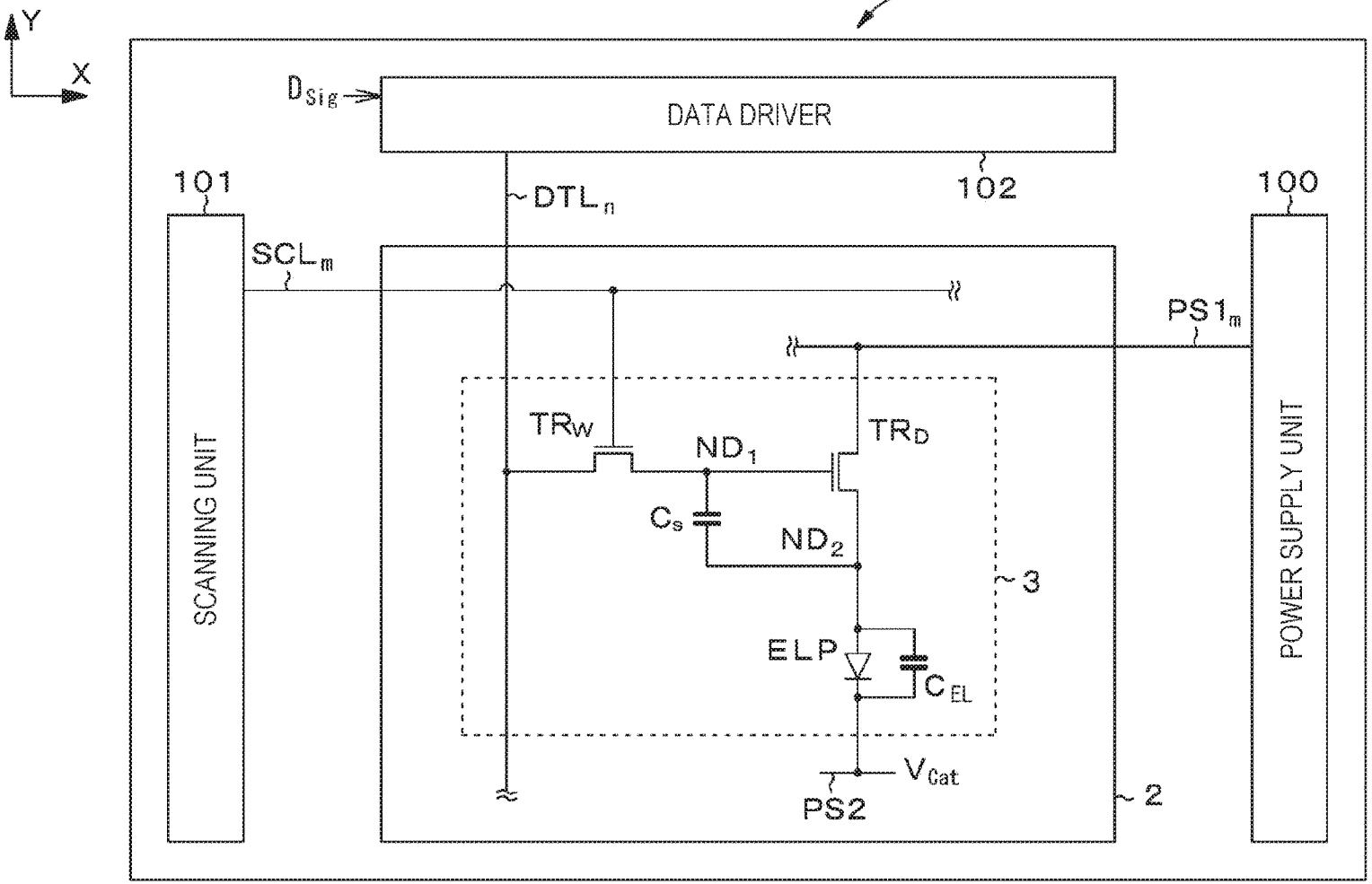
FIG. 1 is a conceptual diagram of a display device according to a first embodiment.

Hereinafter, the present disclosure will be described on the basis of embodiments with reference to the drawings. The present disclosure is not limited to the embodiments, and various numerical values and materials in the embodiments are examples. In the following description, the same reference signs will be used for the same elements or elements having the same function, and redundant description will be omitted. Note that, description will be made in the following order.

1. General Description related to Method for Driving Display Element, Display Device, and Electronic Device according to Present Disclosure
2. First Embodiment
3. Second Embodiment
4. Description of Electronic Device and Others General Description related to Method for Driving Display Element, Display Device, and Electronic Device according to Present Disclosure A method for driving a display element, a display device, and an electronic device according to the present disclosure (hereinafter may be simply referred to as "the present disclosure"), each can have a configuration in which threshold voltage cancellation processing is performed to apply a first drive voltage to one source/drain region in a state where a reference voltage is applied to a gate electrode of a drive transistor, to bring a potential of another source/drain region closer to a potential obtained by subtracting a threshold voltage of the drive transistor from the reference voltage, and subsequently, the gate electrode of the drive transistor is set in a floating state and a voltage of the one source/drain region of the drive transistor is switched to a second drive voltage exceeding the first drive voltage, to change a potential of the gate electrode in the floating state via parasitic capacitance and cause a current to flow via the drive transistor, to increase a voltage between the other source/drain region and the gate electrode, and then the reference voltage is applied to the gate electrode of the drive transistor.

The present disclosure including a preferable configuration described above can have a configuration in which before the threshold voltage cancellation processing, the potential of the other source/drain region is initialized by switching the voltage applied to the one source/drain region of the drive transistor from the second drive voltage to an initialization voltage. In this case, the initialization voltage can be a voltage set to a predetermined value lower than a voltage obtained by subtracting the threshold voltage of the drive transistor from the reference voltage.

The present disclosure including various preferable configurations described above can have a configuration in which the display element further includes a write transistor connected to the gate electrode of the drive transistor, and the video signal voltage is applied to the gate electrode of the drive transistor via the write transistor set in a conductive state. In this case, the present disclosure can have a configuration in which the reference voltage is applied to the gate electrode of the drive transistor via the write transistor set in the conductive state.

Alternatively, the present disclosure can have a configuration in which a voltage is applied to the one source/drain region of the drive transistor via a light emission control transistor, the threshold voltage cancellation processing is performed to apply the drive voltage to the one source/drain region of the drive transistor via the light emission control transistor set in a conductive state due to application of a first control voltage to its gate electrode, in a state where the reference voltage is applied to the gate electrode of the drive transistor, to bring the potential of the other source/drain region closer to the potential obtained by subtracting the threshold voltage of the drive transistor from the reference voltage, and subsequently, the gate electrode of the drive transistor is set in the floating state and the voltage applied to the gate electrode of the light emission control transistor is switched to a second control voltage exceeding the first control voltage, to change the potential of the gate electrode in the floating state via the parasitic capacitance and cause the current to flow via the drive transistor, to increase the voltage between the other source/drain region and the gate electrode, and then the reference voltage is applied to the gate electrode of the drive transistor.

Also in this case, the present disclosure can have a configuration in which the display element further includes a write transistor connected to the gate electrode of the drive transistor, and the video signal voltage is applied to the gate electrode of the drive transistor via the write transistor set in a conductive state. Then, the present disclosure can have a configuration in which before the threshold voltage cancellation processing, the light emission control transistor is set in the non-conductive state and a voltage exceeding the reference voltage is applied to the gate electrode of the drive transistor and subsequently the reference voltage is applied, to initialize the potential of the other source/drain region of the drive transistor. In this case, the present disclosure can have a configuration in which the voltage exceeding the reference voltage and the reference voltage are applied to the gate electrode of the drive transistor via the write transistor set in the conductive state.

The present disclosure including the various preferable configurations described above can have a configuration in which the potential of the other source/drain region of the drive transistor changes due to the current flowing through the drive transistor, in the write processing.

The present disclosure including various preferable configurations described above can have a configuration in which the light-emitting unit includes a current drive type electro-optical element whose light emission luminance varies in accordance with a value of a current flowing. Examples of the current drive type light-emitting unit include an organic electroluminescence light-emitting unit, an LED light-emitting unit, and a semiconductor laser light-emitting unit. These light-emitting units can be configured using known materials and methods. From a viewpoint of configuring a flat type display device, the light-emitting unit preferably includes the organic electroluminescence light-emitting unit among the current drive type light-emitting units.

The drive unit used in the present disclosure including various preferable configurations described above includes circuits such as a scanning unit, a data driver, and a power supply unit. These circuits can be configured using known circuit elements and the like.

The display device may have a so-called monochrome display configuration or a color display configuration. The color display configuration can have a configuration in which one pixel includes a plurality of sub-pixels, more specifically, one pixel includes three sub-pixels, a red light emitting sub-pixel, a green light emitting sub-pixel, and a blue light emitting sub-pixel. Further, the color display configuration can be configured from one set to which one or more kinds of sub-pixels are further added to these three kinds of sub-pixels (for example, one set to which a sub-pixel emitting white light is added for improving luminance, one set to which sub-pixels respectively emitting complementary colors are added for expanding a color reproduction range, one set to which a sub-pixel emitting yellow is added for expanding the color reproduction range, and one set to which sub-pixels respectively emitting yellow and cyan are added for expanding the color reproduction ranges).

As pixel values of the display device, some of the image display resolutions can be exemplified, such as VGA (640, 480), S-VGA (800, 600), XGA (1024, 768), APRC (1152, 900), S-XGA (1280, 1024), U-XGA (1600, 1200), HD-TV (1920,1080), and Q-XGA (2048,1536), and in addition, (1920, 1035), (720, 480), and (1280, 960); however, the pixel values are not limited to these values.

The display element configuring the display unit is formed in a certain plane (for example, formed on a support), and the light-emitting unit is formed above a drive circuit that drives the light-emitting unit, via an interlayer insulating layer, for example.

The drive circuit that drives the light-emitting unit can be configured as a circuit including a transistor and a capacitor. Examples of the transistor configuring the drive circuit include a thin film transistor (TFT). The transistor may be of an enhancement type or a depletion type. In an n-channel transistor, a lightly doped drain structure (LDD structure) may be formed. In some cases, the LDD structure may be formed asymmetrically. For example, since a large current flows through the drive transistor during light emission of the display element, it is also possible to adopt a configuration in which the LDD structure is formed only in the one source/drain region to be the drain region during the light emission. A configuration of the drive circuit is not particularly limited as far as the drive circuit is suitable for operation of the present disclosure.

In two source/drain regions included in one transistor, the term "one source/drain region" may be used in the meaning of a source/drain region connected to a power supply side. In addition, "a transistor is in a conductive state" means a state in which a channel is formed between the source/drain regions. It does not matter whether or not a current flows from the one source/drain region to the other source/drain region of the transistor. On the other hand, "a transistor is in a non-conductive state" means a state in which no channel is formed between the source/drain regions. In addition, the source/drain regions not only can be configured from a conductive material such as polysilicon or amorphous silicon containing impurities, but also can be configured from a metal, an alloy, conductive particles, a laminated structure thereof, or a layer including an organic material (conductive polymer).

The capacitor configuring the drive circuit can be configured from one electrode, the other electrode, and a dielectric layer sandwiched between these electrodes. The above-described transistor and the capacitor configuring the drive circuit are formed in a certain plane (for example, formed on the support), and the light-emitting unit is formed above the transistor and the capacitor configuring the drive circuit, via an interlayer insulating layer, for example. In addition, the other source/drain region of the drive transistor is connected to one end of the light-emitting unit (an anode electrode and the like included in the light-emitting unit) via a contact hole, for example. Note that, a configuration may be adopted in which a transistor is formed on a semiconductor substrate or the like.

Various wiring lines such as scanning lines, data lines, and feeder lines are formed on a certain plane (for example, on the support). These wiring lines can have known configurations and structures.

As a constituent material of the support or a substrate as described later, glass materials can be exemplified, such as high-strain point glass, soda glass ($Na_2O.CaO.SiO_2$), borosilicate glass ($Na_2O.B_2O_3.SiO_2$), forsterite ($2MgO.SiO_2$), and lead glass ($Na_2O.PbO.SiO_2$), and in addition, polymeric materials having flexibility can be exemplified, such as polyether sulfone (PES), polyimide, polycarbonate (PC), and polyethylene terephthalate (PET). Note that, various coatings may be applied to surfaces of the support and the substrate. The constituent materials of the support and the substrate may be the same as each other or different from each other. If the support and substrate including the polymeric material having flexibility are used, a display device having flexibility can be configured.

Conditions shown in various expressions in the present specification are satisfied not only in a case where each of the expressions mathematically strictly holds but also in a case where each of the expressions substantially holds. With respect to holding of the expressions, existence is permitted of various variations caused by designing or manufacturing the display element and the display device.

In the timing chart used in the following description, the length (time length) of the horizontal axis indicating each period is a schematic one and does not indicate the ratio of the time length of each period. This also applies to the vertical axis. The shape of the waveform in the timing chart is also schematic.

First Embodiment

A first embodiment relates to a display element and a method for driving the display element, and a display device and a method for driving the display device according to the present disclosure.

FIG. 1 is a conceptual diagram of the display device according to the first embodiment. A display device 1 includes a display unit 2. The display unit 2 includes display elements 3 each including a light-emitting unit and a drive circuit that drives the light-emitting unit. The display elements 3 are arranged in a two-dimensional matrix in a state of being connected to a scanning line SCL extending in a row direction (X direction in FIG. 1) and a data line DTL extending in a column direction (Y direction in FIG. 1). Note that, for convenience of illustration, FIG. 1 illustrates a connection relationship for one display element 3, more specifically, an (n, m)-th display element 3 as described later.

The display device 1 further includes a power supply unit 100, a scanning unit 101, and a data driver 102. A drive unit for driving the display unit 2 includes these units.

A scanning signal is supplied to the scanning line SCL from the scanning unit 101. A video signal voltage according to a luminance of an image to be displayed and the like are supplied to the data line DTL. A drive voltage and the like are supplied from the power supply unit 100 to a feeder line PS1. Note that, a common voltage (for example, a ground potential) is supplied to a common feeder line PS2 as described later.

Although not illustrated in FIG. 1, an area (display area) in which the display unit 2 displays an image includes the display elements 3 arranged in a two-dimensional matrix of N elements in the row direction and M elements in the column direction, total N×M elements. The number of rows of the display elements 3 in the display area is M, and the number of the display elements 3 configuring rows is N.

The number of the scanning lines SCL and the number of the feeder lines PS1 are each M. The display elements 3 in an m-th row (where m=1, 2, . . . , M) are connected to an m-th scanning line $SCL_m$ and an m-th feeder line $PS1_m$, and configure one display element row. Note that, in FIG. 1, only the scanning line $SCL_m$ and the feeder line $PS1_m$ are illustrated.

In addition, the number of the data lines DTL is N. The display elements 3 in an n-th column (where n=1, 2, . . . , N) are connected to an n-th data line $DTL_n$. Note that, in FIG. 1, only the data line $DTL_n$ is illustrated.

The display element 3 includes an n-channel drive transistor $TR_D$ in which a voltage is applied to one source/drain region and a light-emitting unit ELP is connected to the other source/drain region, and a capacitor $C_S$ connected between a gate electrode of the drive transistor $TR_D$ and the other source/drain region, and further includes a write transistor $TR_W$ connected to the gate electrode of the drive transistor $TR_D$. The drive transistor $TR_D$ and the write transistor $TR_W$ each include an n-channel TFT. Note that, for example, the write transistor $TR_W$ can include a p-channel TFT. In addition, the display element 3 may further include another transistor.

One source/drain region of the write transistor $TR_W$ is connected to the data line DTL, and its gate electrode is connected to the scanning line SCL.

The gate electrode of the drive transistor $TR_D$ is connected to the other source/drain region of the write transistor $TR_W$, and is connected to one electrode of the capacitor $C_S$, to configure a first node $ND_1$. One source/drain region of the drive transistor $TR_D$ is connected to the feeder line PS1, and the other source/drain region is connected to one end of the light-emitting unit ELP (more specifically, an anode electrode included in the light-emitting unit ELP) and is connected to the other electrode of the capacitor $C_S$, to configure a second node $ND_2$.

The capacitor $C_S$ is used to hold a voltage of the gate electrode (so-called gate-source voltage) with respect to a source region of the drive transistor $TR_D$. The "source region" in this case means a source/drain region on a side serving as a "source region" when the light-emitting unit ELP emits light. In a light emitting state of the display element 3, the one source/drain region (the side connected to the feeder line PS1 in FIG. 1) of the drive transistor $TR_D$ serves as a drain region, and the other source/drain region (one end of the light-emitting unit ELP, specifically, the side connected to the anode electrode) serves as a source region.

The display device 1 is a monochrome display device, for example, and one display element 3 configures one pixel. In accordance with the scanning signal from the scanning unit 101, line-sequential scanning is performed on the display device 1 for each row. The display element 3 located in the m-th row and the n-th column is hereinafter referred to as the (n, m)-th display element 3 or the (n, m)-th pixel. In addition, a scanning period (horizontal scanning period) assigned to the display element in the m-th row is represented by a reference sign $H_m$.

In the display device 1, the display elements 3 configuring N pixels arranged in the m-th row are simultaneously driven. In other words, in N display elements 3 arranged along the row direction, timing of light emission/non-light emission is controlled for each row to which the N display elements 3 belong. If a display frame rate of the display device 1 is represented as FR (times/second), the scanning period per row (so-called horizontal scanning period) when the line sequential scanning is performed on the display device 1 for each row is less than (1/FR)×(1/M) seconds.

A video signal $D_{Sig}$ representing a gradation according to an image to be displayed is input to the display device 1 from a device not illustrated, for example. The video signal $D_{Sig}$ is a digital signal having a gradation bit length such as 8 bits, 16 bits, and 24 bits. A video signal corresponding to the (n, m)-th display element 3 among the image signal $D_{Sig}$ input may be represented as $D_{Sig(n,\ m)}$.

The data driver 102 generates a voltage corresponding to a value of the video signal $D_{Sig}$ and supplies the voltage to the data line DTL. The video signal voltage corresponding to the video signal $D_{Sig}$ is represented as $V_{Sig}$. In addition, in a case of indicating that the video signal voltage $V_{Sig}$ corresponds to the (n, m)-th display element 3, for example, the video signal voltage may be represented as a video signal voltage $V_{Sig(n,\ m)}$ or a video signal voltage $V_{Sig_m}$.

Note that, in the first embodiment, the data driver 102 alternately supplies a reference voltage $V_{Ofs}$ and the video signal voltage $V_{Sig}$ to the data line DTL. Specifically, the reference voltage $V_{Ofs}$ is supplied in the first half of the horizontal scanning period and the video signal voltage $V_{Sig}$ is supplied in the latter half.

The power supply unit 100 supplies a first drive voltage $V_{CC\text{-}M}$, a second drive voltage $V_{CC\text{-}H}$, and an initialization voltage $V_{CC\text{-}L}$ to the feeder line PS1.

The scanning unit 101 supplies the scanning signal to the scanning line SCL. As a result, a conductive state/non-conductive state is controlled of the write transistor $TR_W$ connected to the scanning line SCL.

The light-emitting unit ELP is a current drive type electro-optical element whose light emission luminance varies in accordance with a value of a current flowing, and specifically, includes an organic electroluminescence element. The light-emitting unit ELP has known configuration and structure including an anode electrode, a hole transporting layer, a light emitting layer, an electron transporting layer, a cathode electrode, and the like.

A voltage $V_{Cat}$ (for example, 0 [volts]) is applied to the other end (specifically, the cathode electrode) of the light-emitting unit ELP from the common feeder line PS2. Capacitance of the light-emitting unit ELP is represented by a reference sign $C_{EL}$. In addition, a threshold voltage required for light emission of the light-emitting unit ELP is $V_{th\text{-}EL}$. If a voltage equal to or higher than $V_{th\text{-}EL}$ is applied between the anode electrode and the cathode electrode of the light-emitting unit ELP, the light-emitting unit ELP emits light.

Figure 2:
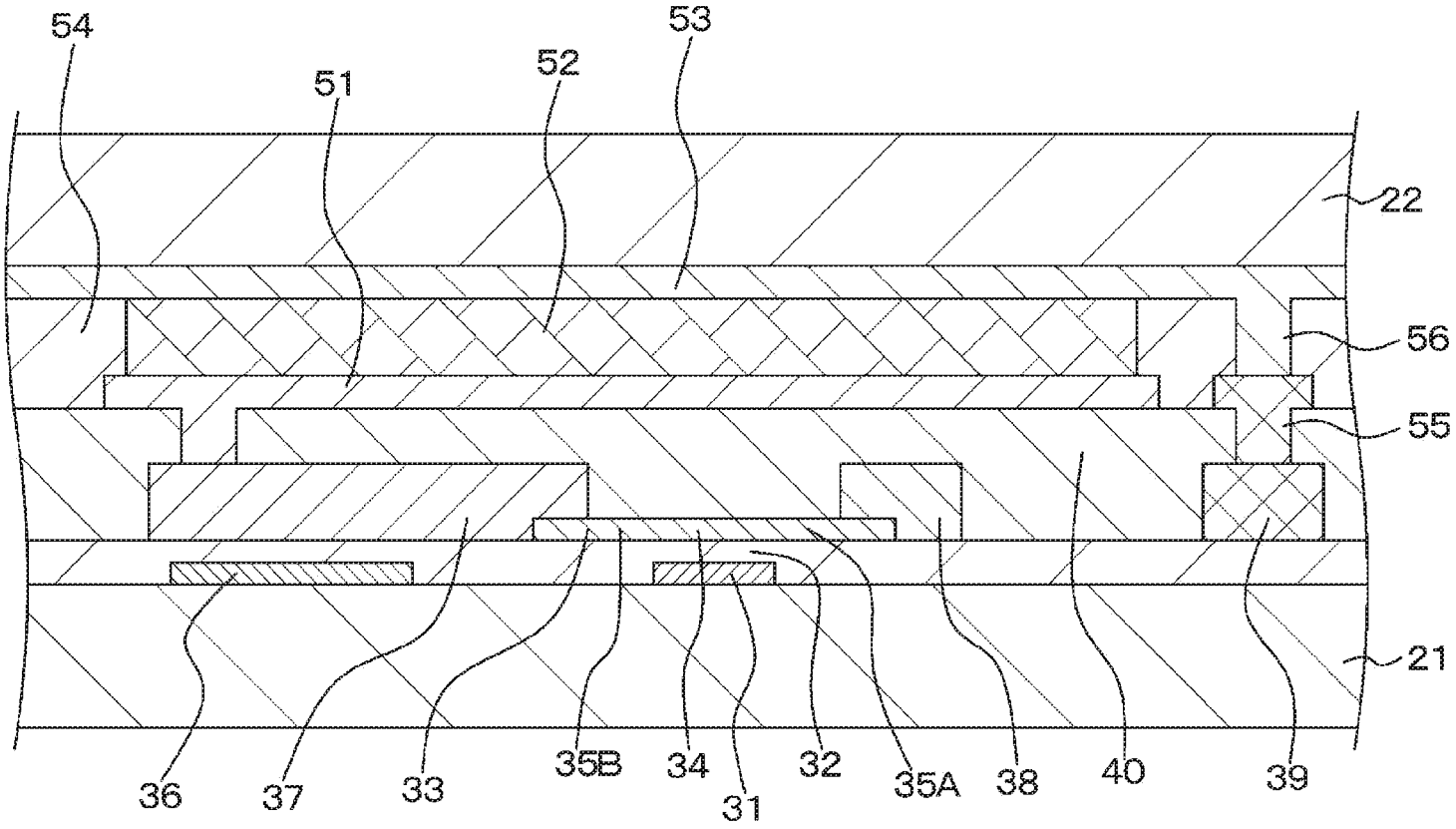
FIG. 2 is a schematic partial cross-sectional view of a portion including a display element in a display unit.

Here, arrangement relationships will be described among the light-emitting unit, the transistor, and the like. FIG. 2 is a schematic partial cross-sectional view of a portion including the display element in the display unit.

The transistors $TR_D$ and $TR_W$, and the capacitor $C_S$ are formed on a support 21, and the light-emitting unit ELP is formed above the transistors $TR_D$ and $TR_W$, and the capacitor $C_S$ via an interlayer insulating layer 40, for example. In addition, the other source/drain region of the drive transistor $TR_D$ is connected to the anode electrode included in the light-emitting unit ELP via a contact hole. Note that, in FIG. 2, only the drive transistor $TR_D$ is illustrated. Other transistors are hidden and invisible.

The drive transistor $TR_D$ includes a gate electrode 31, a gate insulating layer 32, one source/drain region 35A provided in a semiconductor layer 33, another source/drain region 35B, and a channel formation region 34 corresponding to a portion of the semiconductor layer 33 between the one source/drain region 35A and the other source/drain region 35B. Meanwhile, the capacitor $C_S$ includes one electrode 36, a dielectric layer configured by an extending portion of the gate insulating layer 32, and another electrode 37. The gate electrode 31, a portion of the gate insulating layer 32, and the one electrode 36 configuring the capacitor $C_S$ are formed on the support 21. The one source/drain region 35A of the drive transistor $TR_D$ is connected to a wiring line 38 (corresponding to the feeder line PS1), and the other source/drain region 35B is connected to the other electrode 37. The drive transistor $TR_D$, the capacitor $C_S$, and the like are covered with the interlayer insulating layer 40, and the light-emitting unit ELP is provided including an anode electrode 51, a hole transporting layer, a light emitting layer, an electron transporting layer, and a cathode electrode 53, on the interlayer insulating layer 40. Note that, in the figure, the hole transporting layer, the light emitting layer, and the electron transporting layer are represented by a single layer 52. A second interlayer insulating layer 54 is provided on a portion of the interlayer insulating layer 40 where the light-emitting unit ELP is not provided, and a transparent substrate 22 is disposed on the second interlayer insulating layer 54 and the cathode electrode 53. Light emitted from the light emitting layer passes through the substrate 22 and is emitted to the outside. Note that, the other electrode 37 and the anode electrode 51 are connected together by the contact hole provided in the interlayer insulating layer 40. In addition, the cathode electrode 53 is connected to a wiring line 39 (corresponding to the common feeder line PS2) provided on the extending portion of the gate insulating layer 32 via contact holes 56 and 55 provided in the second interlayer insulating layer 54 and the interlayer insulating layer 40.

Note that, areas of the electrodes configuring the light-emitting unit ELP are larger than areas of the electrodes configuring the capacitor $C_S$. Generally, a capacitance value is in a relationship of the capacitance $C_{EL}$ of the light-emitting unit ELP>the capacitor $C_S$.

In the light emitting state of the display element 3, the drive transistor $TR_D$ illustrated in FIG. 1 is subjected to a voltage setting to operate in a saturation region, and is driven to cause a drain current $I_{ds}$ to flow in accordance with an expression (1) below. As described above, in the light emitting state of the display element 3, the one source/drain region of the drive transistor $TR_D$ serves as the drain region and the other source/drain region serves as the source region. For convenience of description, the one source/drain region of the drive transistor $TR_D$ may be simply referred to as the drain region and the other source/drain region may be simply referred to as the source region. Note that, μ: Effective mobility L: Channel length W: Channel width $V_{gs}$: Voltage of gate electrode with respect to source region (gate-source voltage)

$V_{th}$: Threshold voltage $C_{ox}$: (Relative dielectric constant of gate insulating layer)×(dielectric constant of vacuum)/(thickness of gate insulating layer)

$$k \equiv (1/2)\cdot(W/L)\cdot C_{ox}.$$

$$I_{ds} = k\cdot\mu\cdot(V_{gs} - V_{th})^2 \quad (1)$$

The drain current $I_{ds}$ flows through the light-emitting unit ELP, whereby the light-emitting unit ELP of the display element 3 emits light. Further, intensity of light is controlled in the light-emitting unit ELP when the drain current $I_{ds}$ is flowing, by magnitude of a value of the drain current $I_{ds}$.

An outline of the display device 1 has been described above. Subsequently, an outline will be described of basic operation of the display device 1. Detailed operation will be described in detail later with reference to FIGS. 5A, 5B, 6A, 6B, 7A, 7B, 8A, 8B, 9, 10, 11, 12A, 12B, 13A, 13B, 14A, 14B, 15A, 15B, 16, and 17 as described later.

Figure 3:
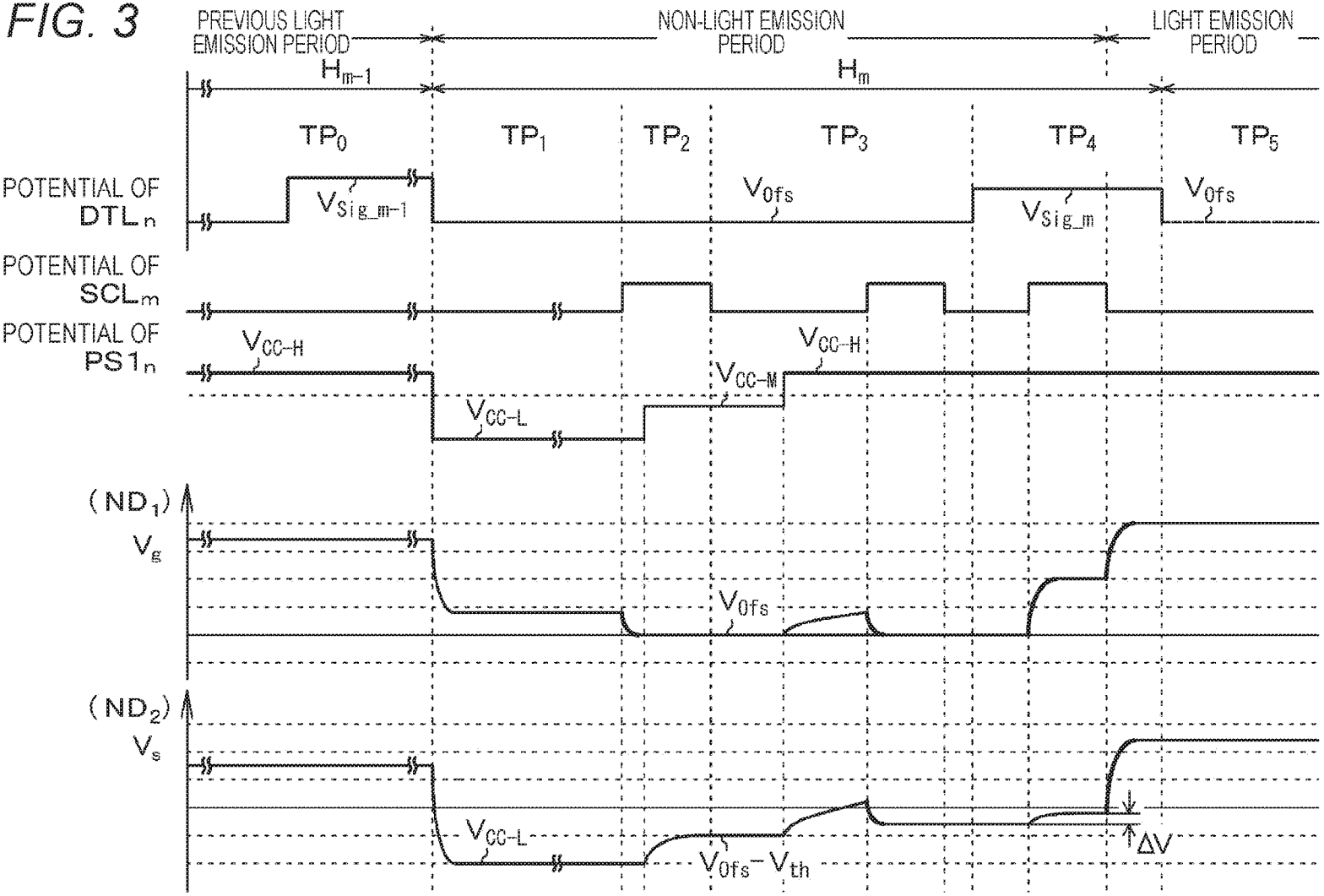
FIG. 3 is a schematic timing chart for explaining operation of the display device according to the first embodiment, more specifically, operation of an (n, m)-th display element of the display device.

FIG. 3 is a schematic timing chart for explaining operation of the display device according to the first embodiment, more specifically, operation of the (n, m)-th display element of the display device.

The present disclosure, in driving the display element 3 including the n-channel drive transistor $TR_D$ in which the voltage is applied to the one source/drain region and the light-emitting unit is connected to the other source/drain region, and the capacitor $C_S$ connected between the gate electrode of the drive transistor $TR_D$ and the other source/drain region, performs threshold voltage cancellation processing that applies a drive voltage to the one source/drain region in a state where the reference voltage $V_{Ofs}$ is applied to the gate electrode of the drive transistor $TR_D$, to bring a potential of the other source/drain region closer to a potential obtained by subtracting the threshold voltage $V_{th}$ of the drive transistor $TR_D$ from the reference voltage $V_{Ofs}$;

subsequently, sets the gate electrode of the drive transistor $TR_D$ in the floating state, and changes a potential of the gate electrode in the floating state via parasitic capacitance and causing a current to flow via the drive transistor $TR_D$ to increase a voltage between the other source/drain region and the gate electrode, and then applies the reference voltage $V_{Ofs}$ to the gate electrode of the drive transistor $TR_D$;

afterwards, performs write processing that applies the video signal voltage $V_{Sig}$ to the gate electrode of the drive transistor $TR_D$; and subsequently, sets the gate electrode of the drive transistor $TR_D$ in the floating state to cause the light-emitting unit to emit light.

Here, in the first embodiment, the threshold voltage cancellation processing is performed to apply the first drive voltage $V_{CC-M}$ to the one source/drain region in a state where the reference voltage $V_{Ofs}$ is applied to the gate electrode of the drive transistor $TR_D$, to bring the potential of the other source/drain region closer to the potential obtained by subtracting the threshold voltage $V_{th}$ of the drive transistor $TR_D$ from the reference voltage $V_{Ofs}$, and subsequently, the gate electrode of the drive transistor $TR_D$ is set in the floating state and the voltage of the one source/drain region of the drive transistor $TR_D$ is switched to the second drive voltage $V_{CC-H}$ exceeding the first drive voltage $V_{CC-M}$, to change the potential of the gate electrode in the floating state via the parasitic capacitance and cause the current to flow via the drive transistor $TR_D$, to increase the voltage between the other source/drain region and the gate electrode, and then the reference voltage $V_{Ofs}$ is applied to the gate electrode of the drive transistor $TR_D$.

In the following description, the values of the voltage or the potential are set as follows, but these are values for the purpose of illustration only and are not limited to these values.

$V_{Sig}$: Video signal voltage

. . . 0 volts to 15 volts $V_{Ofs}$: Reference voltage applied to gate electrode (first node $ND_1$) of drive transistor $TR_D$ . . . 0 volts $V_{CC-L}$: Initialization voltage for initializing potential of another source/drain region (second node $ND_2$) of drive transistor $TR_D$ . . . −10 volts $V_{CC-M}$: First drive voltage supplied during threshold voltage cancellation processing . . . 10 volts $V_{CC-H}$: Second drive voltage for causing current to flow through light-emitting unit ELP . . . 20 volts $V_{th}$: Threshold voltage of drive transistor $TR_D$ . . . 3 volts $V_{Cat}$: Voltage applied to cathode electrode of light-emitting unit ELP . . . 0 volts $V_{th-EL}$: Threshold voltage of light-emitting unit ELP . . . 4 volts A [period-$TP_0$] illustrated in FIG. 3 is, for example, of operation in a previous display frame, and is a period in which the (n, m)-th display element 3 is in the light emitting state. A drain current flows through the light-emitting unit ELP in the display element 3 configuring the (n, m)-th pixel via the drive transistor $TR_D$.

In a [period-$TP_1$], the voltage applied to the one source/drain region of the drive transistor $TR_D$ is switched from the second drive voltage $V_{CC-H}$ to the initialization voltage $V_{CC-L}$, whereby the potential of the other source/drain region is initialized.

Specifically, in the beginning period of the [period-$TP_1$], a voltage of the feeder line $PS1_m$ is switched from the drive voltage $V_{CC-H}$ to the initialization voltage $V_{CC-L}$, and the state is continued until the middle of a [period-$TP_2$]. Since the drive transistor $TR_D$ is in a conductive state, the potential of the other source/drain region of the drive transistor $TR_D$ (that is, the potential of the second node $ND_2$) decreases and is initialized to $V_{CC-L}$. As the voltage values exemplified, the initialization voltage $V_{CC-L}$ is a voltage set to a predetermined value lower than a voltage obtained by subtracting the threshold voltage $V_{th}$ of the drive transistor $TR_D$ from the reference voltage $V_{Ofs}$. Since the write transistor $TR_W$ is in the non-conductive state and the first node $ND_1$ and the second node $ND_2$ are connected together via the capacitor, the potential of the first node $ND_1$ also decreases with potential decrease in the second node $ND_2$.

Then, in the [period-$TP_2$], the threshold voltage cancellation processing is performed to apply the drive voltage (in the first embodiment, the first drive voltage $V_{CC-M}$) to the one source/drain region in a state where the reference voltage $V_{Ofs}$ is applied to the gate electrode of the drive transistor $TR_D$, to bring the potential of the other source/drain region closer to the potential obtained by subtracting the threshold voltage $V_{th}$ of the drive transistor $TR_D$ from the reference voltage $V_{Ofs}$.

Specifically, from the beginning period to the end period of the [period-$TP_2$], the reference voltage $V_{Ofs}$ is applied to the gate electrode of the drive transistor $TR_D$ from the data line $DTL_n$ via the write transistor $TR_W$ set in the conductive state on the basis of the scanning signal from the scanning line SCL. In addition, in the middle of the [period-$TP_2$], the voltage of the feeder line $PS1_m$ is switched from the reference voltage $V_{Ofs}$ to the first drive voltage $V_{CC-M}$.

Since the gate-source voltage of the drive transistor $TR_D$ exceeds the threshold voltage $V_{th}$, the current flows through the drive transistor $TR_D$ and the potential of the other source/drain region increases. As a result, the potential of the second node $ND_2$ is brought to be closer to the potential obtained by subtracting the threshold voltage $V_{th}$ of the drive transistor $TR_D$ from the reference voltage $V_{Ofs}$. If the potential of the second node $ND_2$ reaches ($V_{Ofs}-V_{th}$), the drive transistor $TR_D$ is in a non-conductive state.

Then, in the [period-$TP_2$], the gate electrode of the drive transistor $TR_D$ is set in the floating state, and the potential of the gate electrode in the floating state is changed via the parasitic capacitance and the current is caused to flow via the drive transistor $TR_D$, to increase the voltage between the other source/drain region and the gate electrode, and then the reference voltage $V_{Ofs}$ is applied to the gate electrode of the drive transistor $TR_D$.

Specifically, in a [period-$TP_3$], the gate electrode of the drive transistor $TR_D$ is set in the floating state and the voltage of the one source/drain region of the drive transistor $TR_D$ is switched to the second drive voltage $V_{CC-H}$ exceeding the first drive voltage to increase the voltage between the other source/drain region and the gate electrode, and then the reference voltage $V_{Ofs}$ is applied to the gate electrode of the drive transistor $TR_D$.

In the beginning period of the [period-$TP_3$], the write transistor $TR_W$ is in the non-conductive state. In the middle of the [period-$TP_3$], the voltage of the feeder line $PS1_m$ is switched from the first drive voltage $V_{CC-M}$ to the second drive voltage $V_{CC-H}$. As will be described in detail later with reference to FIG. 14B, since there is the parasitic capacitance between the gate electrode and the one source/drain region of the drive transistor $TR_D$, the potential of the gate electrode also increases with the voltage increase in the feeder line $PS1_m$. As a result, the drive transistor $TR_D$ is in the conductive state, and the potential of the other source/drain region increases. Then, the voltage of the gate electrode of the drive transistor $TR_D$, in other words, the voltage of the first node $ND_1$ also increases due to bootstrap operation.

After that, the reference voltage $V_{Ofs}$ is applied to the gate electrode of the drive transistor $TR_D$ from the data line $DTL_n$ via the write transistor $TR_W$ set in the conductive state on the basis of the scanning signal from the scanning line SCL. The potential of the gate electrode of the drive transistor $TR_D$ decreases to $V_{Ofs}$ to be initialized, and the potential of the second node $ND_2$ also decreases.

During a [period-$TP_4$], the video signal voltage $V_{Sig_m}$ is supplied to the data line $DTL_n$. During this period, write processing is performed that applies the video signal voltage to the gate electrode of the drive transistor $TR_D$. Specifically, the write transistor $TR_W$ is set in the conductive state on the basis of the scanning signal of the scanning line $SCL_m$, and the video signal voltage $V_{Sig_m}$ is applied to the gate electrode of the write transistor $TR_W$ from the data line $DTL_n$.

In this write processing, the current flows through the drive transistor $TR_D$, whereby the potential of the other source/drain region of the drive transistor $TR_D$ changes. That is, since the video signal voltage $V_{Sig}$ is applied to the gate electrode of the drive transistor $TR_D$ in a state where the second drive voltage $V_{CC-H}$ is applied to the one source/drain region of the drive transistor $TR_D$, the current flows via the drive transistor $TR_D$, and the potential of the second node $ND_2$ changes. Specifically, the potential of the second node $ND_2$ increases.

Subsequently, the gate electrode of the drive transistor $TR_D$ is set in the floating state, whereby the light-emitting unit ELP emits light. Specifically, if the scanning signal of the scanning line $SCL_m$ ends, the write transistor $TR_W$ is set in the non-conductive state, and the gate electrode of the drive transistor $TR_D$ is disconnected from the data line $DTL_n$. The second drive voltage $V_{CC-H}$ is applied to the one source/drain region of the drive transistor $TR_D$, and the first node $ND_1$ is electrically disconnected from the data line $DTL_n$. Then, a current according to a value of the voltage held by the capacitor $C_S$ due to the write processing flows through the light-emitting unit ELP via the drive transistor $TR_D$. As a result of the above, the potential of the second node $ND_2$ increases.

Here, as described above, the gate electrode of the drive transistor $TR_D$ is in the floating state and moreover the capacitor $C_S$ exists, so that a phenomenon similar to that in a so-called bootstrap circuit occurs in the gate electrode of the drive transistor $TR_D$, and the potential of the first node $ND_1$ also increases.

The outline of the basic operation of the display device 1 has been described above.

As will be described in detail later, a voltage change of the other source/drain region of the drive transistor $TR_D$ due to the operation in the [period-$TP_3$] illustrated in FIG. 3, reduces a phenomenon that the voltage of the capacitor $C_S$ decreases due to the bootstrap operation as the threshold voltage $V_{th}$ increases in the [period-$TP_4$] to a [period-$TP_5$].

Here, to facilitate understanding of operation characterizing the first embodiment, operation and problems will be described in detail in a reference example in which the characteristic operation is omitted.

Figure 4:
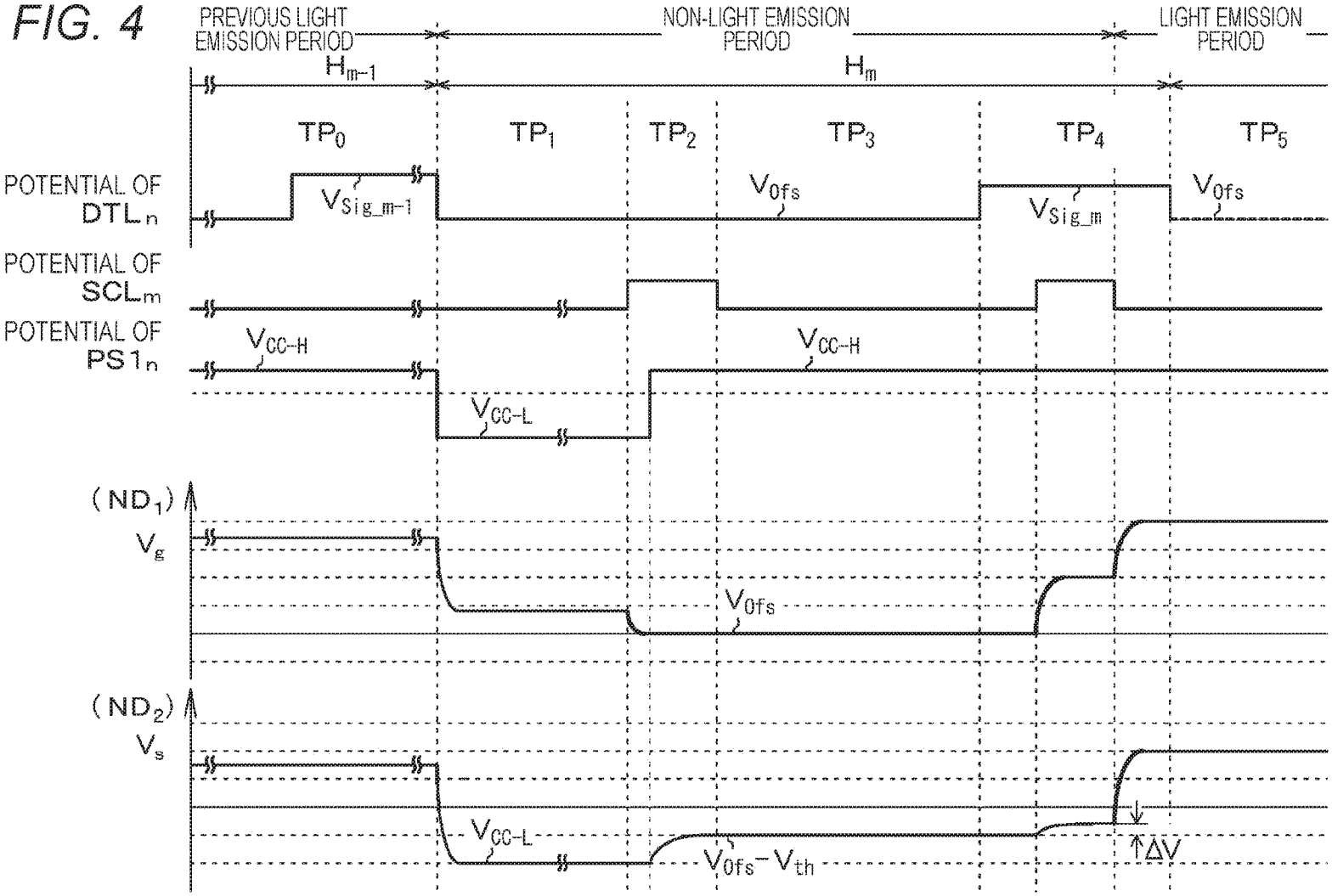
FIG. 4 is a schematic timing chart for explaining operation of a display device of a reference example in which a first drive voltage VCC-M applied to a feeder line in a [period-TP2] and a [period-TP3] of FIG. 3 is set to a drive voltage VCC-H, and a pulse applied to a scanning line in the [period-TP3] is omitted.

FIG. 4 is a schematic timing chart for explaining operation of a display device of the reference example in which the first drive voltage $V_{CC-M}$ applied to the feeder line in the [period-$TP_2$] and the [period-$TP_3$] of FIG. 3 is set to the second drive voltage $V_{CC-H}$, and a pulse applied to the scanning line in the [period-$TP_3$] is omitted.

Figure 5A:
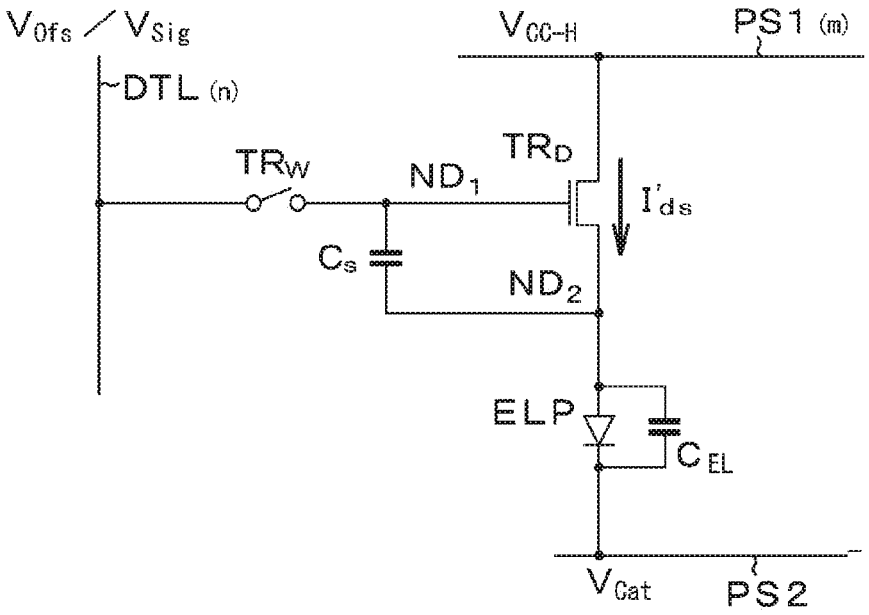
FIGS. 5A and 5B are diagrams each schematically illustrating a conductive state/non-conductive state and the like of each transistor configuring a drive circuit of a display element according to the display device of the reference example.

[Period-$TP_0$] (See FIGS. 4 and 5A)

This [period-$TP_0$] is, for example, of operation in a previous display frame, and is a period in which the (n, m)-th display element 3 is in the light emitting state after completion of the previous various types of processing. That is, the second drive voltage $V_{CC-H}$ is supplied to the feeder line $PS1_m$, and a drain current $I_{ds}'$ based on an expression (5) as described later flows through the light-emitting unit ELP in the display element 3 configuring the (n, m)-th pixel, and a luminance of the display element 3 configuring the (n, m)-th pixel is a value corresponding to the drain current $I_{ds}'$. Here, the write transistor $TR_W$ is in the non-conductive state, and the drive transistor $TR_D$ is in the conductive state.

As described above, corresponding to each horizontal scanning period, the reference voltage $V_{Ofs}$ and the video signal voltage $V_{Sig}$ are supplied to the data line $DTL_n$. However, since the write transistor $TR_W$ is in the non-conductive state, even if a potential (voltage) of the data line $DTL_n$ changes in the [period-$TP_0$], the potentials of the first node $ND_1$ and the second node $ND_2$ do not change (actually, a potential change may occur due to electrostatic coupling of the parasitic capacitance or the like, but these can usually be ignored).

Figure 5B:
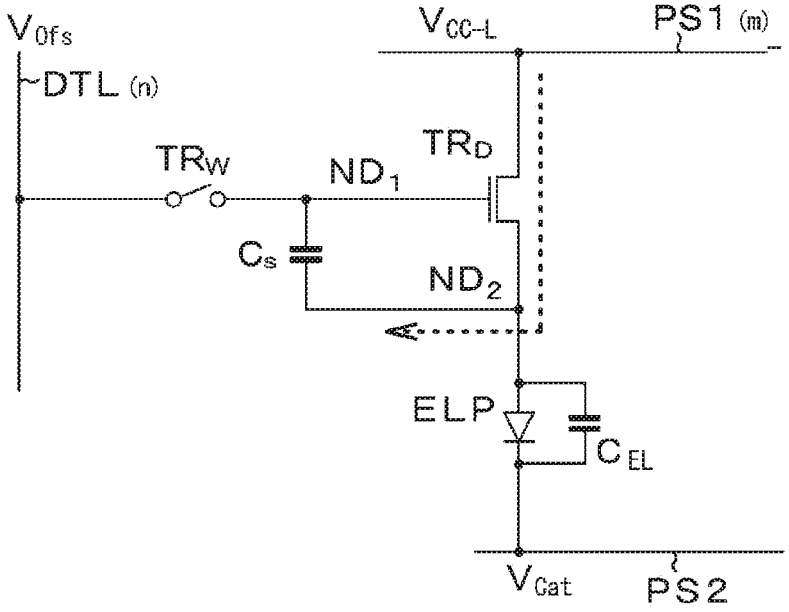

[Period-$TP_1$] (See FIGS. 4 and 5B)

This [period-$TP_1$] is, for example, of operation in a current display frame. In the beginning period of the [period- $TP_0$], the voltage supplied to the feeder line $PS1_m$ is switched from the second drive voltage $V_{CC-H}$ to the initialization voltage $V_{CC-L}$. As a result, the potential of the second node $ND_2$ decreases to $V_{CC-L}$, and a reverse voltage is applied between the anode electrode and the cathode electrode of the light-emitting unit ELP, and the light-emitting unit ELP is in a non-light emitting state. In addition, the potential of the first node $ND_1$ (the gate electrode of the drive transistor $TR_D$) in the floating state also decreases to follow the potential decrease in the second node $ND_2$.

Figure 6A:
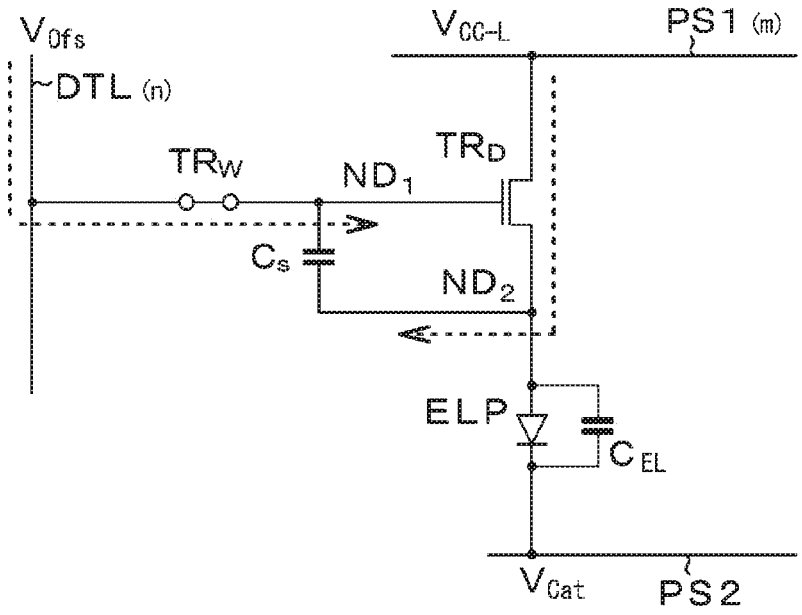
FIGS. 6A and 6B are diagrams each schematically illustrating the conductive state/non-conductive state and the like of each transistor configuring the drive circuit of the display element according to the display device of the reference example, continuing from FIG. 5B.
Figure 6B:
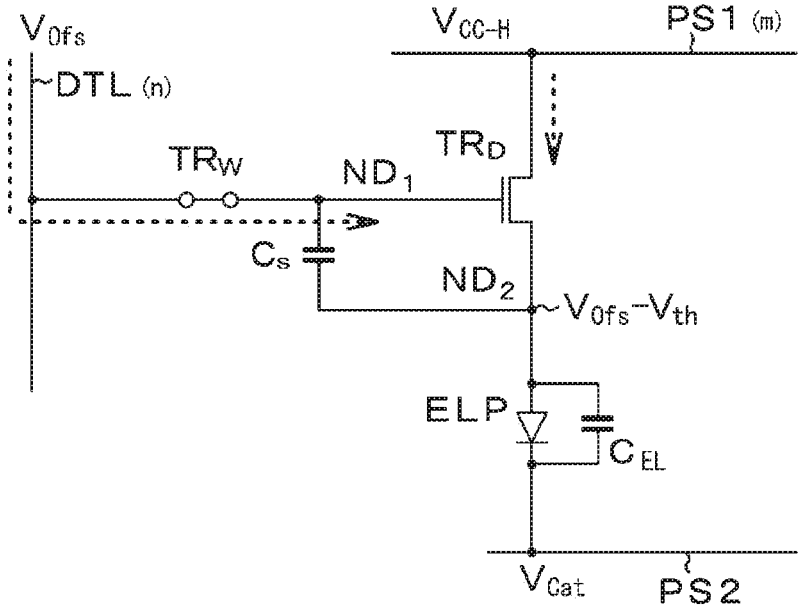

[Period-$TP_2$] (See FIGS. 4, 6A, and 6B)

In this [period-$TP_2$], the scanning line $SCL_m$ is set to a high level to set the write transistor $TR_W$ in the conductive state. Since the reference voltage $V_{Ofs}$ is supplied to the data line $DTL_n$, the potential of the first node $ND_1$ is $V_{Ofs}$ (0 volts) (see FIG. 6A). Then, the voltage supplied to the feeder line $PS1_m$ is switched from the initialization voltage $V_{CC-L}$ to the second drive voltage $V_{CC-H}$. As a result, the potential of the second node $ND_2$ increases to the potential obtained by subtracting the threshold voltage $V_{th}$ of the drive transistor $TR_D$ from the reference voltage $V_{Ofs}$.

If this [period-$TP_2$] is sufficiently long, a potential difference between the gate electrode of the drive transistor $TR_D$ and the other source/drain region reaches $V_{th}$, and the drive transistor $TR_D$ is in the non-conductive state. That is, the potential of the second node $ND_2$ is brought to be closer to $(V_{Ofs}-V_{th})$ and finally is $(V_{Ofs}-V_{th})$ (see FIG. 6B).

Figure 7A:
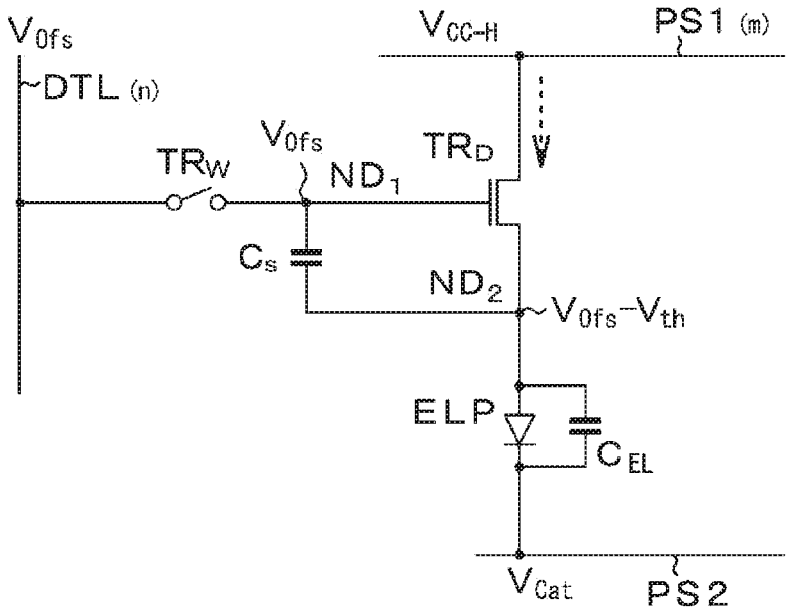
FIGS. 7A and 7B are diagrams each schematically illustrating the conductive state/non-conductive state and the like of each transistor configuring the drive circuit of the display element according to the display device of the reference example, continuing from FIG. 6B.

[Period-$TP_3$] (See FIGS. 4 and 7A)

In this [period-$TP_3$], the scanning line $SCL_m$ is set to a low level, and the write transistor $TR_W$ is set in the non-conductive state. As a result, the first node $ND_1$ is in the floating state. If the drive transistor $TR_D$ has reached the non-conductive state in the [period-$TP_2$], the potentials of the first node $ND_1$ and the second node $ND_2$ do not substantially change (actually, a potential change may occur due to electrostatic coupling of the parasitic capacitance or the like, but these can usually be ignored). Note that, in a case where the drive transistor $TR_D$ has not reached the non-conductive state in the threshold voltage cancellation processing, the bootstrap operation occurs, and the potentials of the first node $ND_1$ and the second node $ND_2$ increase somewhat.

Figure 7B:
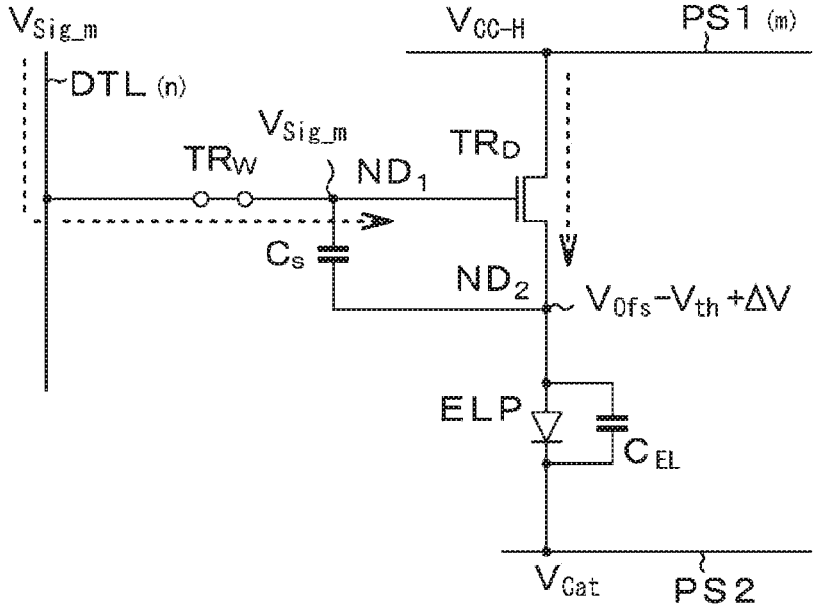
Figure 8A:
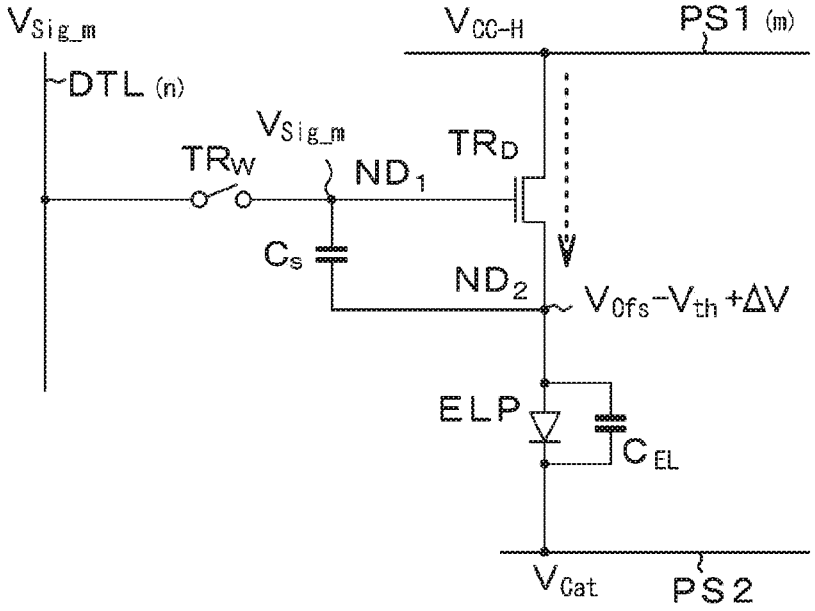
FIGS. 8A and 8B are diagrams each schematically illustrating the conductive state/non-conductive state and the like of each transistor configuring the drive circuit of the display element according to the display device of the reference example, continuing from FIG. 7B.

[Period-$TP_4$] (See FIGS. 4, 7B, and 8A)

In this [period-$TP_4$], the video signal voltage $V_{Sig_m}$ is supplied to the data line $DTL_n$. Then, on the basis of the scanning signal of the scanning line $SCL_m$, the write transistor $TR_W$ is set in the conductive state, and the video signal voltage $V_{Sig_m}$ is applied to the gate electrode of the drive transistor $TR_D$ via the write transistor $TR_W$.

In the write processing described above, the second drive voltage $V_{CC-H}$ is applied to the one source/drain region of the drive transistor $TR_D$. For this reason, as illustrated in FIG. 4, the potential of the second node $ND_2$ increases. An amount of increase in the potential is represented by a reference sign $\Delta V$ (see FIG. 7B). After ending the write processing, on the basis of the scanning signal of the scanning line $SCL_m$, the write transistor $TR_W$ is set in the non-conductive state (see FIG. 8A).

When a potential of the gate electrode (the first node $ND_1$) of the drive transistor $TR_D$ is represented as $V_g$, and a potential of the source region (the second node $ND_2$) of the drive transistor $TR_D$ is represented as $V_s$, if the amount of increase $\Delta V$ in the potential of the second node $ND_2$ is not considered, a value of $V_g$ and a value of $V_s$ are as follows. The potential difference between the first node $ND_1$ and the second node $ND_2$, that is, the potential difference $V_{gs}$ between the other source/drain region serving as the source region and the gate electrode of the drive transistor $TR_D$ can be expressed by an expression (2) below.

$$V_g = V_{Sig_m}$$

$$V_s \approx V_{Ofs} - V_{th}$$

$$V_{gs} \approx V_{Sig_m}(V_{Ofs} - V_{th}) \quad (2)$$

The potential difference $V_{gs}$ obtained in the write processing to the drive transistor $TR_D$ depends only on the video signal voltage $V_{Sig_m}$ for controlling the luminance in the light-emitting unit ELP, the threshold voltage $V_{th}$ of the drive transistor $TR_D$, and the reference voltage $V_{Ofs}$.

Subsequently, the amount of increase ($\Delta V$) in the potential of the second node $ND_2$ will be described. In the method for driving described above, the write processing is performed in a state where the drive voltage $V_{CC-H}$ is applied to the one source/drain region of the drive transistor $TR_D$ of the display element 3. As a result, mobility correction processing is also performed that changes the potential of the other source/drain region of the drive transistor $TR_D$ of the display element 3.

In a case where the drive transistor $TR_D$ is manufactured from a thin film transistor or the like, it is difficult to avoid that variation occurs in the mobility $\mu$ between the transistors. Even if the video signal voltages $V_{Sig}$ having the same value are applied to the gate electrodes of multiple drive transistors $TR_D$ having differences in the mobility $\mu$, a difference occurs between the drain current $I_{ds}$ flowing through the drive transistor $TR_D$ whose mobility $\mu$ is large and the drain current $I_{ds}$ flowing through the drive transistor $TR_D$ whose mobility $\mu$ is small, and homogeneity (uniformity) is degraded of a screen of the display device 1.

In the method for driving described above, in a case where the value is large of the mobility $\mu$ of the drive transistor $TR_D$, the amount of increase $\Delta V$ is large of the potential of the other source/drain region of the drive transistor $TR_D$ (that is, the potential of the second node $ND_2$). Conversely, in a case where the value is small of the mobility $\mu$ of the drive transistor $TR_D$, the amount of increase $\Delta V$ is small of the potential of the other source/drain region of the drive transistor $TR_D$. Here, the potential difference $V_{gs}$ between the other source/drain region serving as the source region and the gate electrode of the drive transistor $TR_D$ is modified from the expression (2) to an expression (3) below.

$$V_{gs} \approx V_{Sig_m}(V_{Ofs} - V_{th}) - \Delta V \quad (3)$$

Note that, length of a period of the scanning signal for writing the video signal voltage $V_{Sig}$ only needs to be determined in accordance with a design of the display element 3 and the display device 1. In addition, the length of the period of the scanning signal is determined such that the potential $(V_{Ofs}-V_{th}+\Delta V)$ in the other source/drain region of the drive transistor $TR_D$ at this time satisfies an expression (4) below. If this condition is satisfied, the light-emitting unit ELP does not emit light in the write processing. Note that, with this mobility correction processing, correction of variation of the coefficient $k(\equiv(1/2)\cdot(W/L)\cdot C_{ox})$ in the expression (1) is also performed at the same time.

$$(V_{Ofs} - V_{th} + \Delta V) < (V_{th-EL} + V_{Cat}) \quad (4)$$

Figure 8B:
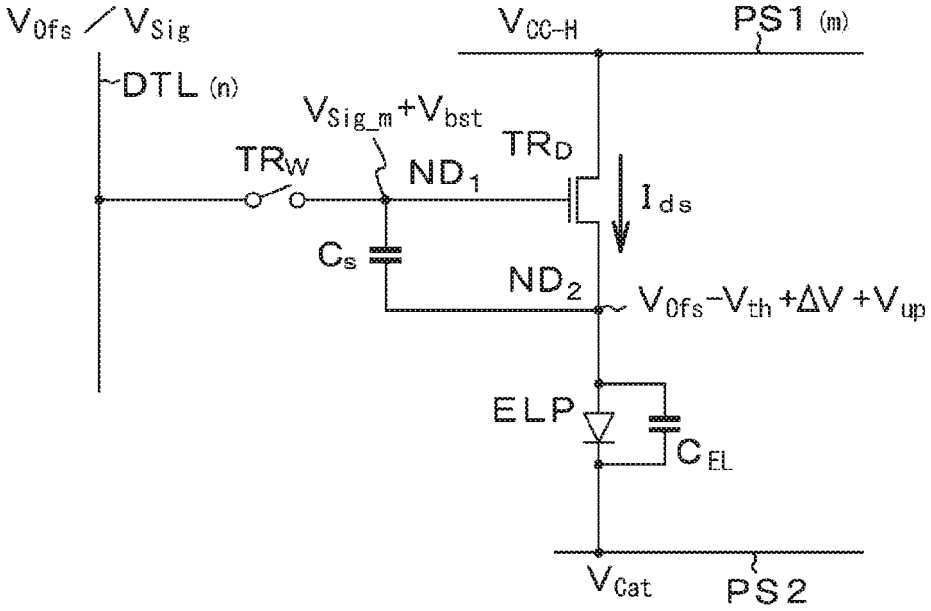

[Period-$TP_5$] (See FIGS. 4 and 8B)

The second drive voltage $V_{CC-H}$ is applied to the one source/drain regions of the drive transistor $TR_D$, and the write transistor $TR_W$ maintains the non-conductive state from the end of the write processing. As a result of the above, the potential of the second node $ND_2$ increases. The amount of increase in the potential at this time is represented by a reference sign $V_{up}$.

The gate electrode of the drive transistor $TR_D$ is in the floating state and moreover the capacitor $C_S$ exists, so that the phenomenon similar to that in the so-called bootstrap circuit occurs in the gate electrode of the drive transistor $TR_D$, and the potential of the first node $ND_1$ also increases. The amount of increase in the potential at this time is represented by a reference sign $V_{bst}$. If the bootstrap operation is ideal, since $V_{up}=V_{bst}$, a value of the gate-source voltage $V_{gs}$ holds a value of the expression (3).

Since the potential of the second node $ND_2$ increases and exceeds ($V_{th\text{-}EL}+V_{Cat}$), the light-emitting unit ELP starts light emission. At this time, since a current flowing through the light-emitting unit ELP is the drain current $I_{ds}$ flowing from the drain region to the source region of the drive transistor $TR_D$, the current can be expressed by the expression (1). Here, from the expressions (1) and (3), the expression (1) can be modified into the expression (5) below.

$$I_{ds}=k\cdot p\cdot(V_{Sig_m}-V_{Ofs}-\Delta V)^2 \tag{5}$$

Therefore, in a case where the reference voltage $V_{Ofs}$ is set to 0 volts, the current $I_{ds}$ flowing through the light-emitting unit ELP is proportional to the square of a value obtained by subtracting a value of the potential correction value $\Delta V$ due to the mobility $\mu$ of the drive transistor $TR_D$ from a value of the video signal voltage $V_{Sig_m}$ for controlling the luminance in the light-emitting unit ELP. Therefore, since the current $I_{ds}$ flowing through the light-emitting unit ELP does not depend on the threshold voltage $V_{th}$ of the drive transistor $TR_D$, an amount of light emission (luminance) of the light-emitting unit ELP is not influenced by the threshold voltage $V_{th}$ of the drive transistor $TR_D$. Furthermore, the luminance of the (n, m)-th display element 3 is a value corresponding to the current $I_{ds}$.

Moreover, since the potential correction value $\Delta V$ is larger for the drive transistor $TR_D$ whose mobility $\mu$ is larger, the value of $V_{gs}$ on the left side of the expression (3) is smaller. Therefore, in the expression (4), the value of $(V_{Sig_m}-V_{Ofs}-\Delta V)^2$ is small even if the value of mobility $\mu$ is large, so that it is possible to correct variation in the drain current $I_{ds}$ caused by variation in the mobility $\mu$ of the drive transistor $TR_D$ (further, variation in k). As a result, it is possible to correct variation in the luminance of the light-emitting unit ELP caused by the variation in the mobility $\mu$ (further, the variation in k).

The operation of the reference example has been described in detail above. Subsequently, the problems of the reference example will be described in detail.

As described above, if the bootstrap operation in the [period-$TP_4$] to the [period-$TP_5$] in FIG. 4 is ideal, the value of the gate-source voltage $V_{gs}$ holds the value of the expression (3). Therefore, the current flowing during light emission is not influenced by the threshold voltage $V_{th}$.

However, in the bootstrap operation, behavior is exhibited, such as Vup>Vbst, actually. As a result, the value of the gate-source voltage Vgs after the bootstrap operation is influenced by the threshold voltage Vth. Detailed description will be made with reference to FIGS. 9, 12A, and 12B below.

Note that, for convenience of description, the potential change $\Delta V$ of the second node $ND_2$ in the write processing is not considered.

Figure 9:
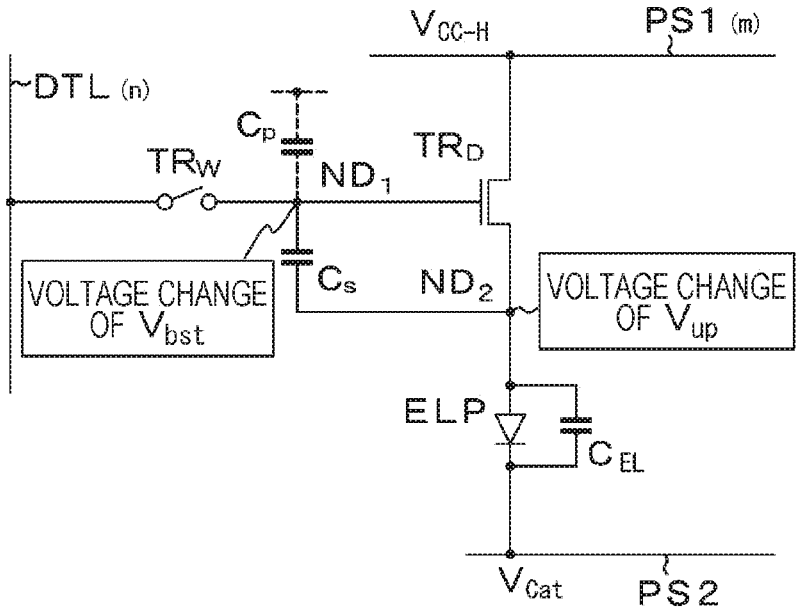
FIG. 9 is a diagram for explaining a bootstrap gain Gbst indicating a ratio of a gate voltage change to a source voltage change of a drive transistor in bootstrap operation in a [period-TP4] to a [period-TP5] illustrated in FIG. 4.

FIG. 9 is a diagram for explaining a bootstrap gain $G_{bst}$ indicating a ratio of a gate voltage change to a source voltage change of the drive transistor in the bootstrap operation in the [period-$TP_4$] to the [period-$TP_5$] illustrated in FIG. 4.

There is parasitic capacitance occurring between the gate electrode of the transistor and various wiring lines and the like. In FIG. 9, the parasitic capacitance is represented by a reference sign $C_p$.

In this case, the voltage change $V_{bst}$ of the first node ND' when the voltage change of $V_{up}$ occurs in the second node $ND_2$ is given by an expression (6) below.

$$\begin{aligned} V_{bst} &= \{Cs/(Cs+Cp)\}\cdot V_{up} \\ &= G_{bst}\cdot V_{up} \end{aligned} \tag{6}$$

However, $G_{bst}\equiv C_S/(C_S+C_p)$, and is hereinafter referred to as a bootstrap gain.

If a value of the parasitic capacitance $C_p$ is sufficiently small with respect to the capacitor $C_S$, the bootstrap gain $G_{bst}$ can be treated substantially as "1". However, as the display element is miniaturized, the area of the electrode configuring the capacitor $C_S$ has to be reduced, and as a result, influence of the parasitic capacitance $C_p$ increases.

Here, the voltage change will be described in a case where the bootstrap gain $G_{bst}$ is "1", and in a case where $G_{bst}$ is "0.6", for example, as an example of a case where the bootstrap gain $G_{bst}$ is smaller than 1.

Figure 10:
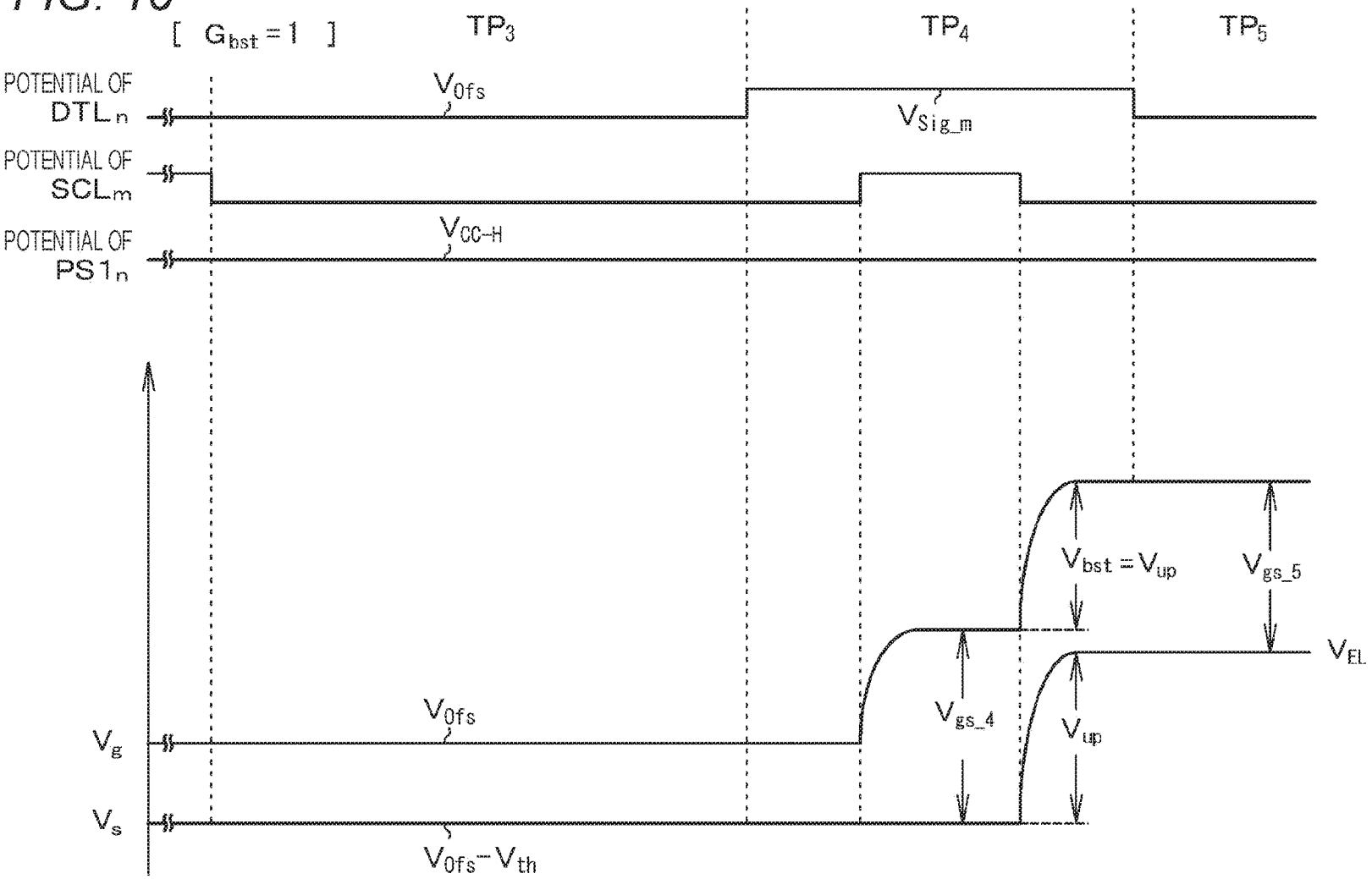
FIG. 10 is a schematic timing chart for explaining the operation when the bootstrap gain Gbst is "1".

FIG. 10 is a schematic timing chart for explaining the operation when the bootstrap gain $G_{bst}$ is "1".

In FIG. 10, if the gate-source voltage at the time of the write processing in the [period-$TP_4$] is represented as $V_{gs_4}$, the voltage is expressed as $V_{gs_4}=V_{Sig_m}-(V_{Ofs}-V_{th})$.

In addition, if the voltage of the anode electrode of the light-emitting unit ELP during light emission is represented by a reference sign $V_{EL}$, the amount of voltage increase $V_{up}$ of the source region of the drive transistor $TR_D$ is expressed as $V_{up}=V_{EL}\ (V_{Ofs}-V_{th})$.

Then, the amount of voltage increase $V_{bst}$ of the gate electrode due to the bootstrap operation is $V_{bst}=G_{bst}\cdot V_{up}=V_{up}$.

Therefore, if the gate-source voltage after the bootstrap operation in the [period-$TP_4$] to the [period-$TP_5$] is represented as $V_{gs_5}$, the voltage is $$\begin{aligned} V_{gs_5} &= V_{Sig_4} \\ &= V_{Sig_m}-(V_{Ofs}-V_{th}). \end{aligned}$$

As described above, in the case where the bootstrap gain $G_{bst}$ is "1", the gate-source voltage does not change before and after the bootstrap operation.

Subsequently, a case of FIG. 11 will be described. Also in the case of FIG. 11, the gate-source voltage $V_{gs_4}$ during the write processing in the [period-$TP_4$] is $V_{gs_4}=V_{Sig_m}-(V_{Ofs}-V_{th})$, similar to the case of FIG. 10, and the amount of voltage increase $V_{up}$ of the source region of the drive transistor $TR_D$ is also $V_{up}=V_{EL}-(V_{Ofs}-V_{th})$.

Figure 11:
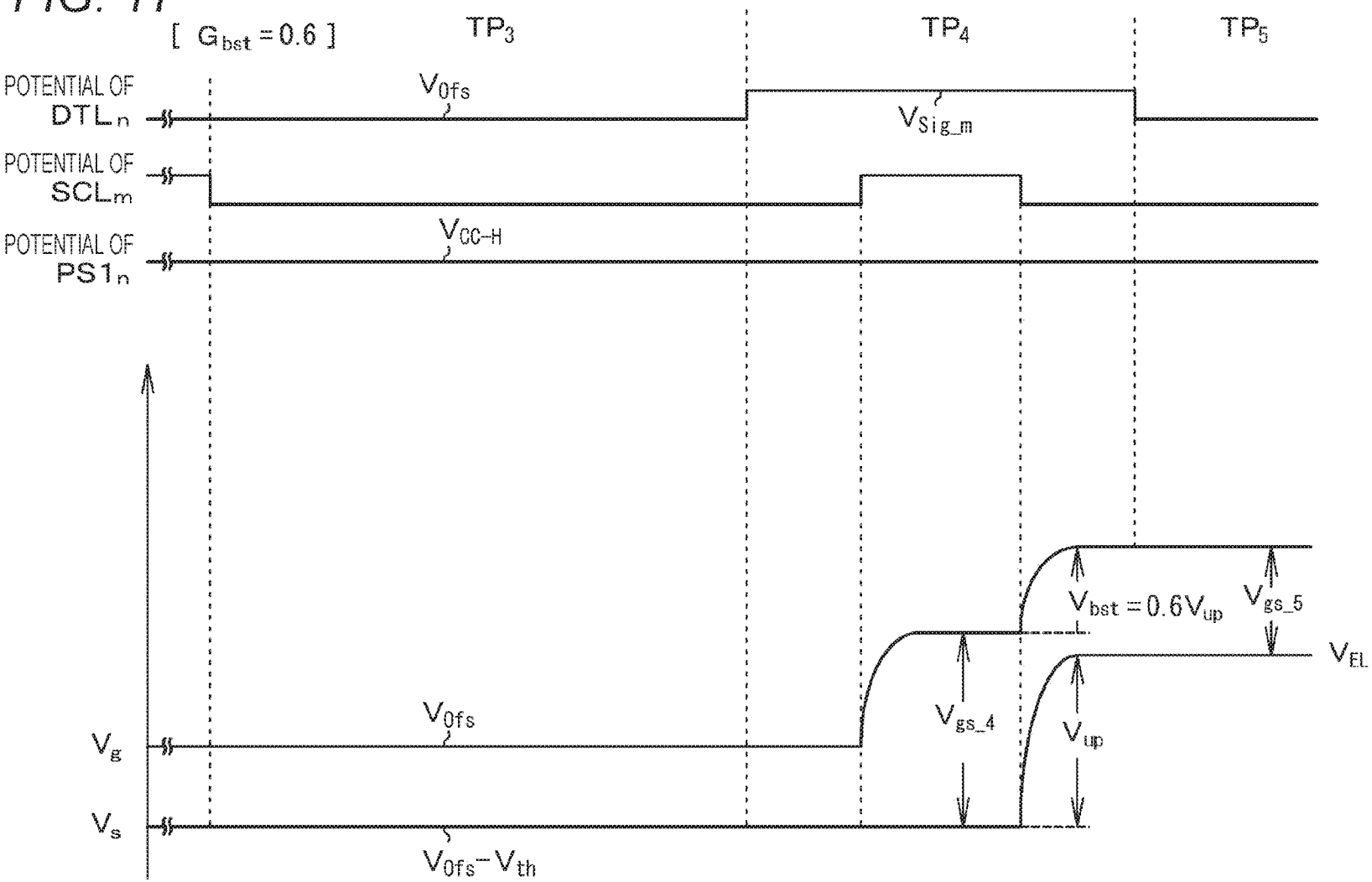
FIG. 11 is a schematic timing chart for explaining the operation when the bootstrap gain Gbst is "0.6".

However, in the case of FIG. 11, the amount of voltage increase $V_{bst}$ of the gate electrode due to the bootstrap operation is $V_{bst}=G_{bst}\cdot V_{up}=0.6\times V_{up}$.

Therefore, the gate-source voltage $V_{gs_5}$ after the bootstrap operation is $$\begin{aligned} V_{gs_5} &= V_{Sig_4} - (V_{up} - 0.6 \times V_{up}) \\ &= V_{Sig_4} - V_{up} \cdot (1 - 0.6) \\ &= V_{Sig_m}(V_{Ofs} - V_{th}) - (V_{EL} - (V_{Ofs} - V_{th})) \cdot (1 - 0.6). \end{aligned}$$

Therefore, in the case where the bootstrap gain $G_{bst}$ is smaller than 1, an amount of decrease in the gate-source voltage in the bootstrap operation is expressed as $(V_{EL}-(V_{Ofs}-V_{th}))\cdot(1-G_{bst})$ (7). Since an example is described in which $G_{bst}$ is "0.6", more specifically, the amount of decrease is expressed as $(V_{EL}-(V_{Ofs}-V_{th}))-(1-0.6)$.

This expression (7) includes the threshold voltage $V_{th}$. Therefore, if the threshold voltage $V_{th}$ varies, the amount of decrease in the gate-source voltage due to the bootstrap operation also varies.

For this reason, even if the voltage is held in the capacitor $C_s$ to cancel influence of the threshold voltage $V_{th}$ in the write processing in the [period-$TP_4$], the luminance varies due to variation in the amount of decrease in the gate-source voltage due to the bootstrap operation.

Figure 12A:
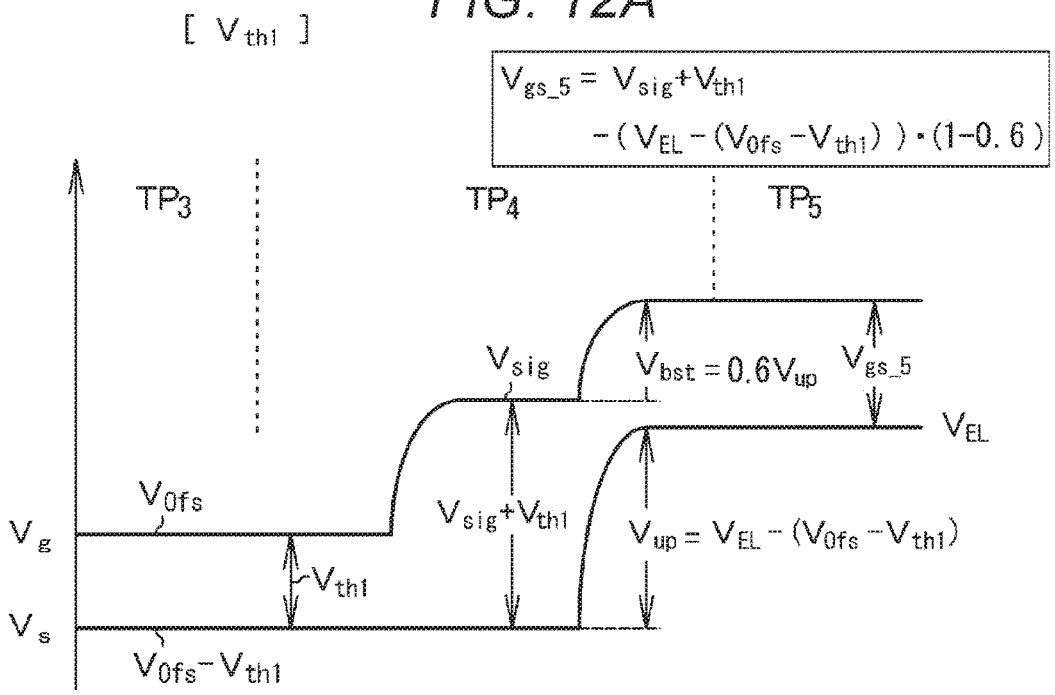
FIGS. 12A and 12B are diagrams each explaining a value of a gate-source voltage Vgs of the drive transistor in the [period-TP4] and the [period-TP5] illustrated in FIG. 4.
Figure 12B:
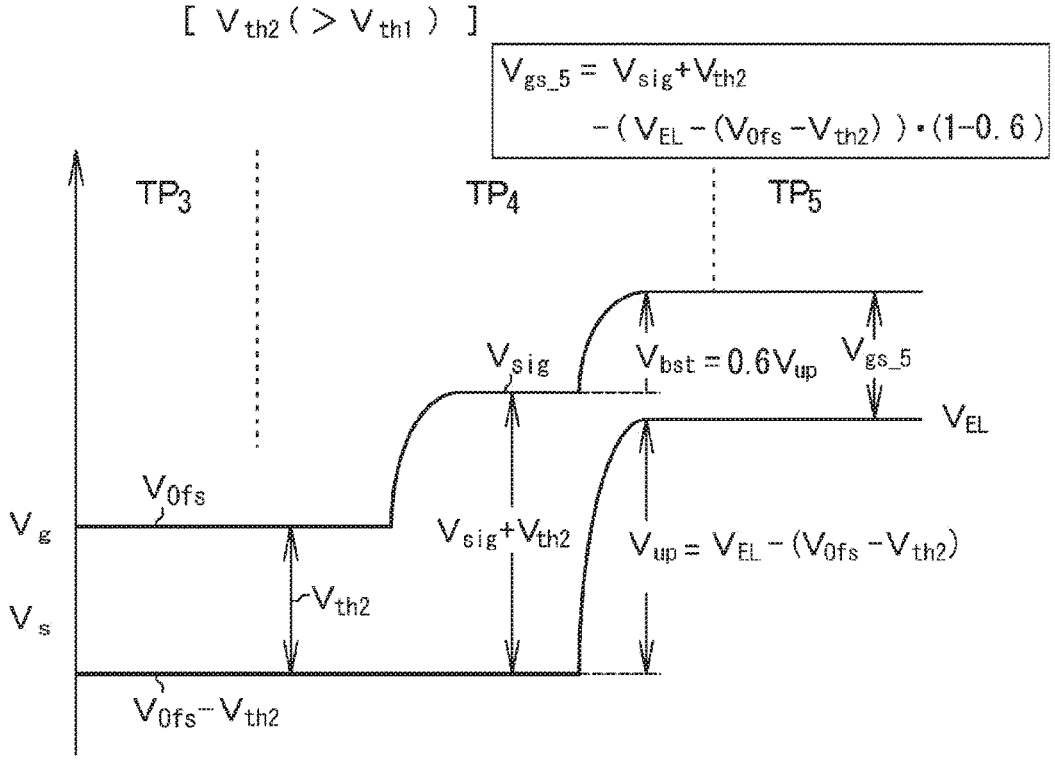

FIGS. 12A and 12B are diagrams each explaining the value of the gate-source voltage $V_{gs}$ of the drive transistor in the [period-$TP_4$] and the [period-$TP_5$], and FIG. 12A illustrates a case where the threshold voltage of the transistor is $V_{th1}$, and FIG. 12B illustrates a case where the threshold voltage of the drive transistor is $V_{th2}$ ($>V_{th1}$).

As apparent from the figure, the amount of voltage increase $V_{up}$ of the source region of the drive transistor $TR_D$ increases as the threshold voltage $V_{th}$ increases. As a result, the amount of decrease in the gate-source voltage in the bootstrap operation also increases as the threshold voltage $V_{th}$ increases. In a case where the threshold voltages are $V_{th1}$ and $V_{th2}$, a difference of $(1-0.6)\cdot(V_{th2}-V_{th1})$ occurs in the amount of decrease in the gate-source voltage in the bootstrap operation. Qualitatively, a phenomenon occurs that the luminance of the display element is darker as the threshold voltage $V_{th}$ increases.

The problems of the reference example have been described in detail above. Subsequently, the operation characterizing the first embodiment will be described in detail with reference to FIG. 3, and FIGS. 13A, 13B, 14A, 14B, 15A, 15B, 16, and 17.

As illustrated in FIG. 3, in the first embodiment, the first drive voltage $V_{CC\text{-}M}$ is applied to the feeder line $PS1_m$ in the [period-$TP_2$] and the [period-$TP_3$].

At this time, although a value of the drive voltage supplied to the feeder line $PS1_m$ is different from the value of the reference example, as will be described below, similarly to the reference example, threshold voltage cancellation processing is performed to bring the potential of the other source/drain region closer to the potential obtained by subtracting the threshold voltage $V_{th}$ of the drive transistor $TR_D$ from the reference voltage $V_{Ofs}$.

Figure 13A:
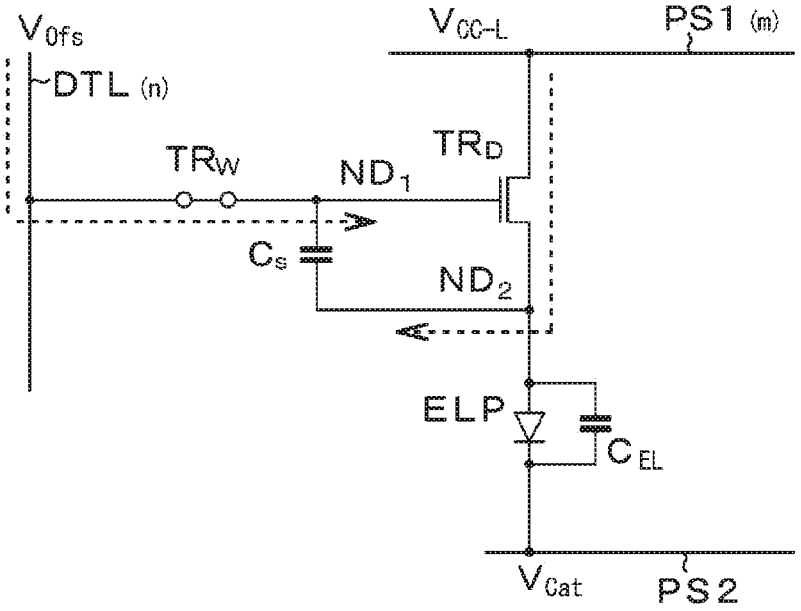
FIGS. 13A and 13B are diagrams each schematically illustrating a conductive state/non-conductive state and the like of each transistor configuring a drive circuit of a display element according to the display device of the first embodiment.
Figure 13B:
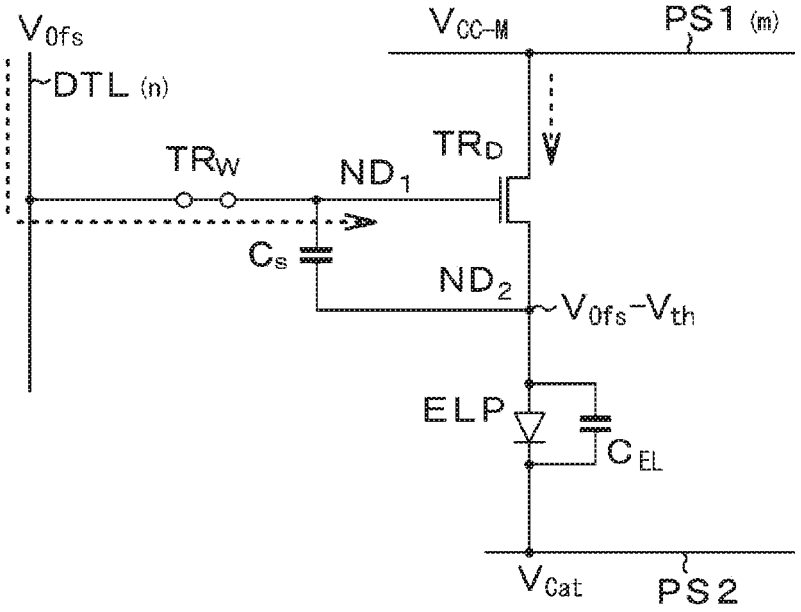

[Period-$TP_2$] (See FIGS. 3, 13A, and 13B)

In the [period-$TP_2$], the scanning line $SCL_m$ is set to the high level to set the write transistor $TR_W$ in the conductive state. Since the reference voltage $V_{Ofs}$ is supplied to the data line $DTL_n$, the potential of the first node $ND_1$ is $V_{Ofs}$ (0 volts) (see FIG. 13A). Then, the voltage supplied to the feeder line $PS1_m$ is switched from the initialization voltage $V_{CC\text{-}L}$ to the first drive voltage $V_{CC\text{-}M}$. As a result, the potential of the second node $ND_2$ increases to the potential obtained by subtracting the threshold voltage $V_{th}$ of the drive transistor $TR_D$ from the reference voltage $V_{Ofs}$.

If this [period-$TP_2$] is sufficiently long, a potential difference between the gate electrode of the drive transistor $TR_D$ and the other source/drain region reaches $V_{th}$, and the drive transistor $TR_D$ is in the non-conductive state. That is, the potential of the second node $ND_2$ is brought to be closer to $(V_{Ofs}-V_{th})$ and finally is $(V_{Ofs}-V_{th})$ (see FIG. 13B).

[Period-$TP_3$] (See FIGS. 3, 14A, 14B, 15A, and 15B)

In this [period-$TP_3$], the scanning line $SCL_m$ is set to the low level, and the write transistor $TR_W$ is set in the non-conductive state. As a result, the first node $ND_1$ is in the floating state. If the drive transistor $TR_D$ has reached the non-conductive state in the [period-$TP_2$], the potentials of the first node $ND_1$ and the second node $ND_2$ do not substantially change (see FIG. 14A). The operation up to this point is similar to the operation of the reference example.

Figure 14A:
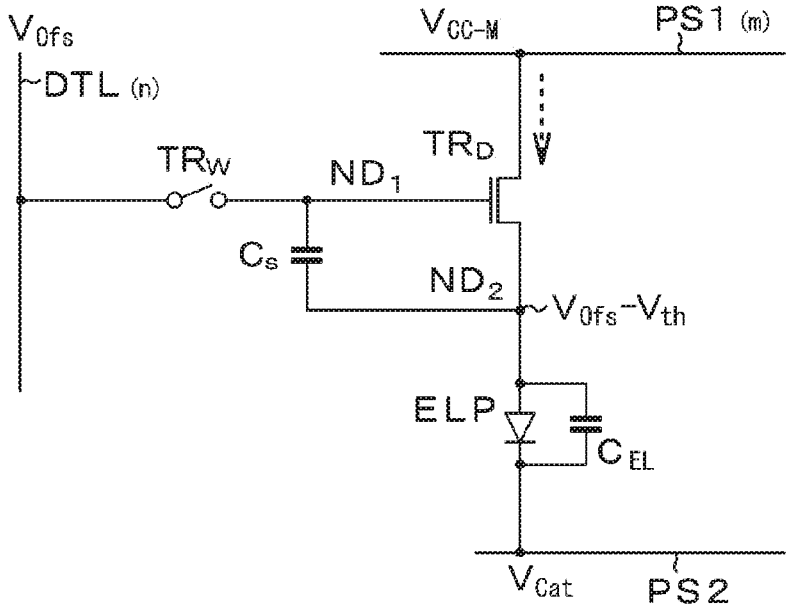
FIGS. 14A and 14B are diagrams each schematically illustrating the conductive state/non-conductive state and the like of each transistor configuring the drive circuit of the display element according to the display device of the first embodiment, continuing from FIG. 13B.
Figure 14B:
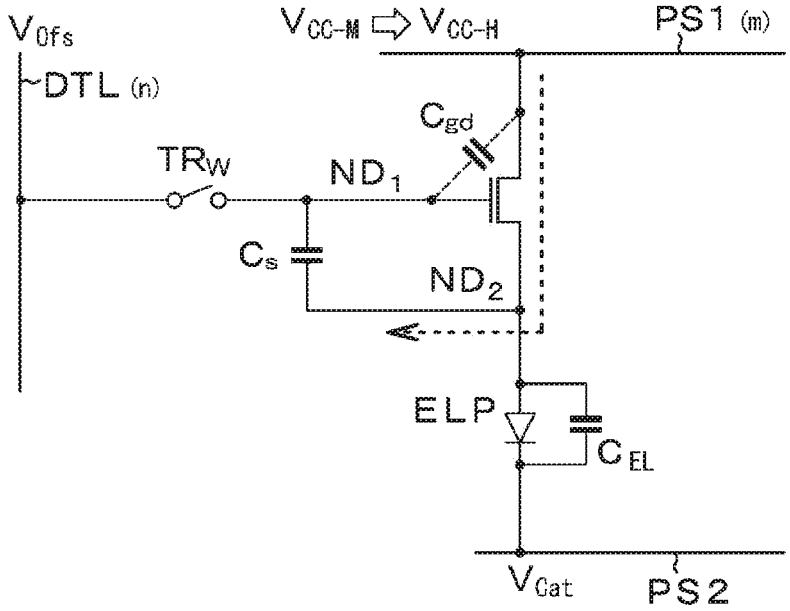
Figure 15A:
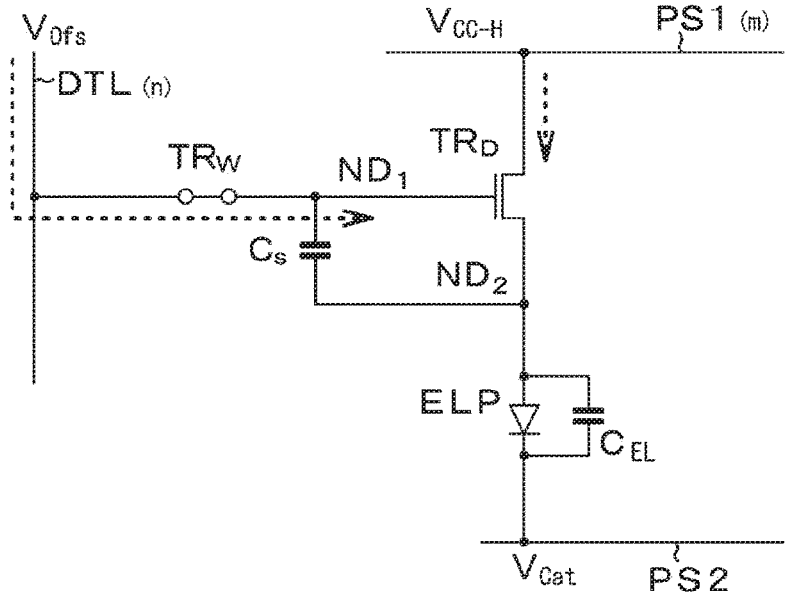
FIGS. 15A and 15B are diagrams each schematically illustrating the conductive state/non-conductive state and the like of each transistor configuring the drive circuit of the display element according to the display device of the first embodiment, continuing from FIG. 14B.
Figure 15B:
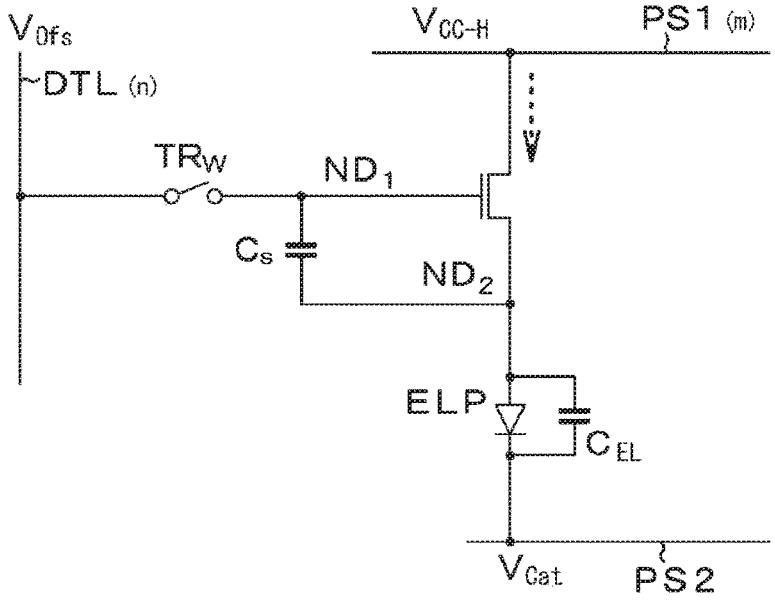

In the first embodiment, the voltage of the feeder line $PS1_m$ is switched from the first drive voltage $V_{CC\text{-}M}$ to the second drive voltage $V_{CC\text{-}H}$, in the middle of the [period-$TP_3$] (see FIG. 14B). Here, since there is parasitic capacitance (represented by a reference sign $C_{gd}$) between the one source/drain region and the gate electrode of the drive transistor $TR_D$, the potential of the gate electrode also increases due to capacitive coupling. As a result, since the gate-source voltage of the drive transistor $TR_D$ exceeds the threshold voltage $V_{th}$, the current flows via the drive transistor $TR_D$, and the potential of the second node $ND_2$ increases. Then, the voltage of the gate electrode of the drive transistor $TR_D$, in other words, the voltage of the first node $ND_1$ also increases due to bootstrap operation.

After that, the reference voltage $V_{Ofs}$ is applied to the gate electrode of the drive transistor $TR_D$ from the data line $DTL_n$ via the write transistor $TR_W$ set in the conductive state on the basis of the scanning signal from the scanning line SCL. The potential of the other source/drain region of the drive transistor $TR_D$ decreases and is initialized to $V_{CC\text{-}L}$ again. The potential of the second node $ND_2$ also decreases. As a result, the drive transistor $TR_D$ is set in the non-conductive state (see FIG. 15A). After that, the write transistor $TR_W$ is set in the non-conductive state, but the drive transistor $TR_D$ keeps the non-conductive state (see FIG. 15B).

Since the operation after the [period-$TP_4$] is similar to the operation described in the reference example, the description will be omitted.

The operation characterizing the first embodiment described above is performed, whereby luminance unevenness is reduced in which the amount of decrease in the gate-source voltage in the bootstrap operation is caused by variation in the threshold voltage $V_{th}$. Detailed description will be made below.

Figure 16:
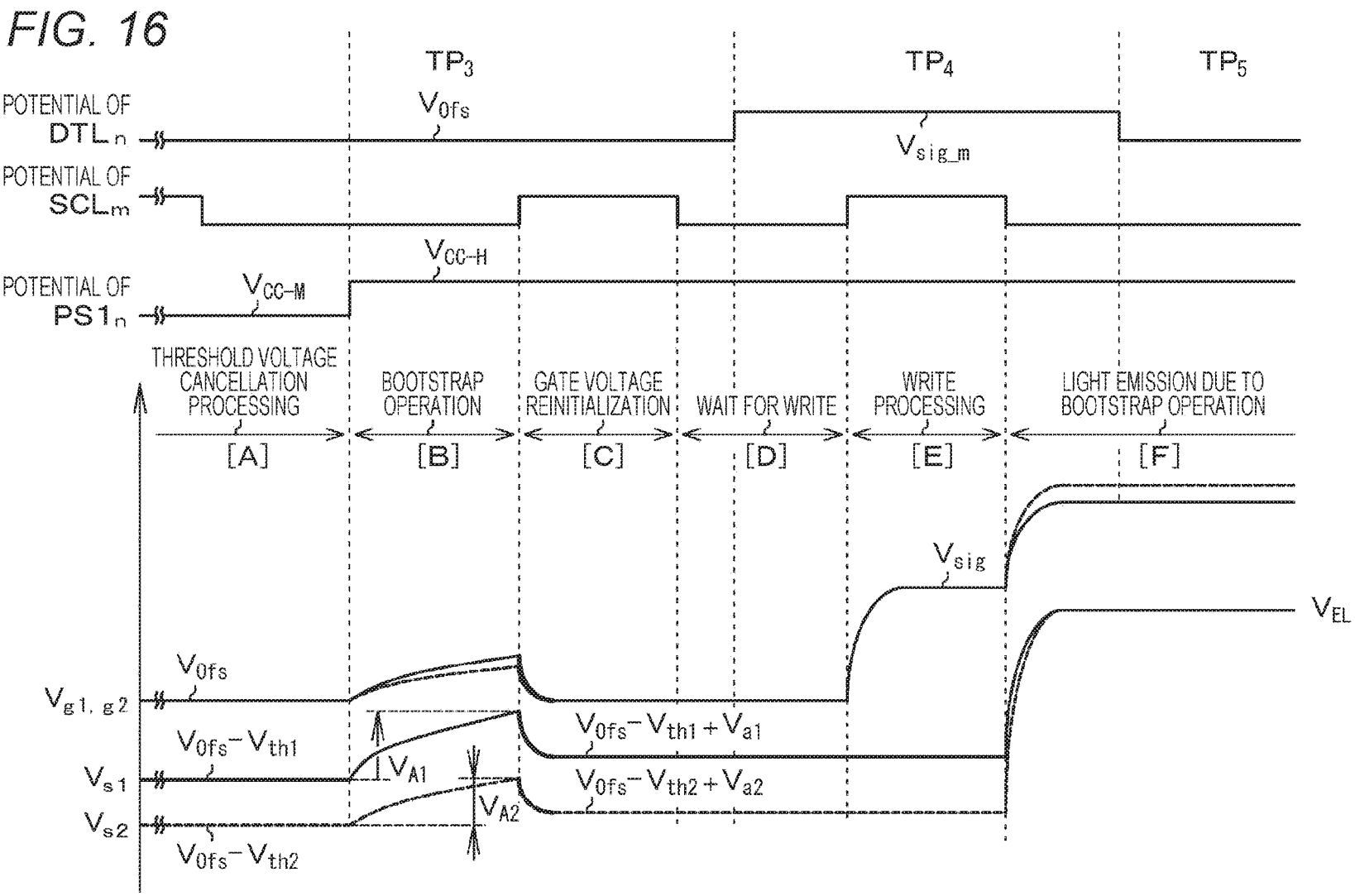
FIG. 16 is a schematic timing chart for explaining changes in the gate voltage and the source voltage of the drive transistor, in the display element including the drive transistor whose threshold voltage is Vth1 and the display element including the drive transistor whose threshold voltage is Vth2 (>Vth1), in the display device according to the first embodiment.

FIG. 16 is a schematic timing chart for explaining changes in the gate voltage and the source voltage of the drive transistor $TR_D$, in the display element including the drive transistor $TR_D$ whose threshold voltage is $V_{th1}$ and the display element including the drive transistor $TR_D$ whose threshold voltage is $V_{th2}$ ($>V_{th1}$), in the display device according to the first embodiment. Note that, the waveform of the transistor whose threshold voltage is $V_{th1}$ is indicated by a solid line, and the waveform of the transistor whose threshold voltage is $V_{th2}$ is indicated by a broken line.

In addition, FIG. 17 is a table for explaining the voltage changes in FIG. 16. Note that, in this table, numerical values are described of an example in which the bootstrap gain $G_{bst}$ is "0.6".

In FIG. 16, reference signs $V_{g1}$ and $V_{s1}$ respectively indicate a gate voltage and a source voltage of the drive transistor $TR_D$ whose threshold voltage is $V_{th1}$. Similarly, reference signs $V_{g2}$ and $V_{s2}$ respectively indicate a gate voltage and a source voltage of the drive transistor $TR_D$ whose threshold voltage is $V_{th2}$. In addition, a reference sign $V_{A1}$ indicates an amount of increase in the source voltage of the drive transistor $TR_D$ whose threshold voltage is $V_{th1}$ during the bootstrap operation in the [period-$TP_3$]. Similarly, a reference sign $V_{A2}$ indicates an amount of increase in the source voltage of the drive transistor $TR_D$ whose threshold voltage is $V_{th2}$.

Qualitatively, even in transistors of the same type, a tendency is shown that a current flows more easily with a transistor whose threshold voltage is lower. In the example of FIG. 16, since $V_{th1}<V_{th2}$, there is a magnitude relationship such as $V_{A1}>V_{A2}$.

Then, if the voltage of the gate electrode is reinitialized in the [period-$TP_3$], the voltage of the source region also decreases to some extent in accordance with the potential change of the gate electrode.

As a result, the gate voltage $V_{s1}$ and the gate voltage $V_{s2}$ have values such as $$V_{s1}=V_{Ofs}-V_{th1}+V_{a1}$$

$$V_{s2}=V_{Ofs}-V_{th2}+V_{a2},$$

as indicated in a field of [C] in FIGS. 16 and 17.

As described above, there is a magnitude relationship such as $V_{A1}>V_{A2}$ before reinitializing the voltage of the gate electrode. For this reason, $V_{a1}$ and $V_{a2}$ also show a magnitude relationship such as $V_{a1}>V_{a2}$. The reason will be described below.

The bootstrap gain $G_{bst}$ described with reference to FIG. 9 is a value indicating the ratio of the gate voltage change to the source voltage change of the drive transistor $TR_D$, and is given as $G_{bst}\equiv C_S/(C_S+C_p)$. Here, from a wiring line relationship of FIG. 9, a value $G_{in}$ is considered indicating the ratio of the source voltage change to the gate voltage change of the drive transistor $TR_D$. In this case, basically, $G_{in}$ is determined by a voltage dividing relationship in a circuit in which the capacitance $C_{EL}$ of the light-emitting unit ELP and the capacitor $C_S$ are connected in series. Specifically, the value is given as $G_{in}\equiv C_S/(C_S+C_{EL})$.

Therefore, the voltage of $V_{g1}$ in [B] of FIG. 16 is expressed as $(V_{Ofs}+V_{A1}\cdot G_{bst})$, and decreases to $V_{Ofs}$ in [C] of FIG. 16. An amount of decrease in $V_{s1}$ due to decrease in $V_{g1}$ is expressed as $(V_{A1}\cdot G_{bst}\cdot G_{in})$. Similarly, the voltage of $V_{g2}$ in [B] of FIG. 16 is expressed as $(V_{Ofs}+V_{A2}\cdot G_{bst})$, and decreases to $V_{Ofs}$ in [C] of FIG. 16. An amount of decrease in $V_{s2}$ due to decrease in $V_{g2}$ is expressed as $(V_{A2}\cdot G_{bst}\cdot G_{in})$.

Then, $V_{a1}$ and $V_{a2}$ in [C] and [D] in FIG. 16 are expressed as $$V_{a1}=V_{A1}\cdot(1-G_{bst}\cdot G_{in})$$

$$V_{a2}=V_{A2}\cdot(1-G_{bst}\cdot G_{in}).$$

Since $G_{bst}$ and $G_{in}$ are values determined from the voltage dividing relationship, $(1-G_{bst}\cdot G_{in})$ is a positive value. Therefore, if $V_{A1}>V_{A2}$, $V_{a1}>V_{a2}$.

Then, the gate voltage $V_{s1}$ and the gate voltage $V_{s2}$ after the write processing are values indicated in a field of [E] in FIG. 17, and the gate voltage $V_{s1}$ and the gate voltage $V_{s2}$ in a state where the bootstrap has occurred are values indicated in a field of [F] in FIG. 17.

From these values, in the first embodiment, in a case where the threshold voltages are $V_{th1}$ and $V_{th2}$, a difference in the amount of decrease in the gate-source voltage in the bootstrap operation is expressed as $(1-0.6)\cdot(V_{th2}-V_{th1})-0.6\times(V_{a1}-V_{a2})$.

Therefore, as compared with a case of the reference example, the difference in the amount of decrease in the gate-source voltage in the bootstrap operation is canceled by $0.6\times(V_{a1}-V_{a2})$. As a result, luminance unevenness is reduced in which the amount of decrease in the gate-source voltage in the bootstrap operation is caused by variation in the threshold voltage $V_{th}$.

For length of a period during which the bootstrap operation is performed in the [period-$TP_3$] in FIG. 3, preferred length only needs to be set as appropriate in accordance with the design and specification of the display device, on the basis of actual measurements and the like.

The first embodiment has been specifically described above; however, the present disclosure is not limited to the embodiment described above, and various modifications can be made based on the technical idea of the present disclosure.

Figure 18:
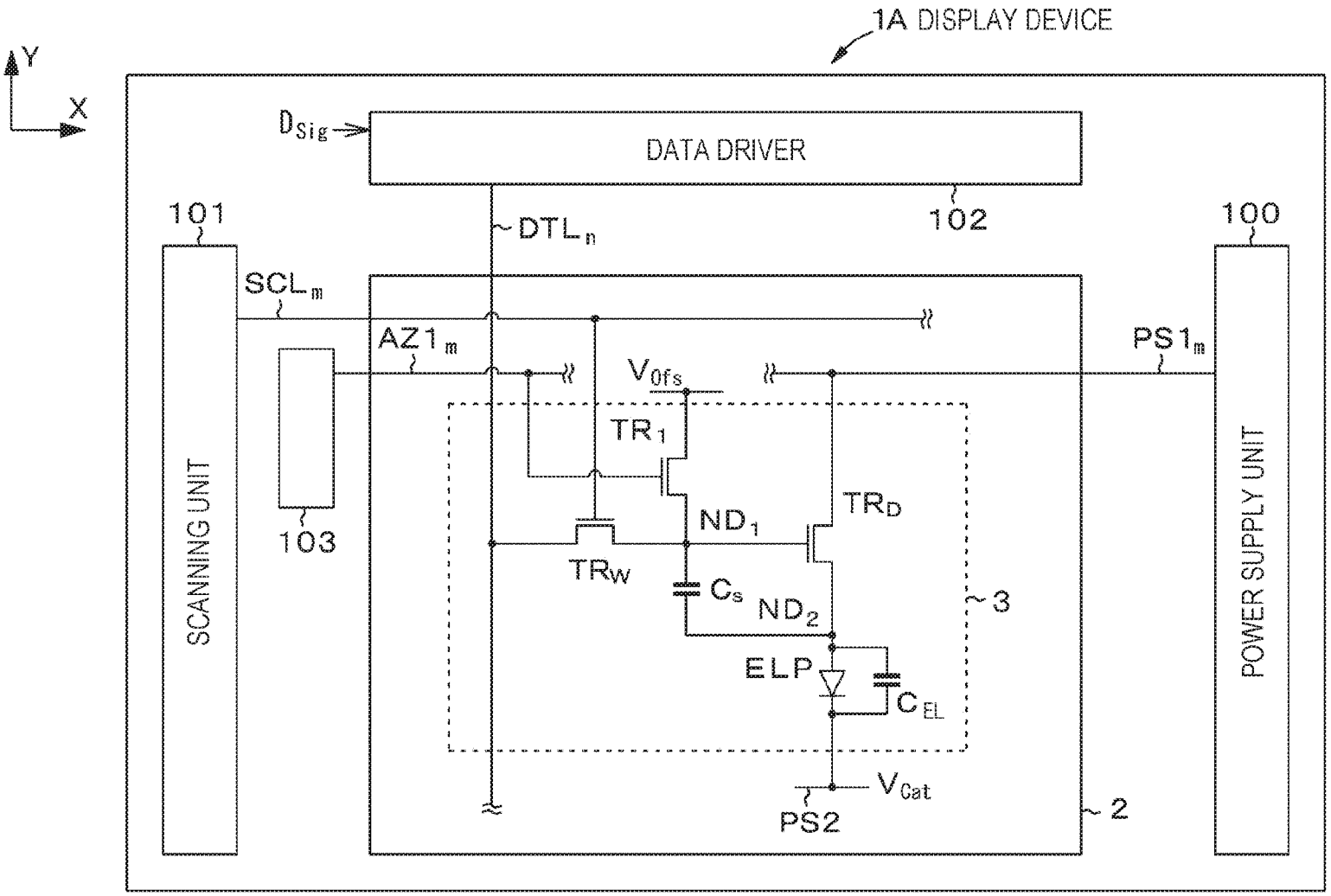
FIG. 18 is a conceptual diagram of a display device according to a modification of the first embodiment.

For example, as in a display device 1A illustrated in FIG. 18, the display element 3 may include a first node initialization transistor $TR_1$ connected to the first node $ND_1$. In the first node initialization transistor $TR_1$, the reference voltage $V_{Ofs}$ is applied to one source/drain region, and the other source/drain region is connected to the first node $ND_1$. The first node initialization transistor $TR_1$ is set in a conductive state when a signal from a first node initialization circuit 103 is applied to its gate electrode, whereby the potential of the first node $ND_1$ can be initialized. Therefore, in this configuration, there is no need to supply the reference voltage $V_{Ofs}$ from the data driver 102.

Second Embodiment

A second embodiment also relates to a display element and a method for driving the display element, and a display device and a method for driving the display device according to the present disclosure.

Figure 19:
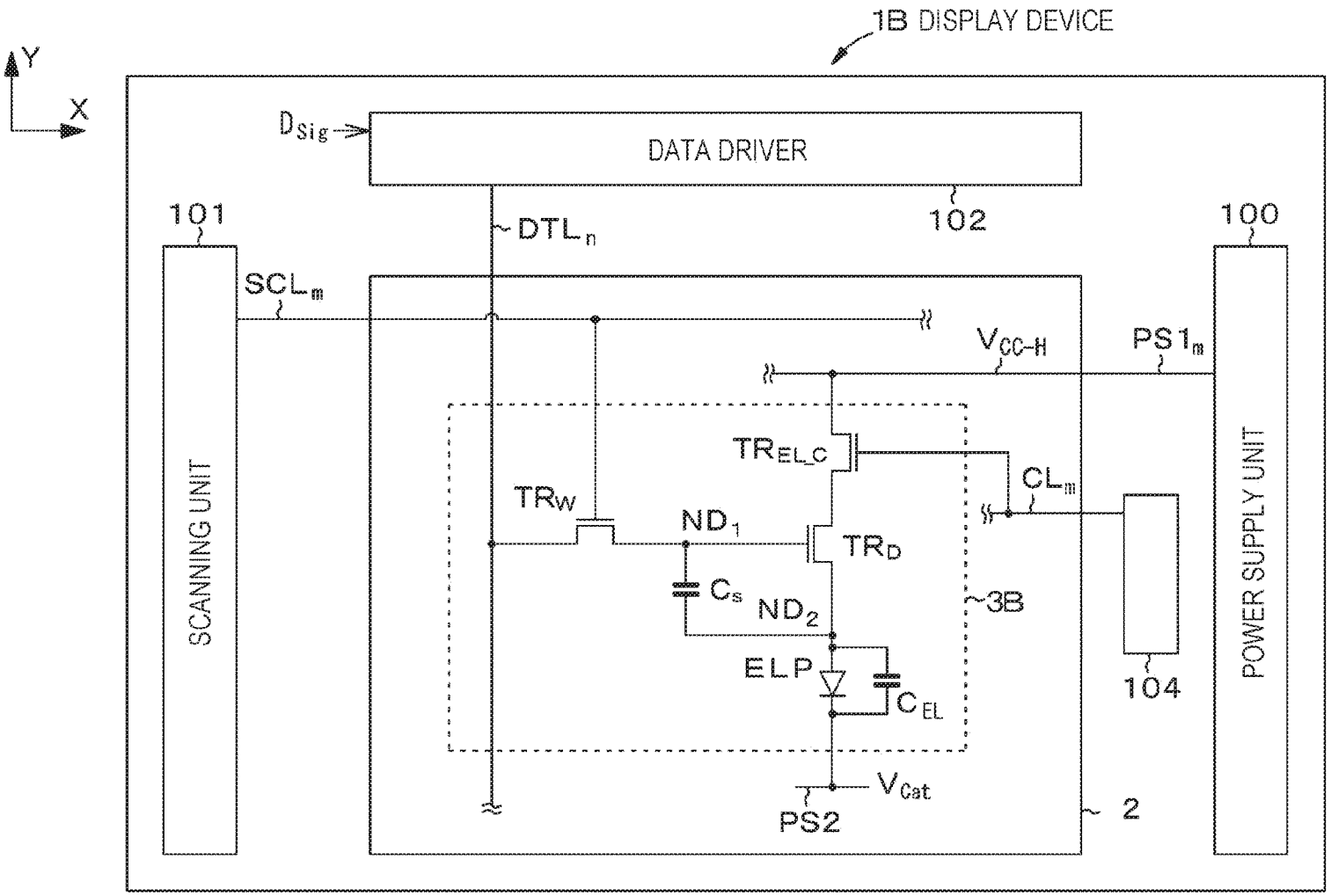
FIG. 19 is a conceptual diagram of a display device according to a second embodiment.

FIG. 19 is a conceptual diagram of the display device according to the second embodiment.

A display device 1B according to the second embodiment mainly differs from the display device 1 illustrated in FIG. 1 in that a display element 3 includes a light emission control transistor $TR_{EL_C}$, and a light emission control line CL and a light emission control unit 104 are included for controlling the light emission control transistor $TR_{EL_C}$. In the second embodiment, a power supply unit 100, a scanning unit 101, a data driver 102, and the light emission control unit 104 configures a drive unit that drives a display unit 2.

M emission control lines CL are provided similarly to the scanning lines SCL, and a gate electrode of the light emission control transistor $TR_{EL_C}$ of the display element 3 in the m-th row is connected to the m-th light emission control line $CL_m$. The light emission control unit 104 supplies a signal to the light emission control line CL. As a result, a conductive state/non-conductive state is controlled of the light emission control transistor $TR_{EL_C}$ connected to the light emission control line CL. Note that, in FIG. 19, only the light emission control line $CL_m$ is illustrated.

Similarly to a drive transistor $TR_D$ and a write transistor $TR_W$, the light emission control transistor $TR_{EL_C}$ includes an re-channel TFT. Note that, for example, the write transistor $TR_W$ can include a p-channel TFT.

The light emission control transistor $TR_{EL_C}$ is disposed between one source/drain region of the drive transistor $TR_D$ and a feeder line PS1. Therefore, a voltage is applied to the one source/drain region of the drive transistor $TR_D$ via the light emission control transistor $TR_{EL_C}$.

The configuration of the display element 3 is similar to the configuration described in the first embodiment except that the light emission control transistor $TR_{EL_C}$ is added. As in the first embodiment, a video signal voltage is applied to a gate electrode of the drive transistor $TR_D$ via the write transistor $TR_W$ in a conductive state.

Note that, a voltage supplied by the data driver 102 or the power supply unit 100 is different from the voltage in the first embodiment. The data driver 102 sequentially supplies a voltage $V_{Ofs-H}$ exceeding a reference voltage $V_{Ofs}$, the reference voltage $V_{Ofs}$, and a video signal voltage $V_{Sig}$, to a data line DTL. More specifically, the voltage $V_{Ofs-H}$ is supplied and then the reference voltage $V_{Ofs}$ is supplied in the first half of a horizontal scanning period, and the video signal voltage $V_{Sig}$ is supplied in the latter half. The power supply unit 100 supplies a second drive voltage $V_{CC-H}$ to the feeder line PS1.

An outline of the display device 1B has been described above. Subsequently, an outline will be described of operation of the display device 1B. Detailed operation will be described in detail later with reference to FIGS. 21A, 21B, 22A, 22B, 23A, 23B, 24A, 24B, 25A, 25B, and 26 as described later.

Figure 20:
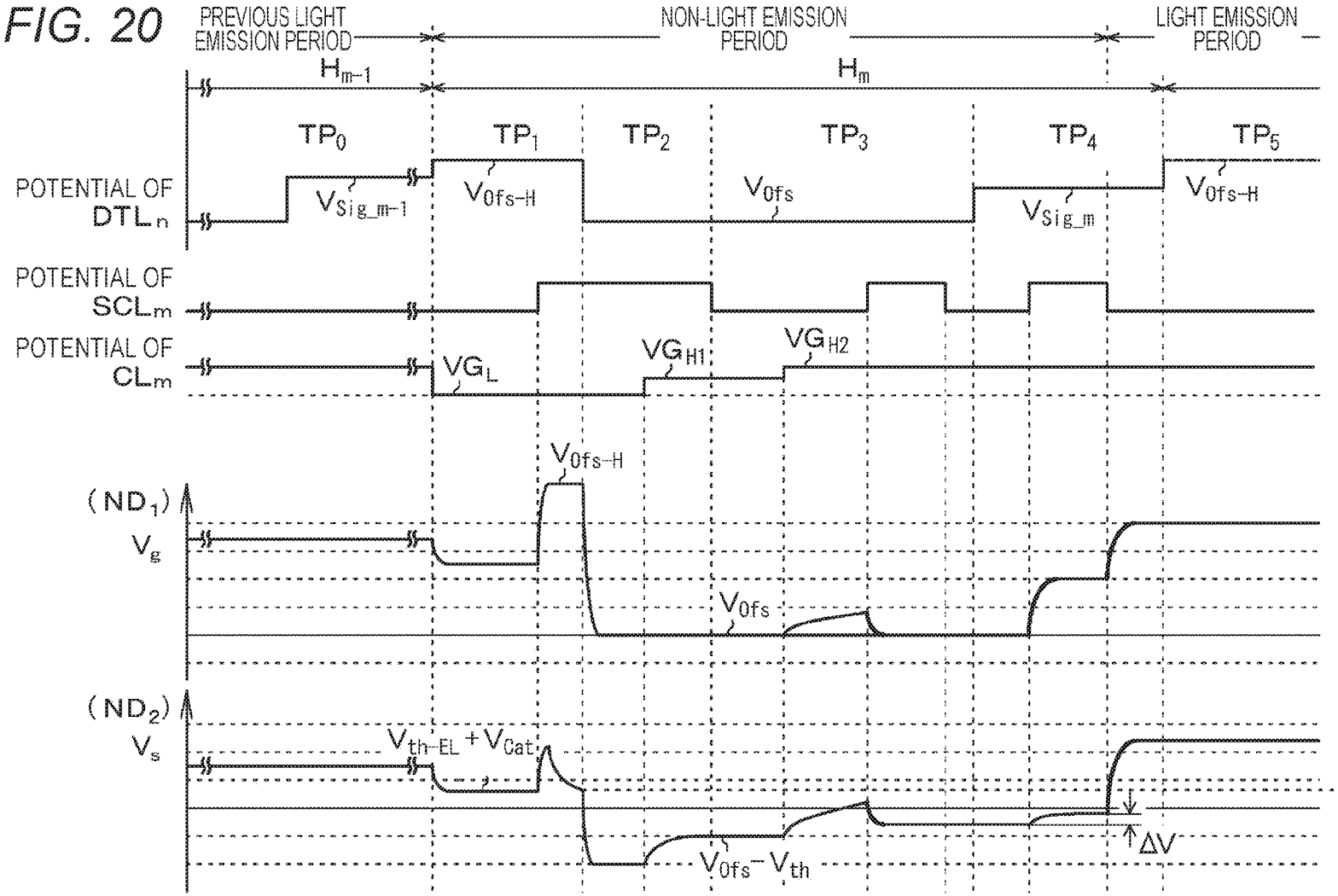
FIG. 20 is a schematic timing chart for explaining operation of the display device according to the second embodiment, more specifically, operation of an (n, m)-th display element of the display device.
Figure 21A:
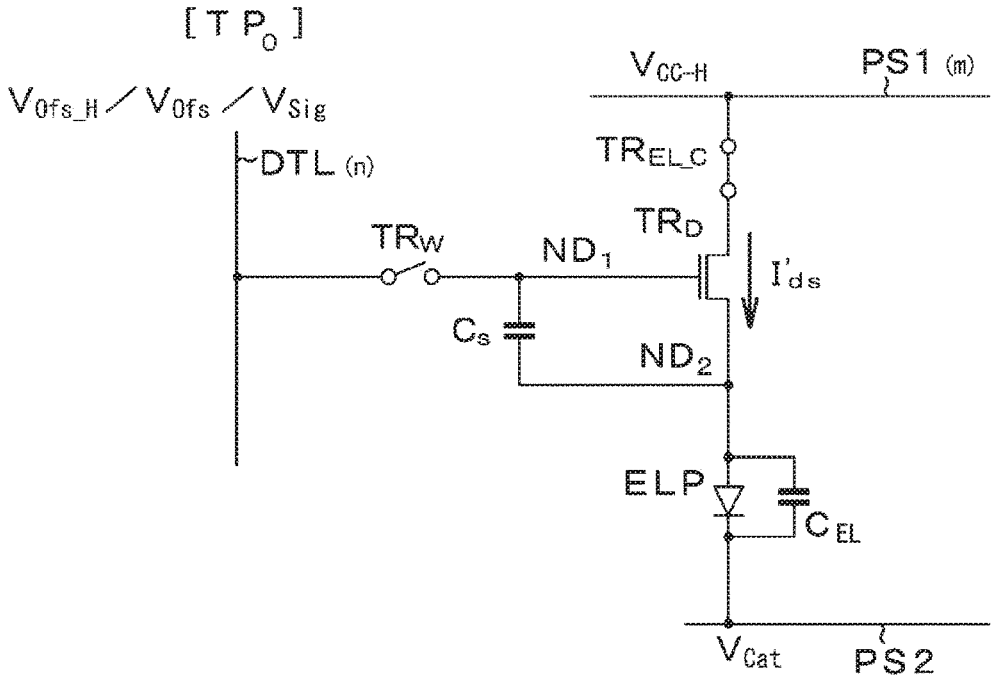
FIGS. 21A and 21B are diagrams each schematically illustrating a conductive state/non-conductive state and the like of each transistor configuring a drive circuit of a display element according to the display device of the second embodiment.
Figure 21B:
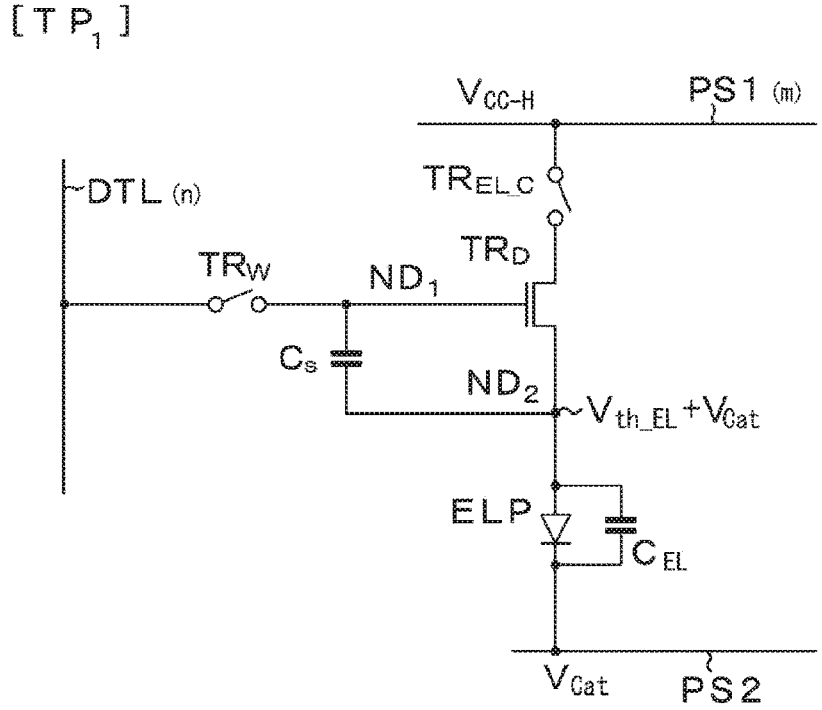
Figure 22A:
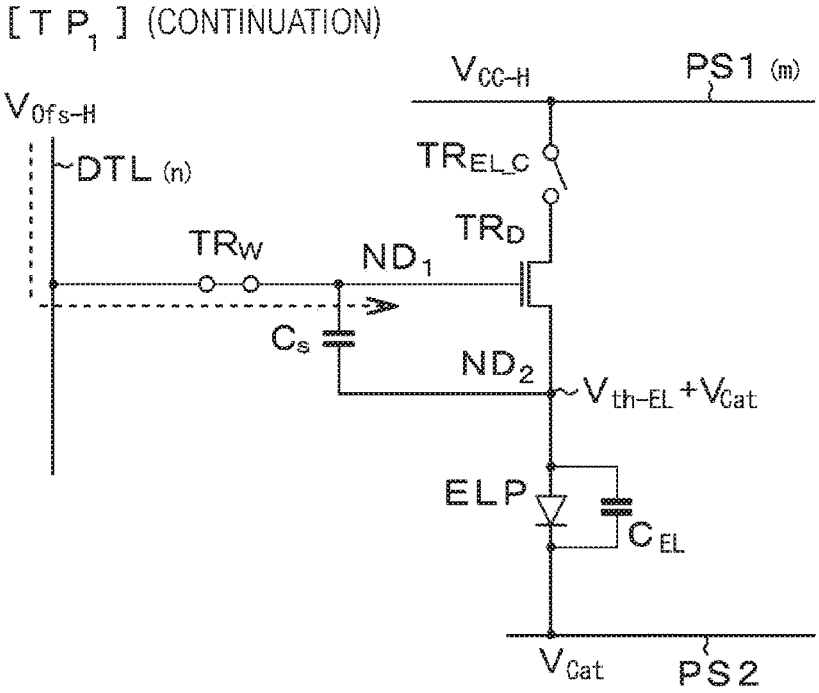
FIGS. 22A and 22B are diagrams each schematically illustrating the conductive state/non-conductive state and the like of each transistor configuring the drive circuit of the display element according to the display device of the second embodiment, continuing from FIG. 21B.
Figure 22B:
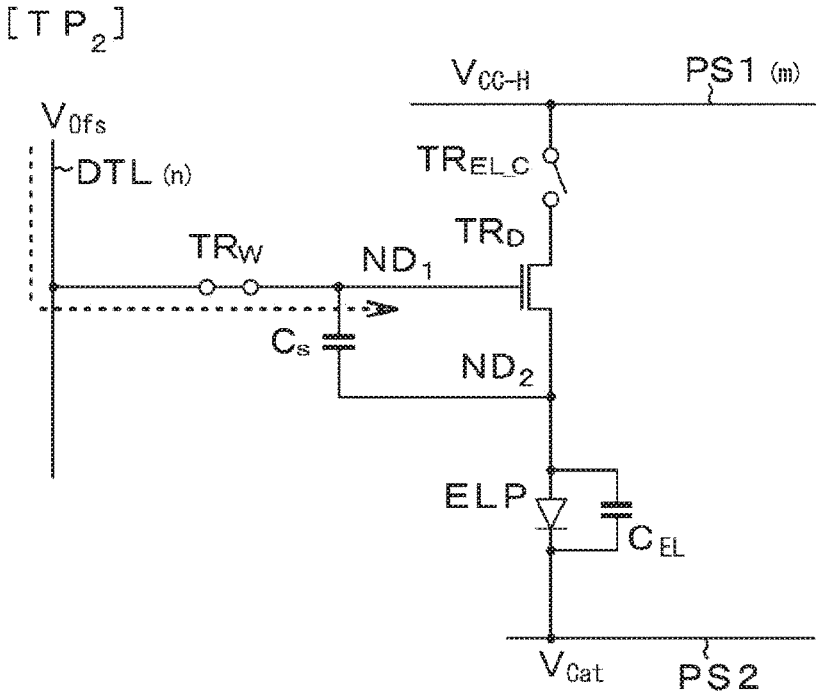

FIG. 20 is a schematic timing chart for explaining operation of the display device according to the second embodiment, more specifically, operation of an (n, m)-th display element of the display device.

As described above, in the present disclosure, in driving the display element 3 including the n-channel drive transistor $TR_D$ in which the voltage is applied to the one source/drain region and the light-emitting unit ELP is connected to the other source/drain region, and the capacitor $C_S$ connected between the gate electrode of the drive transistor $TR_D$ and the other source/drain region, performs threshold voltage cancellation processing that applies a drive voltage to the one source/drain region in a state where the reference voltage $V_{Ofs}$ is applied to the gate electrode of the drive transistor $TR_D$, to bring a potential of the other source/drain region closer to a potential obtained by subtracting the threshold voltage $V_{th}$ of the drive transistor $TR_D$ from the reference voltage;

subsequently, sets the gate electrode of the drive transistor $TR_D$ in the floating state, and changes a potential of the gate electrode in the floating state via parasitic capacitance and causing a current to flow via the drive transistor $TR_D$ to increase a voltage between the other source/drain region and the gate electrode, and then applies the reference voltage $V_{Ofs}$ to the gate electrode of the drive transistor $TR_D$;

afterwards, performs write processing that applies the video signal voltage $V_{Sig}$ to the gate electrode of the drive transistor $TR_D$; and subsequently, sets the gate electrode of the drive transistor $TR_D$ in the floating state to cause the light-emitting unit ELP to emit light.

Here, in the second embodiment, the threshold voltage cancellation processing is performed to apply the drive voltage to the one source/drain region of the drive transistor $TR_D$ via the light emission control transistor $TR_{EL_C}$ set in the conductive state due to application of a first control voltage to its gate electrode, in a state where the reference voltage $V_{Ofs}$ is applied to the gate electrode of the drive transistor $TR_D$, to bring the potential of the other source/drain region closer to the potential obtained by subtracting the threshold voltage $V_{th}$ of the drive transistor $TR_D$ from the reference voltage $V_{Ofs}$, and subsequently, the gate electrode of the drive transistor $TR_D$ is set in the floating state and the voltage applied to the gate of the light emission control transistor $TR_{EL_C}$ is switched to a second control voltage exceeding the first control voltage, to change the potential of the gate electrode in the floating state via the parasitic capacitance and cause the current to flow via the drive transistor $TR_D$, to increase the voltage between the other source/drain region and the gate electrode, and then the reference voltage $V_{Ofs}$ is applied to the gate electrode of the drive transistor $TR_D$.

In the following description, the values of the voltage or the potential are set as follows, but these are values for the purpose of illustration only and are not limited to these values.

VGL: Voltage for setting light emission control transistor TREL_C in non-conductive state . . . 0 volts VGH1: First control voltage for setting light emission control transistor TREL_C in conductive state . . . 10 volts VGH2: Second control voltage for setting light emission control transistor TREL_C in conductive state . . . 15 Volts VOfs-H: Voltage exceeding reference voltage VOfs . . . 30 Volts

[Period-$TP_0$] (See FIGS. 20 and 21 A)

A [period-$TP_0$] illustrated in FIG. 20 is, for example, of operation in a previous display frame, and is a period in which an (n, m)-th display element 3 is in a light emitting state. A drain current flows through the light-emitting unit ELP in the display element 3 configuring the (n, m)-th pixel via the drive transistor $TR_D$. The write transistor $TR_W$ is in a non-conductive state, and the light emission control transistor $TR_{EL_C}$ and the drive transistor $TR_D$ are each in the conductive state.

[Period-$TP_1$] to [Period-$TP_2$] (See FIGS. 20, 21B, 22A, 22B and 23A)

After this [period-$TP_1$] is, for example, of operation in a current display frame. In the [period-$TP_1$] to [period-$TP_2$], the light emission control transistor $TR_{EL_C}$ is set in the non-conductive state and a voltage exceeding the reference voltage $V_{Ofs}$ is applied to the gate electrode of the drive transistor $TR_D$, and subsequently the reference voltage $V_{Ofs}$ is applied, to initialize the potential of the other source/drain region of the drive transistor $TR_D$, and after that, the threshold voltage cancellation processing is performed. The voltage $V_{Ofs-H}$ exceeding the reference voltage $V_{Ofs}$ and the reference voltage $V_{Ofs}$ are applied to the gate electrode of the drive transistor $TR_D$ via the write transistor $TR_W$ set in the conductive state.

Specifically, in the beginning period of the [period-$TP_1$], a voltage $VG_L$ is supplied to the light emission control line $CL_m$, and the light emission control transistor $TR_{EL_C}$ is set in the non-conductive state. Since the drive transistor $TR_D$ and a feeder line $PS1_m$ are electrically disconnected from each other, the light-emitting unit ELP is turned off. As a result, the potential of the other source/drain region of the drive transistor $TR_D$ (that is, the potential of the second node $ND_2$) decreases to a value such as ($V_{th-EL}$+$V_{Cat}$) (see FIG. 21B). Since the write transistor $TR_W$ is in the non-conductive state and the first node $ND_1$ and the second node $ND_2$ are connected together via the capacitor $C_S$, the potential of the first node $ND_1$ also decreases with potential decrease in the second node $ND_2$.

Note that, from the start of the [period-TP1], the voltage VOfs-H exceeding the reference voltage VOfs is supplied to a data line DTLn. The scanning line SCL is set to a high level in the middle of the [period-TP1], to set the write transistor TRW in the conductive state. As a result, the potential of the first node ND1 increases to VOfs-H. Since the first node ND1 and the second node ND2 are connected together via the capacitor CS, the second node ND2 also increases. As a result, a potential difference between both ends of the light-emitting unit ELP exceeds the threshold voltage Vth-EL, so that the light-emitting unit ELP is in a conductive state, but the potential of the source region of the drive transistor TRD immediately decreases to (Vth-EL+VCat) again (see FIG. 22A). Note that, in this process, although the light-emitting unit ELP can emit light, the light emission is momentary and is not a problem practically. Meanwhile, the gate electrode of the drive transistor TRD holds the voltage VOfs-H.

Then, in the [period-$TP_2$], the voltage of the data line $DTL_n$ is switched to the reference voltage $V_{Ofs}$. As a result, the potential of the first node $ND_1$ is $V_{Ofs}$ (see FIG. 22B). Then, with potential decrease in the first node $ND_1$, the potential of the second node $ND_2$ also decreases. That is, charges based on a change ($V_{Ofs}-V_{Ofs-H}$) in the potential of the gate electrode of the drive transistor $TR_D$ are distributed to the capacitor $C_S$, the parasitic capacitance $C_{EL}$ of the light-emitting unit ELP, and parasitic capacitance between the source region and the gate electrode of the drive transistor $TR_D$. Note that, as a prerequisite for threshold correction operation, the potential of the second node $ND_2$ needs to be lower than ($V_{Ofs}-V_{th}$). Values of the voltage $V_{Ofs-H}$ and the like are set to satisfy this condition. That is, with the above processing, the potential difference between the source region and the gate electrode of the drive transistor $TR_D$ is equal to or greater than $V_{th}$, and the drive transistor $TR_D$ is set in the conductive state.

Figure 23A:
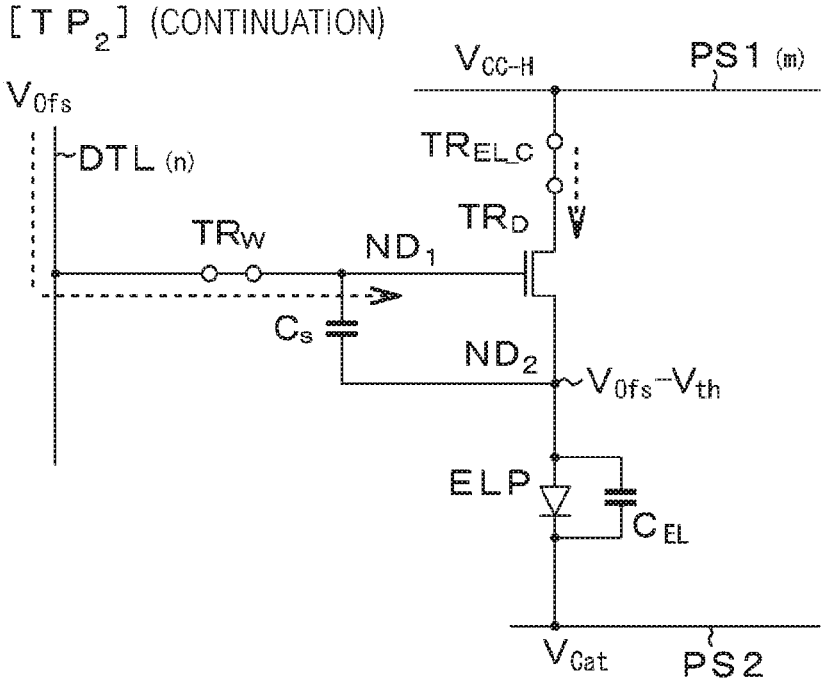
FIGS. 23A and 23B are diagrams each schematically illustrating the conductive state/non-conductive state and the like of each transistor configuring the drive circuit of the display element according to the display device of the second embodiment, continuing from FIG. 22B.

Next, the threshold voltage cancellation processing is performed to apply the drive voltage to the one source/drain region of the drive transistor $TR_D$ via the light emission control transistor $TR_{EL_C}$ set in the conductive state due to application of a first control voltage $VG_{H1}$ to the gate electrode, in a state where the reference voltage $V_{Ofs}$ is applied to the gate electrode of the drive transistor $TR_D$, to bring the potential of the other source/drain region closer to the potential obtained by subtracting the threshold voltage $V_{th}$ of the drive transistor $TR_D$ from the reference voltage $V_{Ofs}$ (see FIG. 23A).

Figure 23B:
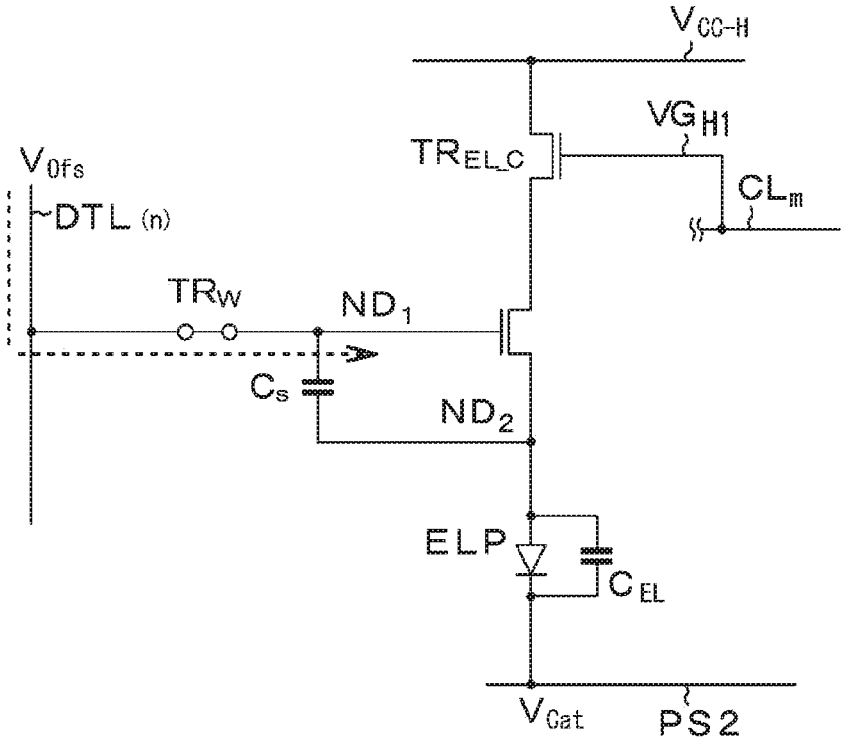

Specifically, the first control voltage $VG_{H1}$ is supplied to the light emission control line $CL_m$ in a state where the conductive state of the write transistor $TR_W$ is kept (see FIG. 23B). Since the gate-source voltage of the drive transistor $TR_D$ exceeds the threshold voltage $V_{th}$, the current flows through the drive transistor $TR_D$ and the potential of the other source/drain region increases. As a result, the potential of the second node $ND_2$ is brought to be closer to the potential obtained by subtracting the threshold voltage $V_{th}$ of the drive transistor $TR_D$ from the reference voltage $V_{Ofs}$. If the potential of the second node $ND_2$ reaches ($V_{Ofs}-V_{th}$), the drive transistor $TR_D$ is in a non-conductive state.

[Period-$TP_3$] (See FIGS. 20, 24A, 24B, 25A, 25B, and 26)

In this [period-$TP_3$], the gate electrode of the drive transistor $TR_D$ is set in the floating state, and the potential of the gate electrode in the floating state is changed via the parasitic capacitance and the current is caused to flow via the drive transistor $TR_D$, to increase the voltage between the other source/drain region and the gate electrode, and then the reference voltage $V_{Ofs}$ is applied to the gate electrode of the drive transistor $TR_D$.

Specifically, the gate electrode of the drive transistor $TR_D$ is set in the floating state and the voltage applied to the gate of the light emission control transistor $TR_{EL_C}$ is switched to a second control voltage $VG_{H2}$ exceeding the first control voltage $VG_{H1}$, to change the potential of the gate electrode in the floating state via the parasitic capacitance and cause the current to flow via the drive transistor $TR_D$, to increase the voltage between the other source/drain region and the gate electrode, and then the reference voltage $V_{Ofs}$ is applied to the gate electrode of the drive transistor $TR_D$.

In the beginning period of the [period-$TP_3$], the scanning line $SCL_m$ is set to a low level, and the write transistor $TR_W$ is set in the non-conductive state. As a result, the first node $ND_1$ is in the floating state. If the drive transistor $TR_D$ has reached the non-conductive state in the [period-$TP_2$], the potentials of the first node $ND_1$ and the second node $ND_2$ do not substantially change (see FIG. 24A).

Figure 24A:
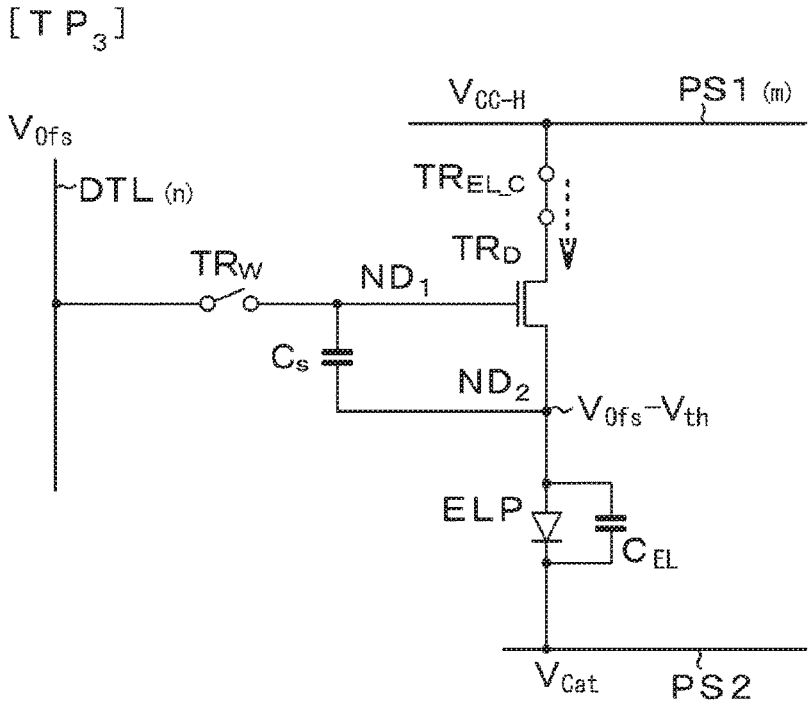
FIGS. 24A and 24B are diagrams each schematically illustrating the conductive state/non-conductive state and the like of each transistor configuring the drive circuit of the display element according to the display device of the second embodiment, continuing from FIG. 23B.
Figure 24B:
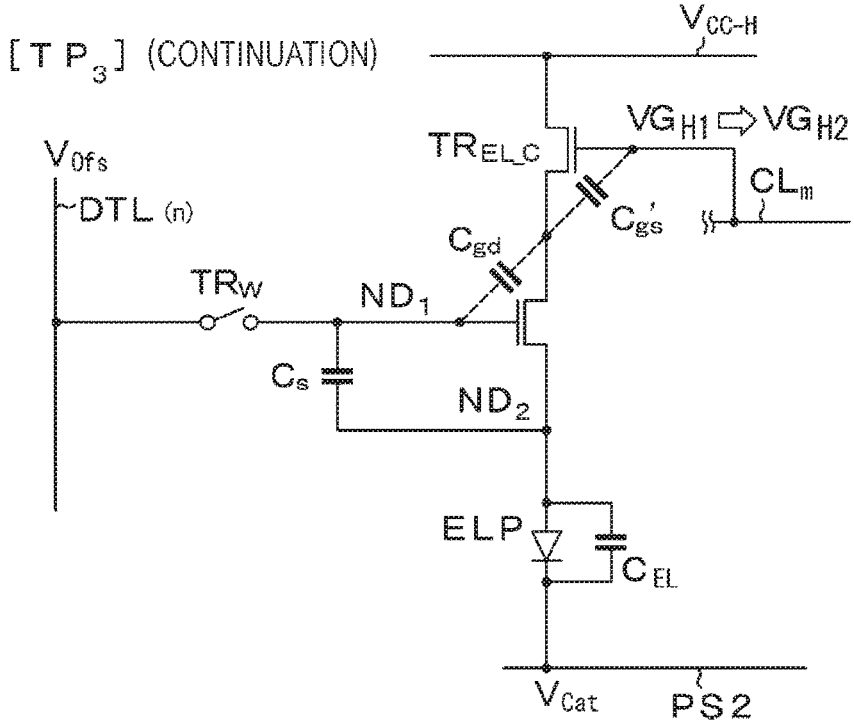
Figure 25A:
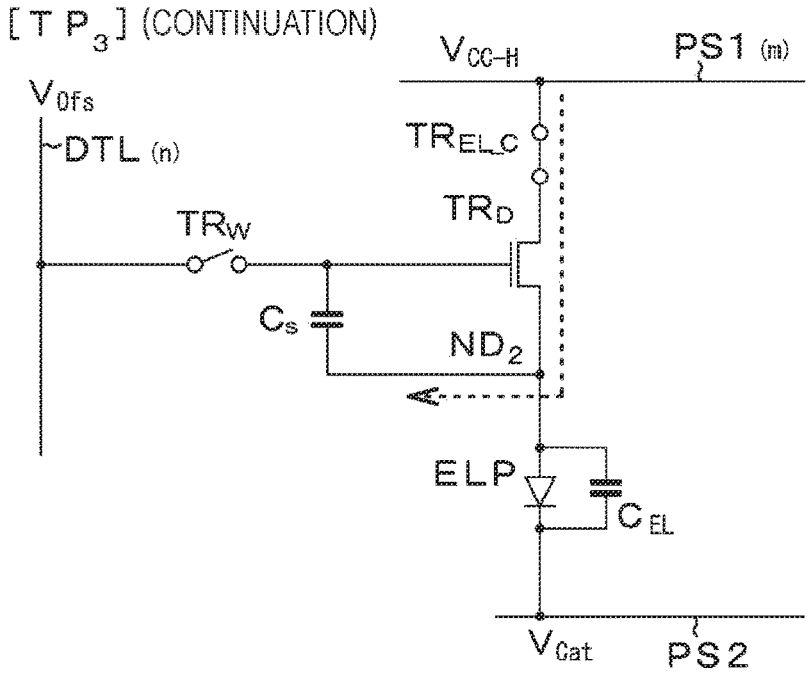
FIGS. 25A and 25B are diagrams each schematically illustrating the conductive state/non-conductive state and the like of each transistor configuring the drive circuit of the display element according to the display device of the second embodiment, continuing from FIG. 24B.
Figure 25B:
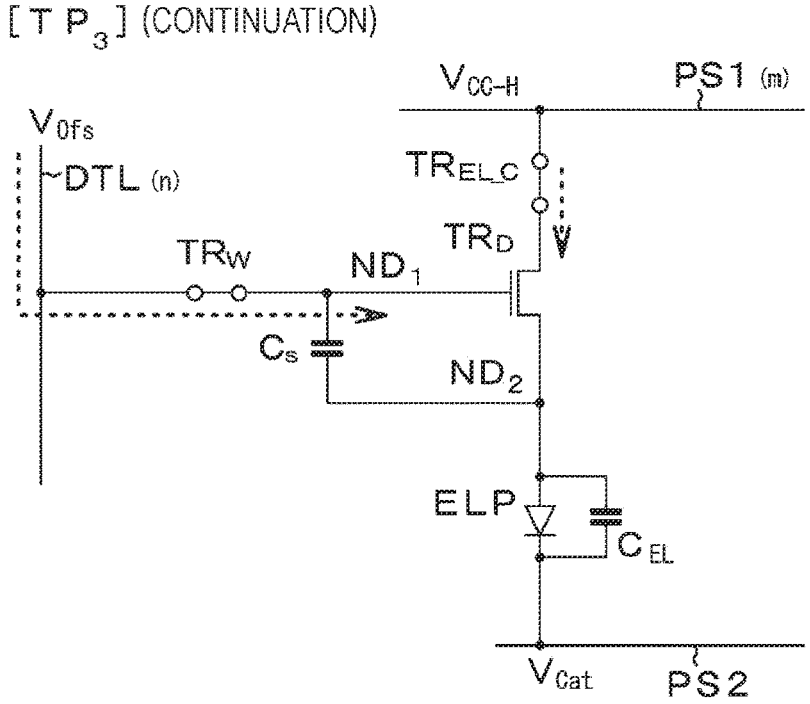
Figure 26:
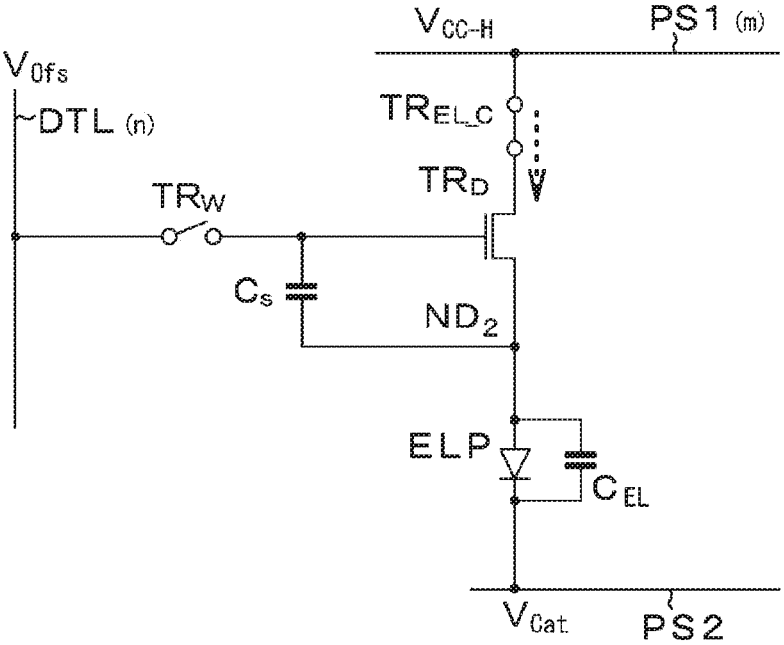
FIG. 26 is a diagram schematically illustrating the conductive state/non-conductive state and the like of each transistor configuring the drive circuit of the display element according to the display device of the second embodiment, continuing from FIG. 25B.

In the second embodiment, the voltage of the light emission control line $CL_m$ is switched from the first control voltage $VG_{H1}$ to the second control voltage $VG_{H2}$ in the middle of the [period-$TP_3$] (see FIG. 24B). Here, since there is parasitic capacitance $C_{gd}$ between the one source/drain region and the gate electrode of the drive transistor $TR_D$ and also there is parasitic capacitance (represented by a reference sign $C_{gs}$') between the source region and the gate electrode of the light emission control transistor $TR_{EL_C}$, the potential of the gate electrode of the drive transistor $TR_D$ also increases due to capacitive coupling. As a result, since the gate-source voltage of the drive transistor $TR_D$ exceeds the threshold voltage $V_{th}$, the current flows via the drive transistor $TR_D$, and the potential of the second node $ND_2$ increases. Then, the voltage of the gate electrode of the drive transistor $TR_D$, in other words, the voltage of the first node $ND_1$ also increases due to bootstrap operation (see FIG. 25A).

After that, the reference voltage $V_{Ofs}$ is applied to the gate electrode of the drive transistor $TR_D$ from the data line $DTL_n$ via the write transistor $TR_W$ set in the conductive state on the basis of the scanning signal from the scanning line SCL. The potential of the other source/drain region of the drive transistor $TR_D$ decreases and is initialized to $V_{CC-L}$ again. The potential of the second node $ND_2$ also decreases. As a result, the drive transistor $TR_D$ is set in the non-conductive state (see FIG. 25B). After that, the write transistor $TR_W$ is set in the non-conductive, but the drive transistor $TR_D$ keeps the non-conductive state (see FIG. 26).

Since the operation after the [period-$TP_4$] is similar to the operation described in the first embodiment, the description will be omitted.

Voltage changes of the gate electrode and the source region of the drive transistor $TR_D$ in the [period-$TP_3$] of the second embodiment is similar to the voltage changes in the [period-$TP_3$] of the first embodiment. Therefore, similarly to the description of the first embodiment, luminance unevenness is reduced in which the amount of decrease in the gate-source voltage in the bootstrap operation is caused by variation in the threshold voltage $V_{th}$.

The second embodiment has been specifically described above; however, the present disclosure is not limited to the embodiment described above, and various modifications can be made based on the technical idea of the present disclosure.

Figure 27:
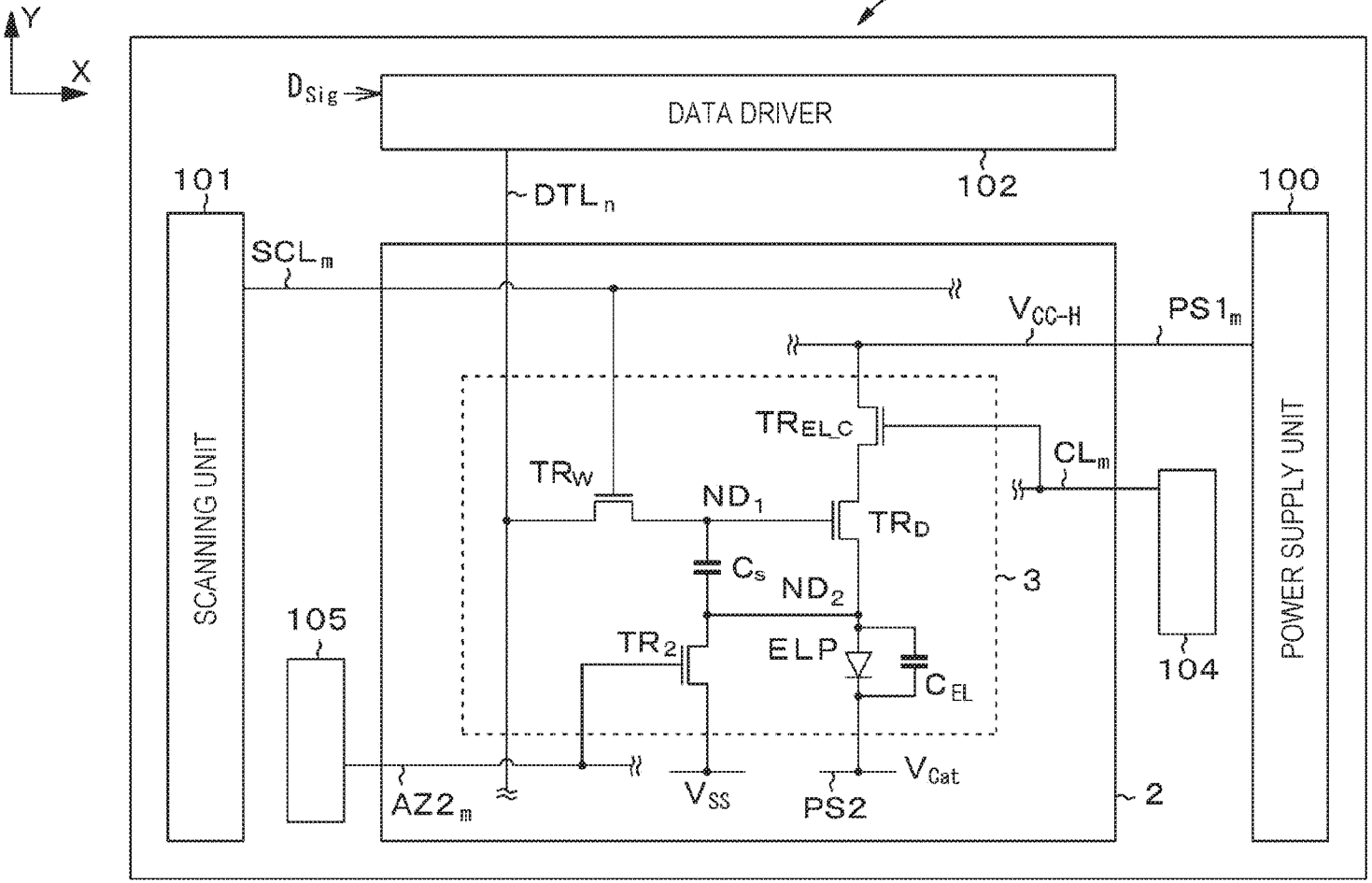
FIG. 27 is a conceptual diagram of a display device according to a modification of the second embodiment.
Figure 28:
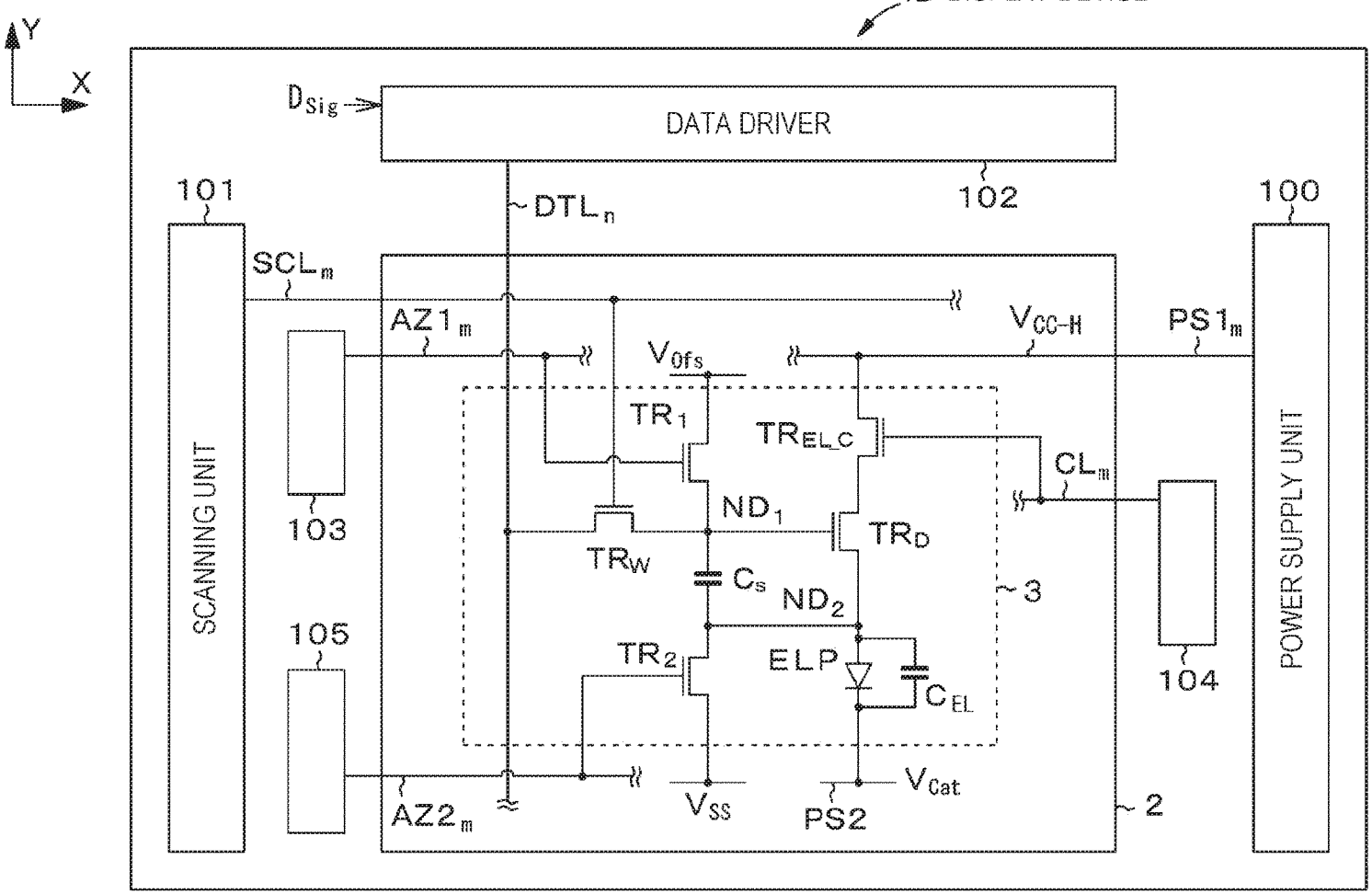
FIG. 28 is a conceptual diagram of a display device according to a modification of the second embodiment.

For example, as in a display device 1C illustrated in FIG. 27, the display element 3 may include a second node initialization transistor $TR_2$ connected to the second node $ND_2$. In the second node initialization transistor $TR_2$, an initialization voltage $V_{SS}$ is applied to one source/drain region, and the other source/drain region is connected to the second node $ND_2$. A signal from the second node initialization circuit 105 is applied to a gate electrode of the second node initialization transistor $TR_2$, whereby its conductive state/non-conductive state is controlled, so that the potential of the second node $ND_2$ can be initialized. Therefore, there is no need for the data driver 102 to supply the voltage $V_{Ofs\text{-}H}$ or the voltage $V_{Ofs}$. In addition, as in a display device 1D illustrated in FIG. 28, the display element 3 may include a first node initialization transistor $TR_1$ connected to the first node $ND_1$, and the second node initialization transistor $TR_2$ connected to the second node $ND_2$.

The embodiments have been specifically described above; however, the present disclosure is not limited to the embodiments described above, and various modifications can be made based on the technical idea of the present disclosure. For example, numerical values, structures, substrates, raw materials, processes, and the like mentioned in the embodiments described above are merely examples, and numerical values, structures, substrates, raw materials, processes, and the like different from the above may be used as needed.

The display device of the present disclosure described above can be used as a display unit (display device) of an electronic device in all fields, the display unit displaying a video signal input to the electronic device or a video signal generated in the electronic device as an image or a video. For example, the display device can be used as a display unit of a television set, a digital still camera, a laptop personal computer, a mobile terminal device such as a mobile phone, a video camera, a head mounted display, and the like.

The display device of the present disclosure also includes a module shape display device having a sealed configuration. An example is a display module in which a facing unit such as transparent glass is attached to a pixel array unit. Note that, the display module may be provided with a circuit unit for inputting/outputting a signal and the like to the pixel array unit from the outside, a flexible printed circuit (FPC), and the like. As a specific example of the electronic device using the display device of the present disclosure, a digital still camera and a head mounted display will be exemplified below. However, the specific example exemplified here is merely an example, and the present invention is not limited to the example.

SPECIFIC EXAMPLE 1

Figure 29A:
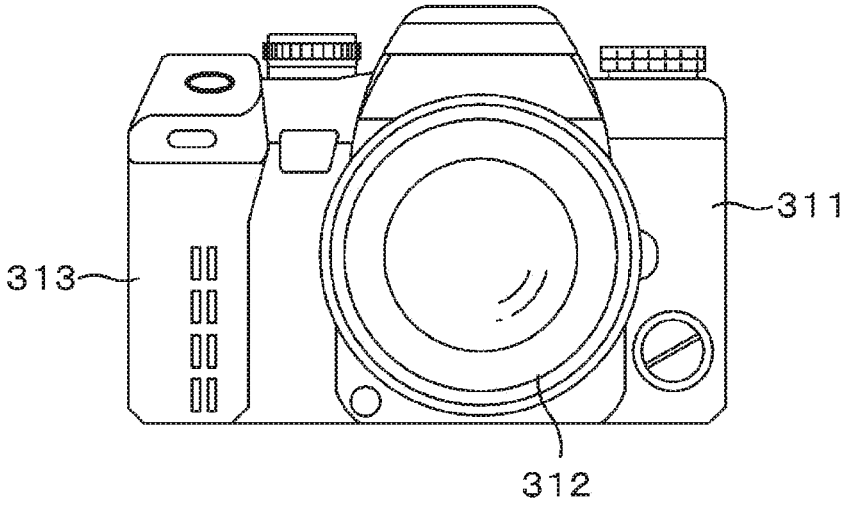
Figure 29B:
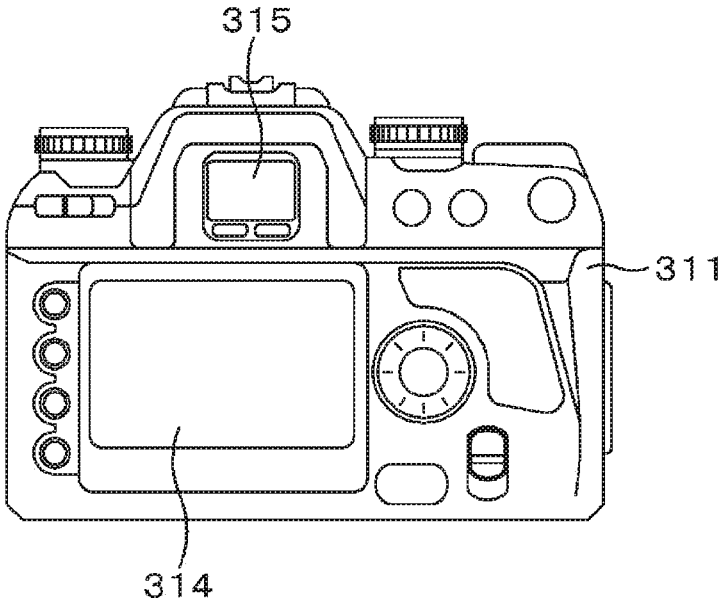

FIGS. 29A and 29B are external views of a lens interchangeable single lens reflex type digital still camera, and FIG. 29A illustrates a front view of the camera and FIG. 29B illustrates a rear view of the camera. The lens interchangeable single lens reflex type digital still camera includes an interchangeable photographing lens unit (interchangeable lens) 312 on the front right side of the camera body part (camera body) 311, and includes a grip part 313 to be held by a photographer on the front left side, for example.

Furthermore, a monitor 314 is provided substantially at the center of the rear surface of the camera body part 311. A viewfinder (eyepiece window) 315 is provided on the top of the monitor 314. The photographer can look in the viewfinder 315, to visually recognize an optical image of a subject guided from the photographing lens unit 312 and determine composition.

In the lens interchangeable single lens reflex type digital still camera with the above configuration, the display device of the present disclosure can be used as the viewfinder 315. That is, the lens interchangeable single lens reflex type digital still camera according to this example is manufactured by using the display device of the present disclosure as the viewfinder 315.

SPECIFIC EXAMPLE 2

Figure 30:
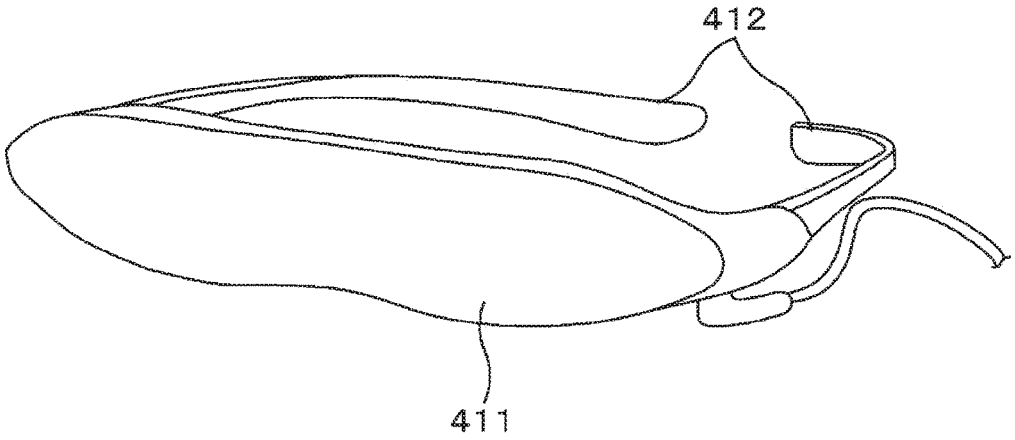
FIG. 30 is an external view of a head mounted display.

FIG. 30 is an external view of a head mounted display. The head mounted display includes, for example, an ear hooking part 412 for attaching to the head of a user on both sides of an eyeglasses-shaped display unit 411. In this head mounted display, the display device of the present disclosure can be used as the display unit 411. That is, the head mounted display according to this example is manufactured by using the display device of the present disclosure as the display unit 411.

SPECIFIC EXAMPLE 3

Figure 31:
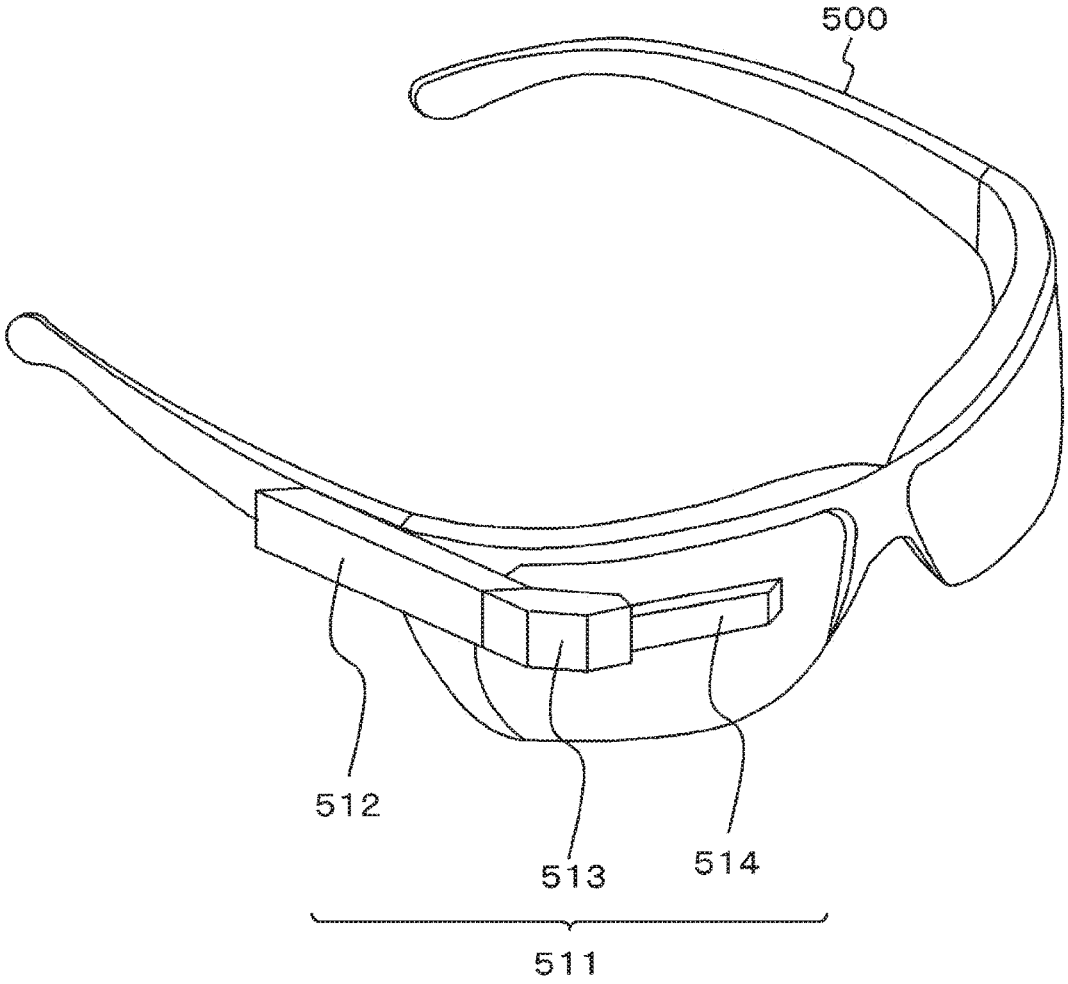
FIG. 31 is an external view of a see-through head mounted display.

FIG. 31 is an external view of a see-through head mounted display. A see-through head mounted display 511 includes a body part 512, an arm 513, and a lens barrel 514.

The body part 512 is connected to the arm 513 and eyeglasses 500. Specifically, an end portion in a long side direction of the body part 512 is coupled to the arm 513, and one side surface of the body part 512 is connected to the eyeglasses 500 via a connection member. Note that, the body part 512 may be directly mounted to the head of a human body.

The body part 512 incorporates a control board for controlling operation of the see-through head mounted display 511 and a display unit. The arm 513 connects the body part 512 and the lens barrel 514 together, and supports the lens barrel 514. Specifically, the arm 513 is coupled to each of the end portion of the body part 512 and an end portion of the lens barrel 514, and fixes the lens barrel 514. In addition, the arm 513 incorporates a signal line for communicating data related to an image provided from the body part 512 to the lens barrel 514.

The lens barrel 514 projects image light provided from the body part 512 via the arm 513 toward eyes of a user wearing the see-through head mounted display 511 through an eyepiece. In the see-through head mounted display 511, the display device of the present disclosure can be used for the display unit of the body part 512.

Note that, the technology of the present disclosure can also adopt the following configuration.

[1]

A method for driving a display element including:

in driving a display element including an n-channel drive transistor in which a voltage is applied to one source/drain region and a light-emitting unit is connected to another source/drain region, and a capacitor connected between a gate electrode of the drive transistor and the other source/drain region, performing threshold voltage cancellation processing that applies a drive voltage to the one source/drain region in a state where a reference voltage is applied to the gate electrode of the drive transistor, to bring a potential of the other source/drain region closer to a potential obtained by subtracting a threshold voltage of the drive transistor from the reference voltage;

subsequently, setting the gate electrode of the drive transistor in a floating state, and changing a potential of the gate electrode in the floating state via parasitic capacitance and causing a current to flow via the drive transistor to increase a voltage between the other source/drain region and the gate electrode, and then applying the reference voltage to the gate electrode of the drive transistor;

afterwards, performing write processing that applies a video signal voltage to the gate electrode of the drive transistor; and subsequently, setting the gate electrode of the drive transistor in the floating state to cause the light-emitting unit to emit light.

[2]

The method for driving a display element according to [1], in which the threshold voltage cancellation processing is performed to apply a first drive voltage to the one source/drain region in the state where the reference voltage is applied to the gate electrode of the drive transistor, to bring the potential of the other source/drain region closer to the potential obtained by subtracting the threshold voltage of the drive transistor from the reference voltage, and subsequently, the gate electrode of the drive transistor is set in the floating state and the voltage of the one source/drain region of the drive transistor is switched to a second drive voltage exceeding the first drive voltage, to change the potential of the gate electrode in the floating state via the parasitic capacitance and cause the current to flow via the drive transistor, to increase the voltage between the other source/drain region and the gate electrode, and then the reference voltage is applied to the gate electrode of the drive transistor.

[3]

The method for driving a display element according to [2], in which before the threshold voltage cancellation processing, the potential of the other source/drain region is initialized by switching the voltage applied to the one source/drain region of the drive transistor from the second drive voltage to an initialization voltage.

[4]

The method for driving a display element according to [3], in which the initialization voltage is a voltage set to a predetermined value lower than a voltage obtained by subtracting the threshold voltage of the drive transistor from the reference voltage.

[5]

The method for driving a display element according to any of [2] to [4], in which the display element further includes a write transistor connected to the gate electrode of the drive transistor, and the video signal voltage is applied to the gate electrode of the drive transistor via the write transistor set in a conductive state.

[6]

The method for driving a display element according to [5], in which the reference voltage is applied to the gate electrode of the drive transistor via the write transistor set in the conductive state.

[7]

The method for driving a display element according to [1], in which a voltage is applied to the one source/drain region of the drive transistor via a light emission control transistor, the threshold voltage cancellation processing is performed to apply the drive voltage to the one source/drain region of the drive transistor via the light emission control transistor set in a conductive state due to application of a first control voltage to its gate electrode, in a state where the reference voltage is applied to the gate electrode of the drive transistor, to bring the potential of the other source/drain region closer to the potential obtained by subtracting the threshold voltage of the drive transistor from the reference voltage, and subsequently, the gate electrode of the drive transistor is set in the floating state and the voltage applied to the gate of the light emission control transistor is switched to a second control voltage exceeding the first control voltage, to change the potential of the gate electrode in the floating state via the parasitic capacitance and cause the current to flow via the drive transistor, to increase the voltage between the other source/drain region and the gate electrode, and then the reference voltage is applied to the gate electrode of the drive transistor.

[8]

The method for driving a display element according to [7], in which the display element further includes a write transistor connected to the gate electrode of the drive transistor, and the video signal voltage is applied to the gate electrode of the drive transistor via the write transistor set in a conductive state.

[9]

The method for driving a display element according to [8], in which before the threshold voltage cancellation processing, the light emission control transistor is set in the non-conductive state and a voltage exceeding the reference voltage is applied to the gate electrode of the drive transistor and subsequently the reference voltage is applied, to initialize the potential of the other source/drain region of the drive transistor.

[10]

The method for driving a display element according to [8], in which the voltage exceeding the reference voltage and the reference voltage are applied to the gate electrode of the drive transistor via the write transistor set in the conductive state.

[11]

The method for driving a display element according to any of [1] to [10], in which the potential of the other source/drain region of the drive transistor changes due to the current flowing through the drive transistor, in the write processing.

[12]

The method for driving a display element according to any of [1] to [11], in which the light-emitting unit includes a current drive type electro-optical element whose light emission luminance varies in accordance with a value of a current flowing.

[13]

The method for driving a display element according to [12], in which the light-emitting unit is an organic electroluminescence element.

[14]

A display device including:

a display unit in which a display element is disposed, the display element including an n-channel drive transistor in which a voltage is applied to one source/drain region and a light-emitting unit is connected to another source/drain region, and a capacitor connected between a gate electrode of the drive transistor and the other source/drain region; and a drive unit that drives the display unit, in which the drive unit performs threshold voltage cancellation processing that applies a drive voltage to the one source/drain region in a state where a reference voltage is applied to the gate electrode of the drive transistor, to bring a potential of the other source/drain region closer to a potential obtained by subtracting a threshold voltage of the drive transistor from the reference voltage, subsequently, sets the gate electrode of the drive transistor in a floating state, and changes a potential of the gate electrode in the floating state via the parasitic capacitance and causes a current to flow via the drive transistor to increase a voltage between the other source/drain region and the gate electrode, and then applies the reference voltage to the gate electrode of the drive transistor, afterwards, performs write processing that applies a video signal voltage to the gate electrode of the drive transistor, and subsequently, sets the gate electrode of the drive transistor in the floating state to cause the light-emitting unit to emit light.

[15]

The display device according to [14], in which the threshold voltage cancellation processing is performed to apply a first drive voltage to the one source/drain region in the state where the reference voltage is applied to the gate electrode of the drive transistor, to bring the potential of the other source/drain region closer to the potential obtained by subtracting the threshold voltage of the drive transistor from the reference voltage, and subsequently, the gate electrode of the drive transistor is set in the floating state and the voltage of the one source/drain region of the drive transistor is switched to a second drive voltage exceeding the first drive voltage, to change the potential of the gate electrode in the floating state via the parasitic capacitance and cause the current to flow via the drive transistor, to increase the voltage between the other source/drain region and the gate electrode, and then the reference voltage is applied to the gate electrode of the drive transistor.

[16]

The display device according to [15], in which before the threshold voltage cancellation processing, the potential of the other source/drain region is initialized by switching the voltage applied to the one source/drain region of the drive transistor from the second drive voltage to an initialization voltage.

[17]

The display device according to [16], in which the initialization voltage is a voltage set to a predetermined value lower than a voltage obtained by subtracting the threshold voltage of the drive transistor from the reference voltage.

[18]

The display device according to any of [15] to [17], in which the display element further includes a write transistor connected to the gate electrode of the drive transistor, and the video signal voltage is applied to the gate electrode of the drive transistor via the write transistor set in a conductive state.

[19]

The display device according to [18], in which the reference voltage is applied to the gate electrode of the drive transistor via the write transistor set in the conductive state.

[20]

The display device according to [14], in which a voltage is applied to the one source/drain region of the drive transistor via a light emission control transistor, the threshold voltage cancellation processing is performed to apply the drive voltage to the one source/drain region of the drive transistor via the light emission control transistor set in a conductive state due to application of a first control voltage to its gate electrode, in a state where the reference voltage is applied to the gate electrode of the drive transistor, to bring the potential of the other source/drain region closer to the potential obtained by subtracting the threshold voltage of the drive transistor from the reference voltage, and subsequently, the gate electrode of the drive transistor is set in the floating state and the voltage applied to the gate of the light emission control transistor is switched to a second control voltage exceeding the first control voltage, to change the potential of the gate electrode in the floating state via the parasitic capacitance and cause the current to flow via the drive transistor, to increase the voltage between the other source/drain region and the gate electrode, and then the reference voltage is applied to the gate electrode of the drive transistor.

[21]

The display device according to [20], in which the display element further includes a write transistor connected to the gate electrode of the drive transistor, and the video signal voltage is applied to the gate electrode of the drive transistor via the write transistor set in a conductive state.

[22]

The display device according to [21], in which before the threshold voltage cancellation processing, the light emission control transistor is set in the non-conductive state and a voltage exceeding the reference voltage is applied to the gate electrode of the drive transistor and subsequently the reference voltage is applied, to initialize the potential of the other source/drain region of the drive transistor.

[23]

The display device according to [21], in which the voltage exceeding the reference voltage and the reference voltage are applied to the gate electrode of the drive transistor via the write transistor set in the conductive state.

[24]

The display device according to any of [14] to [23], in which the potential of the other source/drain region of the drive transistor changes due to the current flowing through the drive transistor, in the write processing.

[25]

The display device according to any of [14] to [24], in which the light-emitting unit includes a current drive type electro-optical element whose light emission luminance varies in accordance with a value of a current flowing.

[26]

The display device according to [25], in which the light-emitting unit is an organic electroluminescence element.

[27]

An electronic device including a display device, in which the display device includes:

a display unit in which a display element is disposed, the display element including an n-channel drive transistor in which a voltage is applied to one source/drain region and a light-emitting unit is connected to another source/drain region, and a capacitor connected between a gate electrode of the drive transistor and the other source/drain region; and a drive unit that drives the display unit, in which the drive unit performs threshold voltage cancellation processing that applies a drive voltage to the one source/drain region in a state where a reference voltage is applied to the gate electrode of the drive transistor, to bring a potential of the other source/drain region closer to a potential obtained by subtracting a threshold voltage of the drive transistor from the reference voltage, subsequently, sets the gate electrode of the drive transistor in a floating state, and changes a potential of the gate electrode in the floating state via the parasitic capacitance and causes a current to flow via the drive transistor to increase a voltage between the other source/drain region and the gate electrode, and then applies the reference voltage to the gate electrode of the drive transistor, afterwards, performs write processing that applies a video signal voltage to the gate electrode of the drive transistor, and subsequently, sets the gate electrode of the drive transistor in the floating state to cause the light-emitting unit to emit light.

[28]

The electronic device according to [27], in which the threshold voltage cancellation processing is performed to apply a first drive voltage to the one source/drain region in the state where the reference voltage is applied to the gate electrode of the drive transistor, to bring the potential of the other source/drain region closer to the potential obtained by subtracting the threshold voltage of the drive transistor from the reference voltage, and subsequently, the gate electrode of the drive transistor is set in the floating state and the voltage of the one source/drain region of the drive transistor is switched to a second drive voltage exceeding the first drive voltage, to change the potential of the gate electrode in the floating state via the parasitic capacitance and cause the current to flow via the drive transistor, to increase the voltage between the other source/drain region and the gate electrode, and then the reference voltage is applied to the gate electrode of the drive transistor.

[29]

The electronic device according to [28], in which before the threshold voltage cancellation processing, the potential of the other source/drain region is initialized by switching the voltage applied to the one source/drain region of the drive transistor from the second drive voltage to an initialization voltage.

[30]

The electronic device according to [29], in which the initialization voltage is a voltage set to a predetermined value lower than a voltage obtained by subtracting the threshold voltage of the drive transistor from the reference voltage.

[31]

The electronic device according to any of [28] to [30], in which the display element further includes a write transistor connected to the gate electrode of the drive transistor, and the video signal voltage is applied to the gate electrode of the drive transistor via the write transistor set in a conductive state.

[32]

The electronic device according to [31], in which the reference voltage is applied to the gate electrode of the drive transistor via the write transistor set in the conductive state.

[33]

The electronic device according to [27], in which a voltage is applied to the one source/drain region of the drive transistor via a light emission control transistor, the threshold voltage cancellation processing is performed to apply the drive voltage to the one source/drain region of the drive transistor via the light emission control transistor set in a conductive state due to application of a first control voltage to its gate electrode, in a state where the reference voltage is applied to the gate electrode of the drive transistor, to bring the potential of the other source/drain region closer to the potential obtained by subtracting the threshold voltage of the drive transistor from the reference voltage, and subsequently, the gate electrode of the drive transistor is set in the floating state and the voltage applied to the gate of the light emission control transistor is switched to a second control voltage exceeding the first control voltage, to change the potential of the gate electrode in the floating state via the parasitic capacitance and cause the current to flow via the drive transistor, to increase the voltage between the other source/drain region and the gate electrode, and then the reference voltage is applied to the gate electrode of the drive transistor.

[34]

The electronic device according to [33], in which the display element further includes a write transistor connected to the gate electrode of the drive transistor, and the video signal voltage is applied to the gate electrode of the drive transistor via the write transistor set in a conductive state.

[35]

The electronic device according to [34], in which before the threshold voltage cancellation processing, the light emission control transistor is set in the non-conductive state and a voltage exceeding the reference voltage is applied to the gate electrode of the drive transistor and subsequently the reference voltage is applied, to initialize the potential of the other source/drain region of the drive transistor.

[36]

The electronic device according to [34], in which the voltage exceeding the reference voltage and the reference voltage are applied to the gate electrode of the drive transistor via the write transistor set in the conductive state.

[37]

The electronic device according to any of [27] to [36], in which the potential of the other source/drain region of the drive transistor changes due to the current flowing through the drive transistor, in the write processing.

[38]

The electronic device according to any of [27] to [37], in which the light-emitting unit includes a current drive type electro-optical element whose light emission luminance varies in accordance with a value of a current flowing.

[39]

The electronic device according to [38], in which the light-emitting unit is an organic electroluminescence element.

REFERENCE SIGNS LIST

1, 1A, 1B, 1C, 1D Display device
2 Display unit
3 Display element
21 Support
22 Transparent substrate
31 Gate electrode
32 Gate insulating layer
33 Semiconductor layer
34 Channel formation region

35A One source/drain region
35B Other source/drain region
36 One electrode
37 Other electrode
38, 39 Wiring line
40 Interlayer insulating layer
51 Anode electrode
52 Hole transporting layer, light emitting layer, and electron transporting layer
53 Cathode electrode
54 Second interlayer insulating layer
55, 56 Contact hole
100 Power supply unit
101 Scanning unit
102 Data driver
103 First node initialization circuit
104 Light emission control unit
105 Second node initialization circuit
SCL Scanning line
DTL Data line
PS1 Feeder line
PS2 Common feeder line
CL Light emission control line
AZ1 First node initialization control line
AZ2 Second node initialization control line
$TR_W$ Write transistor
$TR_D$ Drive transistor
$TR_1$ First node initialization transistor
$TR_2$ Second node initialization transistor
$TR_{EL_C}$ Light emission control transistor
$C_S$ Capacitor
ELP Organic electroluminescence light-emitting unit
$C_{EL}$ Capacity of light-emitting unit ELP
$ND_1$ First node
$ND_2$ Second node
311 Camera body part
312 Photographing lens unit
313 Grip part
314 Monitor
315 Viewfinder
500 Eyeglasses
511 See-through head mounted display
512 Body part
513 Arm
514 Lens barrel

The invention claimed is:

1. A method for driving a display element, the method comprising:

in driving the display element including an n-channel drive transistor in which a voltage is applied to one source/drain region and a light-emitting unit is connected to another source/drain region, and a capacitor connected between a gate electrode of the n-channel drive transistor and the other source/drain region, performing threshold voltage cancellation processing that applies a drive voltage to the one source/drain region in a state where a reference voltage is applied to the gate electrode of the n-channel drive transistor, to bring a potential of the other source/drain region closer to a potential obtained by subtracting a threshold voltage of the n-channel drive transistor from the reference voltage;

subsequently, setting the gate electrode of the n-channel drive transistor in a floating state, and changing a potential of the gate electrode in the floating state via a parasitic capacitance and causing a current to flow via the n-channel drive transistor to increase a voltage between the other source/drain region and the gate electrode, and then applying the reference voltage to the gate electrode of the n-channel drive transistor;

afterwards, performing write processing that applies a video signal voltage to the gate electrode of the n-channel drive transistor; and subsequently, setting the gate electrode of the n-channel drive transistor in the floating state to cause the light-emitting unit to emit light.

2. The method for driving the display element according to claim 1, wherein the threshold voltage cancellation processing is performed to apply a first drive voltage to the one source/drain region in the state where the reference voltage is applied to the gate electrode of the n-channel drive transistor, to bring the potential of the other source/drain region closer to the potential obtained by subtracting the threshold voltage of the n-channel drive transistor from the reference voltage, and subsequently, the gate electrode of the n-channel drive transistor is set in the floating state and the voltage of the one source/drain region of the n-channel drive transistor is switched to a second drive voltage exceeding the first drive voltage, to change the potential of the gate electrode in the floating state via the parasitic capacitance and cause the current to flow via the n-channel drive transistor, to increase the voltage between the other source/drain region and the gate electrode, and then the reference voltage is applied to the gate electrode of the n-channel drive transistor.

3. The method for driving the display element according to claim 2, wherein before the threshold voltage cancellation processing, the potential of the other source/drain region is initialized by switching the voltage applied to the one source/drain region of the n-channel drive transistor from the second drive voltage to an initialization voltage.

4. The method for driving the display element according to claim 3, wherein the initialization voltage is a voltage set to a predetermined value lower than a voltage obtained by subtracting the threshold voltage of the n-channel drive transistor from the reference voltage.

5. The method for driving the display element according to claim 2, wherein the display element further includes a write transistor connected to the gate electrode of the n-channel drive transistor, and the video signal voltage is applied to the gate electrode of the n-channel drive transistor via the write transistor set in a conductive state.

6. The method for driving the display element according to claim 5, wherein the reference voltage is applied to the gate electrode of the n-channel drive transistor via the write transistor set in the conductive state.

7. The method for driving the display element according to claim 1, wherein the voltage is applied to the one source/drain region of the n-channel drive transistor via a light emission control transistor, the threshold voltage cancellation processing is performed to apply the drive voltage to the one source/drain region of the n-channel drive transistor via the light emission control transistor set in a conductive state due to application of a first control voltage to the gate electrode of the n-channel drive transistor, in the state where the reference voltage is applied to the gate electrode of the n-channel drive transistor, to bring the potential of the other source/drain region closer to the potential obtained by subtracting the threshold voltage of the n-channel drive transistor from the reference voltage, and subsequently, the gate electrode of the n-channel drive transistor is set in the floating state and the voltage applied to a gate of the light emission control transistor is switched to a second control voltage exceeding the first control voltage, to change the potential of the gate electrode in the floating state via the parasitic capacitance and cause the current to flow via the n-channel drive transistor, to increase the voltage between the other source/drain region and the gate electrode, and then the reference voltage is applied to the gate electrode of the n-channel drive transistor.

8. The method for driving the display element according to claim 7, wherein the display element further includes a write transistor connected to the gate electrode of the n-channel drive transistor, and the video signal voltage is applied to the gate electrode of the n-channel drive transistor via the write transistor set in the conductive state.

9. The method for driving the display element according to claim 8, wherein before the threshold voltage cancellation processing, the light emission control transistor is set in a non-conductive state and a voltage exceeding the reference voltage is applied to the gate electrode of the n-channel drive transistor and subsequently the reference voltage is applied, to initialize the potential of the other source/drain region of the n-channel drive transistor.

10. The method for driving the display element according to claim 8, wherein the voltage exceeding the reference voltage and the reference voltage are applied to the gate electrode of the n-channel drive transistor via the write transistor set in the conductive state.

11. The method for driving the display element according to claim 1, wherein the potential of the other source/drain region of the n-channel drive transistor changes due to the current flowing through the n-channel drive transistor, in the write processing.

12. The method for driving the display element according to claim 1, wherein the light-emitting unit includes a current drive type electro-optical element whose light emission luminance varies in accordance with a value of the current flowing through the n-channel drive transistor.

13. The method for driving the display element according to claim 12, wherein the light-emitting unit is an organic electroluminescence element.

14. A display device, comprising:

a display unit in which a display element is disposed, the display element including an n-channel drive transistor in which a voltage is applied to one source/drain region and a light-emitting unit is connected to another source/drain region, and a capacitor connected between a gate electrode of the n-channel drive transistor and the other source/drain region; and a drive unit that drives the display unit, wherein the drive unit performs threshold voltage cancellation processing that applies a drive voltage to the one source/drain region in a state where a reference voltage is applied to the gate electrode of the n-channel drive transistor, to bring a potential of the other source/drain region closer to a potential obtained by subtracting a threshold voltage of the n-channel drive transistor from the reference voltage, subsequently, sets the gate electrode of the n-channel drive transistor in a floating state, and changes a potential of the gate electrode in the floating state via a parasitic capacitance and causes a current to flow via the n-channel drive transistor to increase a voltage between the other source/drain region and the gate electrode, and then applies the reference voltage to the gate electrode of the n-channel drive transistor, afterwards, performs write processing that applies a video signal voltage to the gate electrode of the n-channel drive transistor, and subsequently, sets the gate electrode of the n-channel drive transistor in the floating state to cause the light-emitting unit to emit light.

15. An electronic device comprising:

a display device, wherein the display device includes:

a display unit in which a display element is disposed, the display element including an n-channel drive transistor in which a voltage is applied to one source/drain region and a light-emitting unit is connected to another source/drain region, and a capacitor connected between a gate electrode of the n-channel drive transistor and the other source/drain region; and a drive unit that drives the display unit, wherein the drive unit performs threshold voltage cancellation processing that applies a drive voltage to the one source/drain region in a state where a reference voltage is applied to the gate electrode of the n-channel drive transistor, to bring a potential of the other source/drain region closer to a potential obtained by subtracting a threshold voltage of the n-channel drive transistor from the reference voltage, subsequently, sets the gate electrode of the n-channel drive transistor in a floating state, and changes a potential of the gate electrode in the floating state via a parasitic capacitance and causes a current to flow via the n-channel drive transistor to increase a voltage between the other source/drain region and the gate electrode, and then applies the reference voltage to the gate electrode of the n-channel drive transistor, afterwards, performs write processing that applies a video signal voltage to the gate electrode of the n-channel drive transistor, and subsequently, sets the gate electrode of the n-channel drive transistor in the floating state to cause the light-emitting unit to emit light.

* * * * *